US005447835A

United States Patent [19]

Sakai et al.

[11] Patent Number: 5,447,835

[45] Date of Patent: Sep. 5, 1995

[54] SILVER HALIDE PHOTOGRAPHIC MATERIAL CONTAINING HYDRAZINE COMPOUNDS

[75] Inventors: Minoru Sakai; Kazunobu Katoh; Hisashi Okamura; Kazumi Nii, all of Kanagawa, Japan

[73] Assignee: Fuji Photo Film Co., Ltd., Kanagawa, Japan

[21] Appl. No.: 167,219

[22] Filed: Dec. 16, 1993

Related U.S. Application Data

[63] Continuation of Ser. No. 876,379, Apr. 30, 1992, abandoned.

[30] Foreign Application Priority Data

May 2, 1991 [JP] Japan ..... 3-12812

[51] Int. Cl.[6] ..... G03C 1/08

[52] U.S. Cl. ..... 430/598; 430/223; 430/264; 430/436; 430/957

[58] Field of Search ..... 430/223, 264, 436, 598, 430/957

[56] References Cited

U.S. PATENT DOCUMENTS

| | | | |
|---|---|---|---|
| 4,272,606 | 6/1981 | Mifune et al. | 430/264 |
| 4,684,604 | 8/1987 | Harder | 430/375 |
| 4,824,764 | 4/1989 | Inagawa et al. | 430/264 |
| 5,030,542 | 7/1991 | Nakamura et al. | 430/598 |
| 5,085,971 | 2/1992 | Katoh et al. | 430/957 |
| 5,124,231 | 6/1992 | Sakai et al. | 430/264 |
| 5,155,006 | 10/1992 | Goto et al. | 430/264 |

FOREIGN PATENT DOCUMENTS

| | | | |
|---|---|---|---|
| 0286062 | 10/1988 | European Pat. Off. | 430/598 |
| 0393711 | 10/1990 | European Pat. Off. . | |
| 0420005 | 4/1991 | European Pat. Off. . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

Disclosed is a silver halide photographic material comprising a support having thereon a silver halide emulsion layer containing at least one nucleating agent represented by general formula (N-1) shown below. The silver halide photographic material contains at least one compound represented by general formula (Q-2) shown below in the above described silver halide emulsion layer and/or in a hydrophilic colloid layer adjacent thereto which does not contain a silver halide emulsion:

(N-1)

(Q-2)

The variable terms in the above formulas are defined in the specification. The silver halide photographic material is suitable for plate making and provides a high contrast image even when using a highly stable developing solution.

22 Claims, No Drawings

SILVER HALIDE PHOTOGRAPHIC MATERIAL CONTAINING HYDRAZINE COMPOUNDS

This is a continuation of application Ser. No. 07/876,379 filed Apr. 30, 1992, now abandoned.

FIELD OF THE INVENTION

The present invention relates to a silver halide photographic material and a method of forming a superhigh contrast negative image using such a material. More particularly, the invention relates to a silver halide photographic material containing both a compound capable of utilizing a photographically useful group during a development processing step and a compound which makes full use of the above compound.

BACKGROUND OF THE INVENTION

In the field of photomechanical processes using silver halide photographic materials, there is a demand for photographic light-sensitive materials having satisfactory image reproducibility of originals, stability of processing solutions, and simplification of the replenishment system, in order to cope with the recent diversity and complexity of printed materials.

In particular, originals in line work are comprised of photo-composed letters, hand-written letters, illustrations, and dot prints, and thus contain images having different densities or line widths. There has therefore been a demand for a process camera, photographic light-sensitive material or image formation system which enables one to reproduce the original with good reproducibility. In the photomechanical processing of catalogues or large posters, on the other hand, enlargement (spread) or reduction (choke) of a dot print is often required. When a dot print is enlarged in plate making, the line number becomes small and the dots are blurred. When a dot print is reduced, the line number/inch ratio becomes larger and the dots become finer than in the original. Accordingly, an image formation system having a broader latitude is needed to maintain reproducibility of dot gradation.

A halogen lamp or a xenon lamp is employed as a light source of a process camera. In order to obtain photographic sensitivity to these light sources, photographic materials are usually subjected to orthochromatic sensitization. However, orthochromatic photographic materials are more susceptible to the influences of chromatic aberration of the lens and thus susceptible to image quality deterioration. The deterioration is conspicuous when a xenon lamp is used as a light source.

Known systems meeting the demand for a broad latitude include a method in which a lith type silver halide light-sensitive material containing silver chlorobromide (containing at least 50% of silver chloride) is processed with a hydroquinone developing solution having an extremely low effective sulfite ion concentration (usually 0.1 mol/l or less) to thereby obtain a line or dot image having high contrast and high blackening density in which image areas and non-image areas are clearly distinguished. According to this method, however, development is extremely unstable against air oxidation due to the low sulfite concentration of the developing solution. Hence, various efforts and devices are required to stabilize developing activity, and the processing speed is quite slow, reducing working efficiency.

There has thus been a demand for an image formation system which eliminates the image formation instability associated with the above-described lith development system and provides a superhigh contrast image by using a processing solution having a satisfactory preservation stability. In this connection, it has been proposed to process a surface latent image type silver halide photographic material containing a specific acylhydrazine compound with a developing solution having a pH between 11.0 and 12.3 and containing at least 0.15 mol/l of a sulfite preservative (thereby exhibiting satisfactory preservation stability) to form a superhigh contrast negative image having a gamma exceeding 10, as disclosed in U.S. Pat. Nos. 4,166,742, 4,168,977, 4,221,857, 4,224,401, 4,243,739, 4,272,606, and 4,311,781. In this new image formation system, silver iodobromide and silver chloroiodobromide as well as silver chlorobromide may be used, whereas the conventional superhigh contrast image formation systems are applicable only to photographic materials comprising silver chlorobromide having a high silver chloride content.

While the above-described image formation system exhibits excellent values in dot quality, stability of processing, rapidness of processing, and reproducibility of originals, a system which provides further improved reproducibility of originals is needed to cope with the recent diversity of printed materials.

In an attempt to improve image quality, a method using a redox compound having a carbonyl group which is capable of imagewise releasing a development inhibitor is known as disclosed, for example, in JP-A-61-213847 (the term "JP-A" as used herein means an "unexamined published Japanese patent application"). However, extension of dot gradation is insufficient, even with these compounds.

There is therefore a need for a light-sensitive material which forms a high contrast dot image using a stable developing solution and whose tone is controllable over a wide range.

On the other hand, improvement in working efficiency in page make-up and dot-to-dot work (a so-called contact work) has been attempted by performing the work in a brighter environment. Accordingly, light-sensitive materials for plate making which can be handled in a bright room environment and exposure printers for these materials have been developed.

The term "light-sensitive material for a bright room" as used herein means a light-sensitive material which can be safely handled for a long time with a safe light which includes no ultraviolet light component and has a wavelength of substantially 400 nm or more.

A light-sensitive material for a bright room which can be used in page make-up and in contact work, may be exposed to light while in intimate contact with a developed film having a letter or dot image (i.e., original) to effect negative-positive or positive-positive conversion. The light-sensitive material should (A) have the ability to perform negative-positive conversion of a dot image or a line or letter image according to the dot area or the line or letter image width of the original, and (B) have an ability to control the tone of the dot image or the width of the letter or line image. Light-sensitive materials for bright room contact work which meet these requirements have been provided.

However, when a conventional light-sensitive material for a bright room is used in bright room contact work in the highly technical image conversion operation called superimposed letter image formation by contact work, the resulting superimposed letter image is poor in quality as compared to that obtained by the technique involving dark room contact work using a conventional light-sensitive material for dark room contact work.

The method of superimposed letter image formation by contact work is illustrated in detail by reference to FIG. 1 of JP-A-2-293736. A film (2) having a letter or line image shown in black (i.e., the line original) and a film (4) having a dot image shown in black (i.e., the dot original) are adhered to transparent or translucent bases (1) and (3), respectively. Bases (1) and (3) are usually polyethylene terephthalate films having a thickness of about 100 μm. The line original and the dot original are superposed on each other to make an original. The emulsion layer of a light-sensitive material (5) for contact work is brought into contact with the dot original (4) and then exposed to light. The exposed light-sensitive material is then subjected to development processing to form a white line image within a dot image.

It is important in the above-described superimposed letter image formation that the negative-positive conversion be conducted precisely according to the dot area of the dot original and the line width of the line original. As is apparent from the Figure, the dot original (4) is in intimate contact with the emulsion layer of the light-sensitive material (5). On the other hand, line original (2) is not directly superposed on light-sensitive material (5). Rather the base (3) and dot original (4) are interposed therebetween. Therefore, when the light-sensitive material (5) is exposed to light at an exposure amount sufficient to effect negative-positive conversion faithfully to the dot original, the exposure through the line original is through base (3) and dot original (4), causing a reduction of the line width of the transparent line image. This causes deterioration of the superimposed letter image quality.

In order to solve the above problem, systems using a hydrazine derivative have been proposed as disclosed in JP-A-62-80640, JP-A-62-235938, JP-A-62-235939, JP-A-63-104046, JP-A-63-103235, JP-A-63-296031, JP-A-63-314541 and JP-A-64-13545, but sufficient effects have not yet been obtained, leaving a need for further improvements.

Additionally, systems using redox compounds which release a development inhibitor upon oxidation together with the hydrazine derivative are disclosed, for example, in JP-A-61-213847, JP-A-64-72140, JP-A-2-285340, JP-A-3-87733, JP-A-293736, JP-A-2-308239 and JP-A-3-110544.

As described above, by using a nucleating agent and a redox compound capable of releasing a development inhibitor upon oxidation, dot image reproducibility in terms of spread and choke is improved. The image quality of fine line or a transparent part of fine line is improved with respect to light-sensitive materials for photographing. Moreover, the improvement in image quality with respect to the requirements (A) and (B) described above is achieved for light-sensitive materials for contact work.

However, with light-sensitive materials containing a nucleating agent, there is the disadvantage that black peppers are formed, particularly when a developing solution which is fatigued upon oxidation by air is employed. Thus, one cannot take advantage of the features of the light-sensitive materials. Therefore, various methods for reducing the occurrence of black peppers have been investigated. For instance, a method wherein a trihydroxybenzene derivative is incorporated into a light-sensitive material is described in JP-A-2-310555, and a method wherein a hydroquinone derivative is incorporated into a light-sensitive material is described in Japanese Patent Application No. 2-127480. However, these methods have the disadvantage that the effect for restraining black peppers is decreased or that the occurrence of black peppers is rather promoted during the preservation of light-sensitive materials containing these compounds. Thus these methods are not yet satisfactory, and further improvement is needed.

SUMMARY OF THE INVENTION

Therefore, an object of the present invention is to provide a light-sensitive material for photomechanical process which provides a high contrast image using a highly stable developing solution.

Another object of the present invention is to provide a light-sensitive material for photomechanical process which is excellent in image quality in terms of spread, chock, copy dot and fine line reproducibility properties and has reduced black peppers.

Other objects of the present invention will become apparent from the following detailed description and examples.

These objects of the present invention are accomplished by a silver halide photographic material comprising a support having thereon a silver halide emulsion layer containing at least one nucleating agent represented by general formula (N-1) shown below, wherein the silver halide photographic material contains at least one compound represented by general formula (Q-1) or (Q-2) shown below in the above described silver halide emulsion layer and/or in a hydrophilic colloid layer adjacent thereto which does not contain a silver halide emulsion:

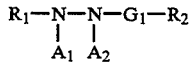

(N-1)

wherein $R_1$ represents an aliphatic group or an aromatic group; $R_2$ represents a hydrogen atom, an alkyl group, an aralkyl group, an aryl group, an alkoxyl group, an aryloxy group, an amino group, a hydrazino group, a carbamoyl group, or an oxycarbonyl group; $G_1$ represents

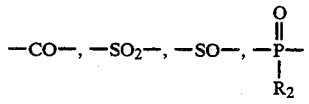

(wherein $R_2$ is as defined above),

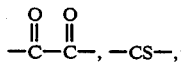

or an iminomethylene group; $A_1$ and $A_2$ each represents a hydrogen atom, or one of $A_1$ and $A_2$ represents a hydrogen atom, and the other represents a substituted or unsubstituted alkylsulfonyl group, a substituted or unsubstituted arylsulfonyl group, or a substituted or unsubstituted acyl group,

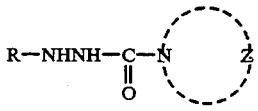

(Q-1)

wherein R represents an aliphatic group, an aromatic group or a heterocyclic group; and Z represents an atomic group necessary to form a nitrogen-containing heterocyclic aromatic group,

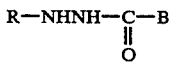

(Q-2)

wherein R represents an aliphatic group, an aromatic group or a heterocyclic group; and B represents a phenyl group or a naphthyl group.

DETAILED DESCRIPTION OF THE INVENTION

The nucleating agent represented by general formula (N-1) in the present invention is described in detail below.

In general formula (N-I), the aliphatic group represented by $R_1$ is preferably an aliphatic group containing from 1 to 30 carbon atoms, and more preferably a straight chain, branched or cyclic alkyl group having from 1 to 20 carbon atoms. The branched alkyl group may be cyclized to form a saturated heterocyclic ring containing at least one hetero atom. Further, the alkyl group may be substituted with, for example, an aryl group, an alkoxyl group, a sulfoxy group, a sulfonamido group, or a carbonamido group.

The aromatic group represented by $R_1$ in general formula (N-I) is a monocyclic or bicyclic aryl group or an unsaturated heterocyclic group. The unsaturated heterocyclic group may be condensed with a monocyclic or bicyclic aryl group to form a heteroaryl group. Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with those containing a benzene ring being particularly preferred.

$R_1$ particularly preferably represents an aryl group.

The aryl group or unsaturated heterocyclic group represented by $R_1$ may have a substituent typically including, for example, an alkyl group, an aralkyl group, an alkenyl group, an alkynyl group, an alkoxy group, an aryl group, a substituted amino group, an acylamino group, a sulfonamido group, a ureido group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a phosphonamido group, a diacylamino group, an imido group, and a

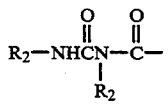

group (wherein $R_2$ is as defined above). Preferred examples of the substituents include a straight chain, branched or cyclic alkyl group (preferably having from 1 to 20 carbon atoms), an aralkyl group (preferably a monocyclic or bicyclic group having from 1 to 3 carbon atoms in the alkyl moiety thereof), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphonamido group (preferably having from 1 to 30 carbon atoms).

The alkyl group represented by $R_2$ in general formula (N-I) preferably contains from 1 to 4 carbon atoms and may have a substituent, e.g., a halogen atom, a hydroxy group, a cyano group, a carboxy group, a sulfo group, an alkoxyl group, a phenyl group, an acyl group, an alkoxycarbonyl group, an aryloxycarbonyl group, a carbamoyl group, an alkylsulfonyl group, an arylsulfonyl group, a sulfamoyl group, a nitro group, a heteroaromatic group, and a

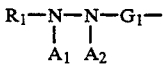

group (wherein $R_1$, $A_1$, $A_2$ and $G_1$ each is as defined above). These substituent groups may further be substituted.

The aryl group represented by $R_2$ is preferably a monocyclic or bicyclic aryl group, such as those containing a benzene ring. The aryl group may have one or more substituents including those described for the alkyl group above.

The alkoxyl group represented by $R_2$ preferably contains from 1 to 8 carbon atoms and may be substituted, for example, with a halogen atom or an aryl group.

The aryloxy group represented by $R_2$ is preferably monocyclic and may be substituted, for example, with a halogen atom.

The amino group represented by $R_2$ is preferably an unsubstituted amino group, an alkylamino group having from 1 to 10 carbon atoms, and an arylamino group. It may be substituted, for example, with an alkyl group, a halogen atom, a cyano group, a nitro group, or a carboxyl group.

The carbamoyl group represented by $R_2$ is preferably an unsubstituted carbamoyl group, an alkylcarbamoyl group having from 1 to 10 carbon atoms, and an arylcarbamoyl group. It may be substituted, for example, with an alkyl group, a halogen atom, a cyano group, or a carboxy group.

The oxycarbonyl group represented by $R_2$ is preferably an alkoxycarbonyl group having from 1 to 10 carbon atoms and an aryloxycarbonyl group. It may be substituted, for example, with an alkyl group, a halogen atom, a cyano group, or a nitro group.

When $G_1$ is a carbonyl group, $R_2$ preferably represents a hydrogen atom, an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, and 2-hydroxymethylphenyl), and more preferably a hydrogen atom.

When $G_1$ is a sulfonyl group, $R_2$ preferably represents an alkyl group (e.g., methyl), an aralkyl group (e.g., o-hydroxybenzyl), an aryl group (e.g., phenyl), or a substituted amino group (e.g., dimethylamino).

When $G_1$ is —SO—, $R_2$ preferably represents a cyanobenzyl group or a methylthiobenzyl group.

When $G_1$ is

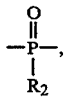

$R_2$ preferably represents methoxy group, an ethoxy group, a butoxy group, a phenoxy group, or a phenyl group, and more preferably a phenoxy group.

When $G_1$ is an N-substituted or unsubstituted iminomethylene group, $R_2$ preferably represents a methyl group, an ethyl group, or a substituted or unsubstituted phenyl group.

Substituents applicable to $R_2$ include those listed above as the substituents of $R_1$.

In general formula (N-I), $G_1$ most preferably represents —CO—.

$R_2$ may be a group which causes the $—G_1—R_2$ moiety to split off from the remainder of the compound of general formula (N-I) to induce cyclization producing a cyclic structure containing the $—G_1—R_2$ moiety. More specifically, such a group is represented by the following general formula (a):

$$—R_3—Z_1 \qquad \text{(a)}$$

wherein $Z_1$ represents a group which nucleophilically attacks $G_1$ to split the $—G_1—R_3—Z_1$ moiety from the remainder; $R_3$ represents a group derived by removing one hydrogen atom from $R_2$; and $R_3$ and $Z_1$ form a cyclic structure together with $G_1$ upon nucleophilic attack of $Z_1$ on $G_1$.

In more detail, when the hydrazine compound of general formula (N-I) undergoes any reaction such as oxidation to produce an intermediate represented by the formula of $R_1—N{=}N—G_1—R_3—Z_1$, $Z_1$ easily reacts nucleophilically with $G_1$ to split $R_1—N{=}N$ from $G_1$. Such a $Z_1$ group includes a functional group capable of directly reacting with $G_1$, e.g., —OH, —SH, $—NHR_4$ (wherein $R_4$ represents a hydrogen atom, an alkyl group, an aryl group), $—COR_5$, or $—SO_2R_5$ (wherein $R_5$ represents a hydrogen atom, an alkyl group, an aryl group, or a heterocyclic group), and —COOH (these functional groups may be temporarily protected so as to release the functional group upon hydrolysis with an alkali, etc.) and a functional group which becomes capable of reacting with $G_1$ on reacting with a nucleophilic agent (e.g., a hydroxide ion and a sulfite ion), such as

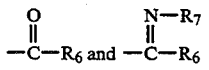

(wherein $R_6$ and $R_7$ each represents a hydrogen atom, an alkyl group, an alkenyl group, an aryl group, or a heterocyclic group).

The ring formed by $G_1$, $R_3$, and $Z_1$ is preferably a 5-membered or 6-membered ring.

Preferred among the groups represented by general formula (a) are those represented by general formula (b) below:

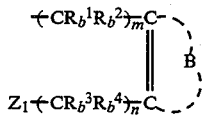

(b)

wherein $Z_1$ is as defined above; $R_b^1$, $R_b^2$, $R_b^3$, and $R_b^4$, which may be the same or different, each represents a hydrogen atom, an alkyl group (preferably having from 1 to 12 carbon atoms), an alkenyl group (preferably having from 2 to 12 carbon atoms), or an aryl group (preferably having from 6 to 12 carbon atoms); B represents an atomic group necessary to form a substituted or unsubstituted 5-membered or 6-membered ring; m and n each represents 0 or 1; and (n+m) is 1 or 2.

In general formula (b), the 5-membered or 6-membered ring formed by B includes, for example, cyclohexene, cyclopentene, benzene, naphthalene, pyridine, and quinoline rings.

Also preferred among the groups represented by general formula (a) are those represented by general formula (c) below:

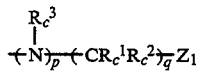

(c)

wherein $Z_1$ is as defined above; $R_c^1$ and $R_c^2$, which may be the same or different, each represents a hydrogen atom, an alkyl group, an alkenyl group, an aryl group, or a halogen atom; $R_c^3$ represents a hydrogen atom, an alkyl group, an alkenyl group, or an aryl group; p represents an integer of from 0 to 2; q represents an integer of from 1 to 4; $R_c^1$, $R_c^2$, and $R_c^3$ may be taken together to form a ring provided that $Z_1$ is capable of intramolecular nucleophilic attack on $G_1$.

$R_c^1$ and $R_c^2$ each preferably represents a hydrogen atom, a halogen atom, or an alkyl group, and $R_c^3$ preferably represents an alkyl group or an aryl group.

q preferably represents 1 to 3. When q is 1, p represents 1 or 2; when q is 2, p represents 0 or 1; when q is 3, p represents 0 or 1; and when q is 2 or 3, $CR_c^1R_c^2$ moieties may be the same or different.

In general formula (N-I), $A_1$ and $A_2$ each represents a hydrogen atom, an alkylsulfonyl or arylsulfonyl group having not more than 20 carbon atoms (preferably a phenylsulfonyl group or a phenylsulfonyl group which is substituted so that the sum of Hammett's substituent constants may be −0.5 or more), an acyl group having not more than 20 carbon atoms (preferably a benzoyl group, a benzoyl group which is substituted so that the sum of the Hammett's substituent constants is −0.5 or more), or a straight chain, branched chain or cyclic, substituted or unsubstituted aliphatic acyl group (the substituent includes a halogen atom, an ether group, a sulfonamido group, a carbonamido group, a hydroxy group, a carboxy group, and a sulfonic group)).

$A_1$ and $A_2$ each most preferably represents a hydrogen atom.

$R_1$ or $R_2$ in general formula (N-I) may contain a ballast group usually employed in immobile photographic additives such as couplers or may form a polymer. The ballast group is a group which contains at least 8 carbon atoms and is relatively inert to the photographic characteristics of the material. Suitable examples of the ballast groups include an alkyl group, an alkoxy group, a phenyl group, an alkylphenyl group, a phenoxy group, and an alkylphenoxy group. Further, suitable examples of the polymers include those described in JP-A-1-100530.

$R_1$ or $R_2$ in general formula (N-I) may further contain a group which accelerates adsorption onto the surfaces of silver halide grains (hereinafter referred to as an adsorption accelerating group). Examples of such adsorption accelerating groups include a thiourea group, a heterocyclic thioamido group, a mercapto heterocyclic group, and a triazole group as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

Examples of the nucleating agent represented by general formula (N-I) are shown below, but the present invention should not be construed as being limited thereto:

I-1)

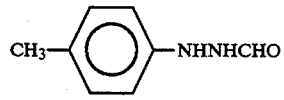

I-2)

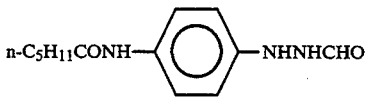

I-3)

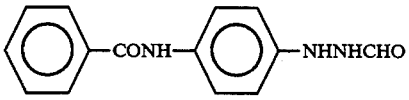

I-4)

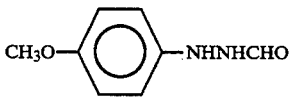

I-5)

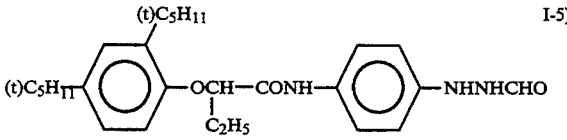

I-6)

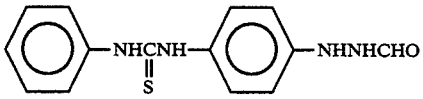

I-7)

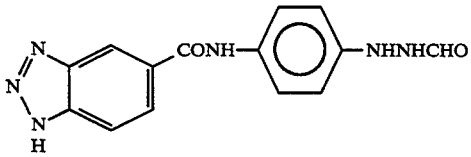

I-8)

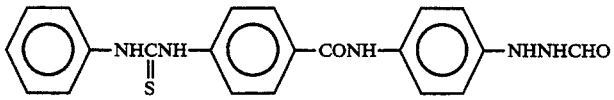

I-9)

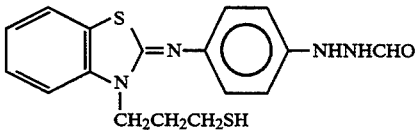

I-10)

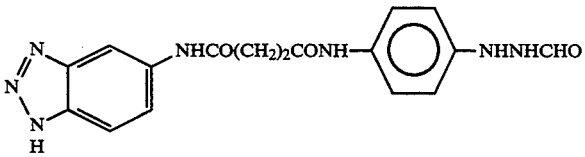

I-11)

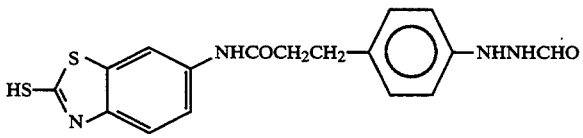

I-12)

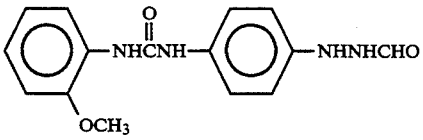

-continued
I-13)
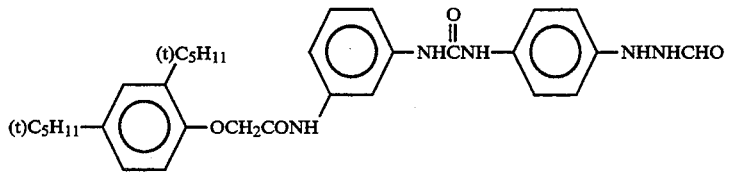
I-14)
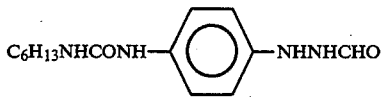
I-15)
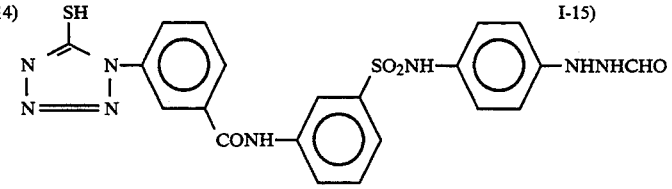
I-16)
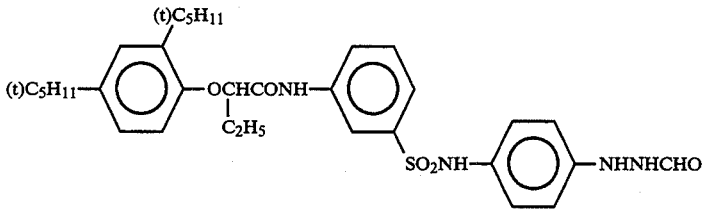
I-17)
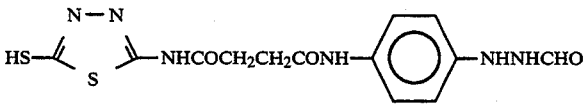
I-18)
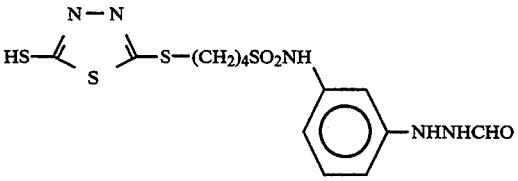
I-19)
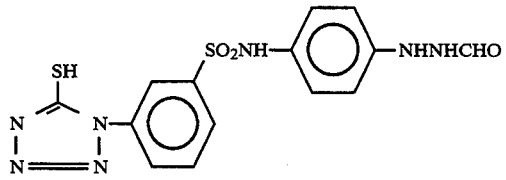
I-20)
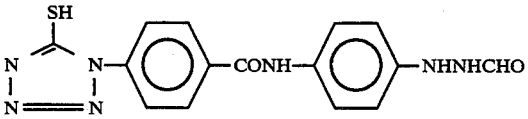
I-21)
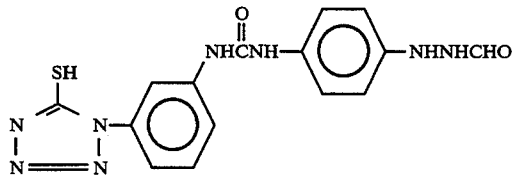
I-22)
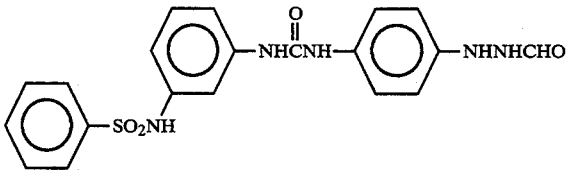
I-23)
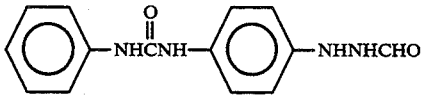
I-24)
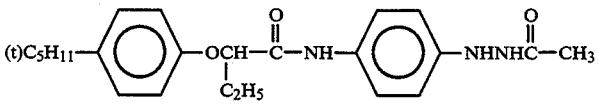

-continued
I-25)
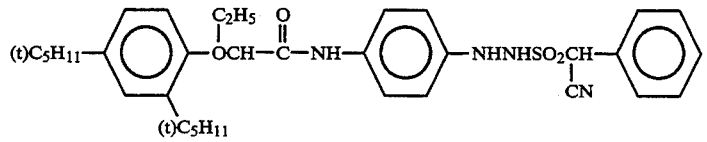
I-26)
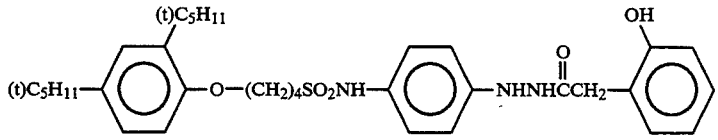
I-27)
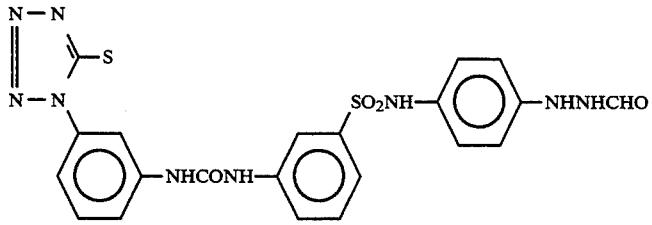
I-28)
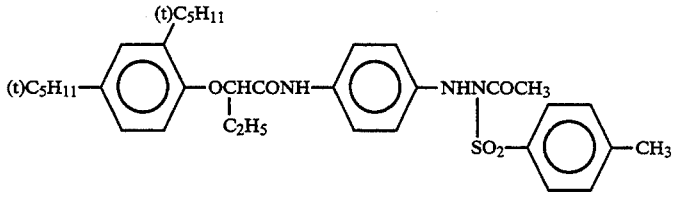
I-29)
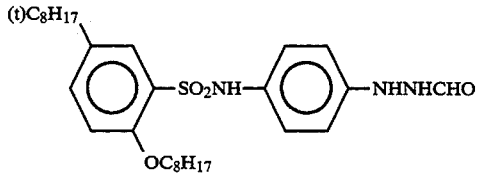
I-30)
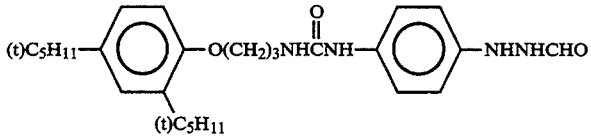
I-31)
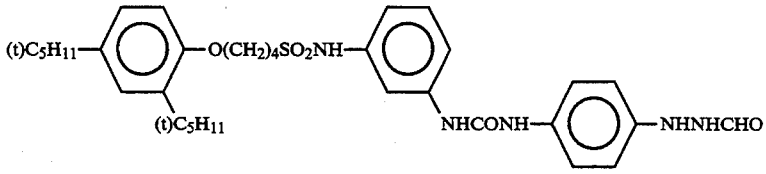
I-32)
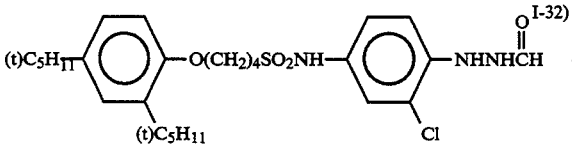
I-33)
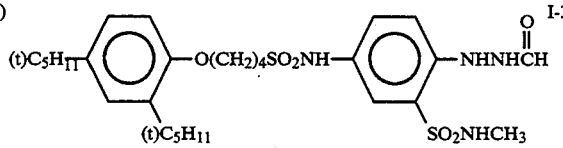
I-34)
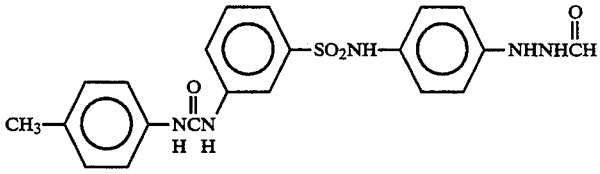

-continued
I-35)
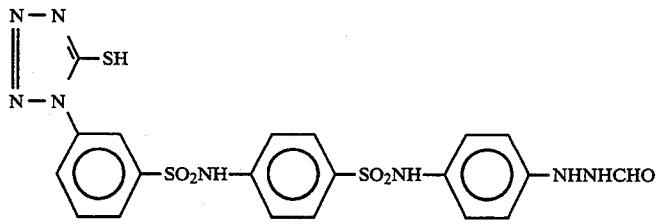
I-36)
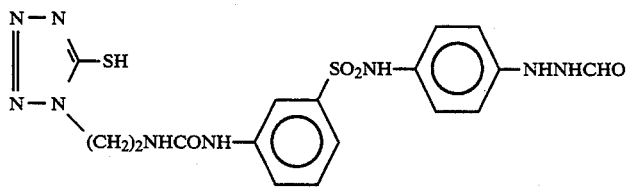
I-37)
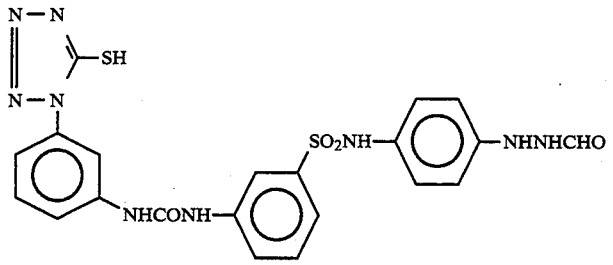
I-38)
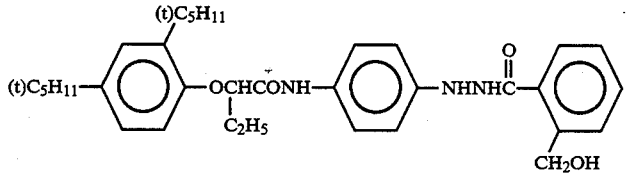
I-39)
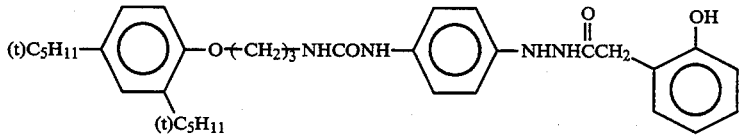
I-40)
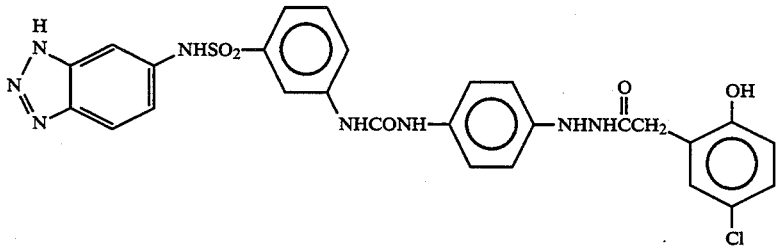
I-41)
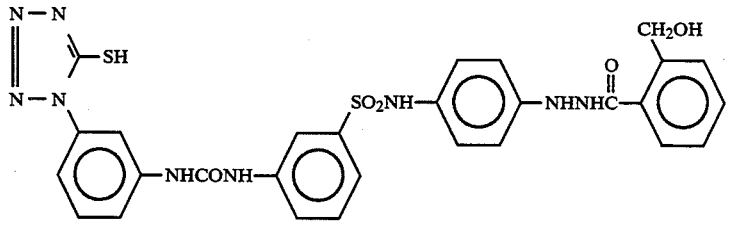

-continued
I-42)
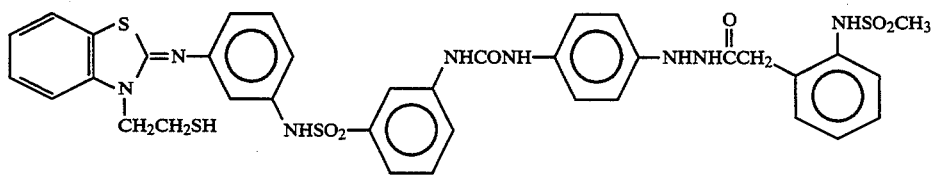
I-43)
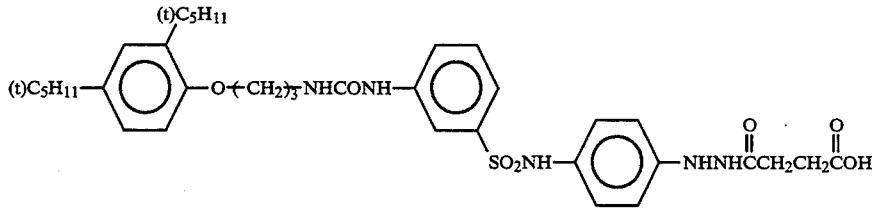
I-44)
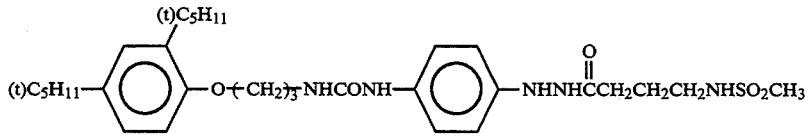
I-45)
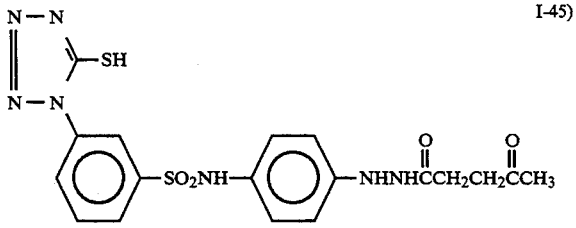
I-46)
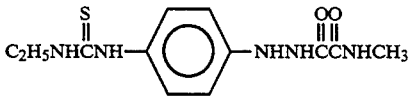
I-47)
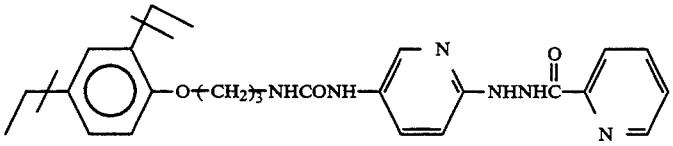
I-48)
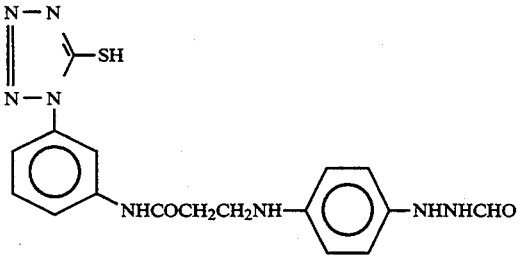
I-49)
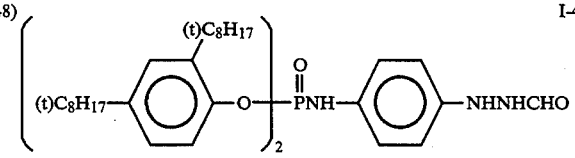
I-50)
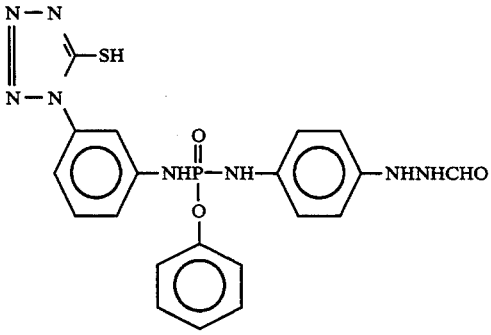

-continued
I-51)
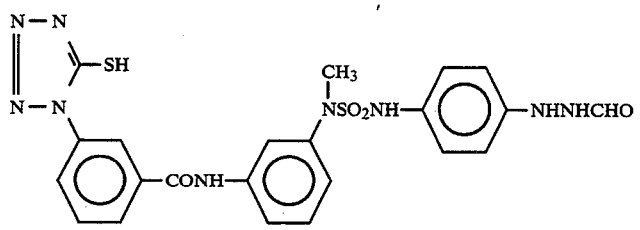
I-52)
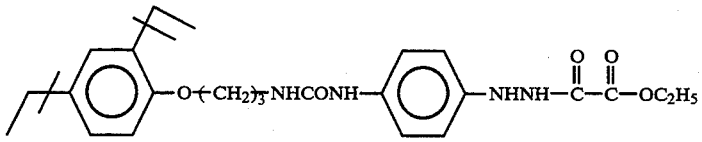
I-53)
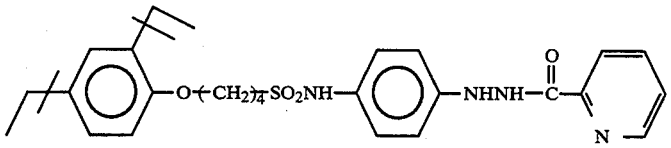
I-54)
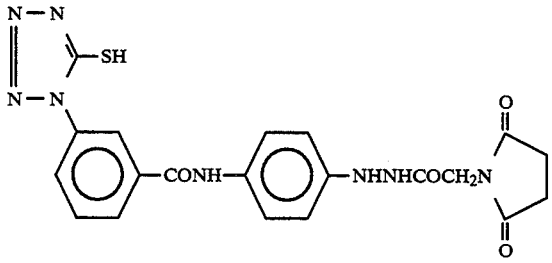
I-55)
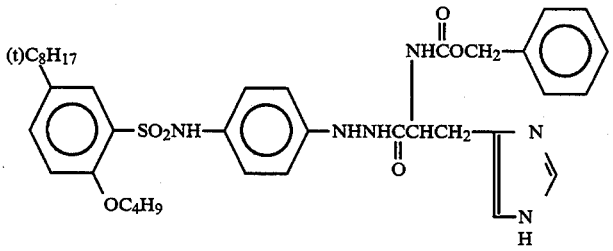
I-56)
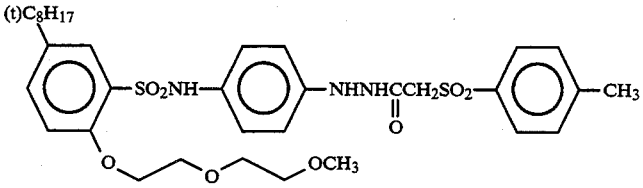
I-57)
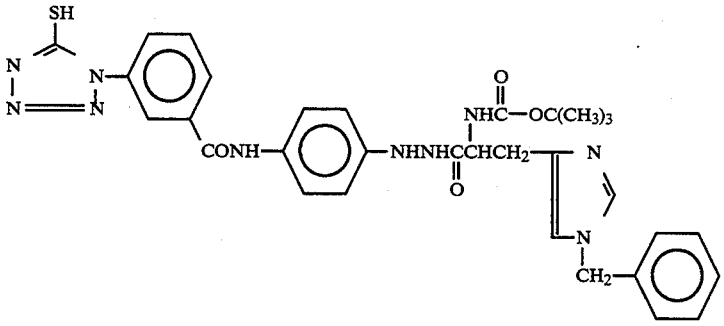

-continued

I-58)

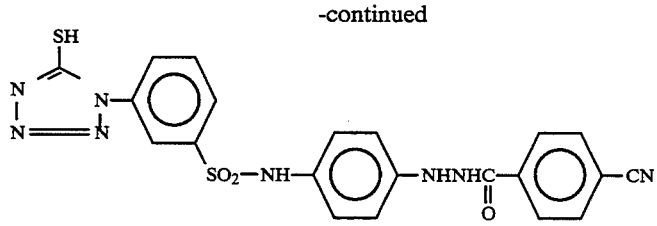

I-59)

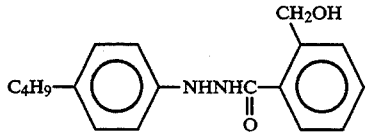

I-60)

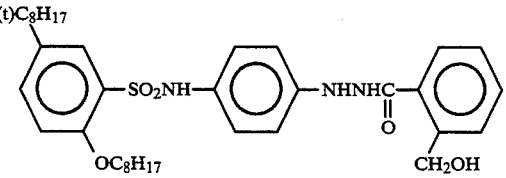

I-61)

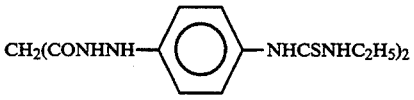

I-62)

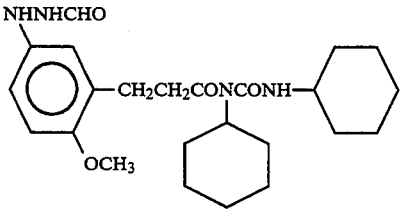

I-63)

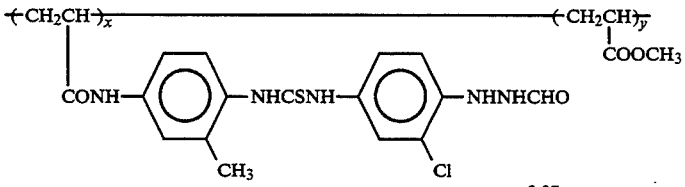

x:y = 3:97

$\overline{M} \approx 100{,}000$

I-64)

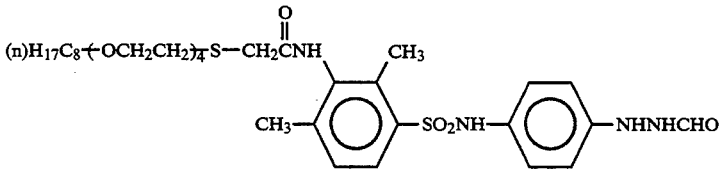

In addition to the above, it is also possible to use, as the hydrazine derivative nucleating agents of the present invention, those described in (and in the references cited in) *Research Disclosure*, No. 23516 (November, 1983), page 346, and those described in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, European Patent 217,310, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-139538, JP-A-2-77057, JP-A-2-198440, JP-A-2-198441, JP-A-2-198442, JP-A-2-196234, JP-A-2-196235, JP-A-220042, JP-A-2-221953, JP-A-2-221954, JP-A-2-302750 and JP-A-2-304550, and U.S. Pat. No. 4,988,604. Suitable methods for preparing the hydrazine derivatives are described in the above references.

The amount of the nucleating agent employed in the present invention is preferably from $1\times10^{-6}$ mol to $5\times10^{-1}$ mol, and more preferably from $1\times10^{-5}$ mol to $1\times10^{-1}$ mol, per mol of silver halide.

The nucleating agent according to the present invention can be employed by dissolving it in an appropriate water-miscible organic solvent, for example, an alcohol (e.g., methanol, ethanol, propanol, or a fluorinated alcohol), a ketone (e.g., acetone or methyl ethyl ketone), dimethylformamide, dimethylsulfoxide, or methyl cellosolve.

Also, it can be employed by dissolving it in an oil such as dibutyl phthalate, tricresyl phosphate, glycerol triacetate, or diethylphthalate together with an auxiliary solvent such as ethyl acetate, or cyclohexanone and dispersing it mechanically to form an emulsified dispersion according to an emulsified dispersion method well known in the art. Further, it can be employed by dissolving it together with a polymer such as poly-tert-butylacrylamide, polymethyl methacrylate, or polyvinyl acetate, the above described auxiliary solvent, and if desired, the above described oil and dispersing it mechanically to form an emulsified dispersion. Moreover, a powdered nucleating agent can be employed by dispersing it in water using a ball mill, a colloid mill or ultrasonic wave according to a solid dispersion method known in the art.

In case of using the emulsified dispersion, it is preferred sometimes to use it after removing the auxiliary solvent from the dispersion by heating, distillation under reduced pressure, ultrafiltration, or noodle washing, if desired.

The compound represented by general formula (Q-1) which can be used in the present invention is described in detail below.

In general formula (Q-1), the aliphatic group represented by R includes a straight chain, branched chain or cyclic alkyl group, an alkenyl group or an alkynyl group, and preferably has from 1 to 40 carbon atoms.

The aromatic group represented by R includes a monocyclic or bicyclic aryl group, for example, a phenyl group or a naphthyl group, and preferably has from 6 to 40 carbon atoms.

The heterocyclic group (heterocyclic ring) represented by R includes a saturated or unsaturated 3-membered to 10-membered hetero ring containing at least one nitrogen, oxygen or sulfur atom. The hetero ring may be monocyclic or may form a condensed ring with the other aromatic or heterocyclic rings. The hetero ring preferably includes a 5-membered or 6-membered aromatic heterocyclic group, for example, those containing a pyridyl, imidazolyl, quinolinyl, benzimidazolyl, pyrimidyl, pyrazolyl, isoquinolinyl, thiazolyl, or benzothiazolyl group.

R is preferably an aromatic group.

R may have a substituent. Examples of suitable substituents for R include an alkyl group, an aralkyl group, an alkenyl group, an alkynyl group, an alkoxyl group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an alkyloxycarbonyl group, an aryloxycarbonyl group, an acyl group, an acyloxy group, a carbonamido group, a sulfonamido group, a nitro group, and a group represented by general formula (R):

$$R_1-L-Y-\underset{\underset{R_2}{|}}{N}- \qquad (R)$$

wherein Y represents $$-CO-,\ -SO_2-,\ \text{or}\ -\overset{\overset{O}{\|}}{\underset{\underset{R_3}{|}}{P}}-$$

(wherein $R_3$ represents an alkoxy group or an aryloxy group); L represents a mere bond, $$-O-,\ -S-,\ \text{or}\ -\underset{\underset{R_4}{|}}{N}-$$

(wherein $R_4$ represents a hydrogen atom, an aliphatic group, or an aromatic group); and $R_1$ and $R_2$, which may be the same or different, each represents a hydrogen atom, an aromatic group, an aliphatic group, or a heterocyclic group, or $R_1$ and $R_2$ may be connected to each other to form a ring.

In general formula (R), the aliphatic group represented by $R_1$ includes a straight chain, branched chain or cyclic alkyl group, an alkenyl group or an alkynyl group, and preferably has from 1 to 30 carbon atoms.

The aromatic group represented by $R_1$ includes a monocyclic or bicyclic aryl group, for example, a phenyl group and a naphthyl group, and preferably has from 6 to 30 carbon atoms.

The heterocyclic group represented by $R_1$ includes a saturated or unsaturated 3-membered to 10-membered hetero ring containing at least one nitrogen, oxygen or sulfur atom. The hetero ring may be monocyclic or may form a condensed ring with other aromatic or heterocyclic rings. The hetero ring preferably includes a 5-membered or 6-membered aromatic heterocyclic group, for example, those containing a pyridyl, imidazolyl, quinolinyl, benzimidazolyl, pyrimidyl, pyrazolyl, isoquinolinyl, thiazolyl, or benzothiazolyl group.

$R_1$ may have a substituent. Examples of suitable substituents for $R_1$ include an alkyl group, an aralkyl group, an alkenyl group, an alkynyl group, an alkoxyl group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an alkyloxycarbonyl group, an aryloxycarbonyl group, an acyl group, an acyloxy group, a carbonamido group, a sulfonamido group, and a nitro group. These substituents may further be substituted and may be taken together, if possible, to form a ring.

The aliphatic group represented by $R_2$ in general formula (R) includes a straight chain, branched chain or cyclic alkyl group, an alkenyl group or an alkynyl group.

The aromatic group represented by $R_2$ includes a monocyclic or bicyclic aryl group, for example, a phenyl group.

$R_2$ may have a substituent, such as those described as the substituents for $R_1$ above.

$R_1$ and $R_2$ may be taken together, if possible, to form a ring.

$R_2$ preferably represents a hydrogen atom.

In the general formula (R), Y preferably represents —CO— or $-SO_2-$, and L preferably represents a mere bond or $$-\underset{\underset{R_4}{|}}{N}-.$$

The aliphatic group represented by $R_4$ includes a straight chain, branched chain or cyclic alkyl group, an alkenyl group or an alkynyl group.

The aromatic group represented by $R_4$ includes a monocyclic or bicyclic aryl group, for example, a phenyl group.

$R_4$ may have a substituent, such as those described as the substituents for $R_1$ above.

$R_4$ preferably represents a hydrogen atom.

R in the general formula (Q-1) may include a substituent which contains an adsorption accelerating group.

The adsorption accelerating group with which R may be substituted is represented by formula $X-L')_t$, wherein X represents an adsorption accelerating group; L' represents a divalent linking group; and t represents 0 or 1.

Examples of suitable adsorption accelerating groups represented by X include a thioamido group, a mercapto group, a group having a disulfide linkage, and a 5-membered or 6-membered nitrogen-containing heterocyclic group.

The thioamido adsorption accelerating group represented by X is a divalent group represented by

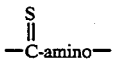

which may be a part of a cyclic structure or an acyclic thioamido group. Useful thioamido adsorption accelerating groups can be selected from those disclosed in U.S. Pat. Nos. 4,030,925, 4,031,127, 4,080,207, 4,245,037, 4,255,511, 4,266,013, and 4,276,364, and *Research Disclosure*, Vol. 151, No. 15162 (Nov., 1976) and *ibid*, Vol. 176, No. 17626 (Dec., 1978).

Examples of acyclic thioamido groups include thioureido, thiourethane and dithiocarbamic ester groups. Examples of cyclic thioamido groups include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,5-oxadiazoline-2-thione, benzimidazoline-2-thione, benzoxazoline-2-thione, and benzothiazoline-2-thione. These groups may further be substituted.

The mercapto group represented by X includes an aliphatic mercapto group, an aromatic mercapto group, and a heterocyclic mercapto group. A heterocyclic mercapto group wherein the carbon atom to which —SH is bonded is adjacent to a nitrogen atom is the same as a cyclic thioamido group, being a tautomeric isomer of such a heterocyclic mercapto group. Examples of such a group are the same as those described above with respect to the cyclic thioamido group.

The 5-membered or 6-membered nitrogen-containing heterocyclic group represented by X includes those composed of at least one carbon atom and at least one nitrogen, oxygen or sulfur atom. Examples of preferred groups include benzotriazole, triazole, tetrazole, indazole, benzimidazole, imidazole, benzothiazole, thiazole, benzoxazole, oxazole, thiadiazole, oxadiazole, and triazine. These groups may further be substituted with an appropriate substituent. Suitable substituents include those described with respect to the substituents for R above.

Among the groups represented by X, those preferred are a cyclic thioamido group (i.e., a mercapto-substituted nitrogen-containing heterocyclic group, e.g., 2-mercaptothiadiazole, 3-mercapto-1,2,4-triazole, 5-mercaptotetrazole, 2-mercapto-1,3,4-oxadiaole, and 2-mercaptobenzoxazole groups) and a nitrogen-containing heterocyclic group (e.g., benzotriazole, benzimidazoie, and indazole groups).

Two or more moleties of $X—L')_t$ may be present, and these moleties may be the same or different.

The divalent linking group represented by L' is an atom or an atomic group containing at least one of carbon, nitrogen, sulfur, or oxygen atom. Examples of L' include an alkylene group, an alkenylene group, an alkynylene group, an arylene group, —O—, —S—, —NH—, —N=, —CO—, —$SO_2$—, either alone or in combination thereof. These groups may have a substituent.

Specific examples of the linking group represented by L' include —CONH—, —NHCONH—, —$SO_2$NH—, —COO—, —NHCOO—, —$CH_2CH_2SO_2$NH—, —$CH_2CH_2$CONH—, —NHCONH$CH_2CH_2$CONH—,

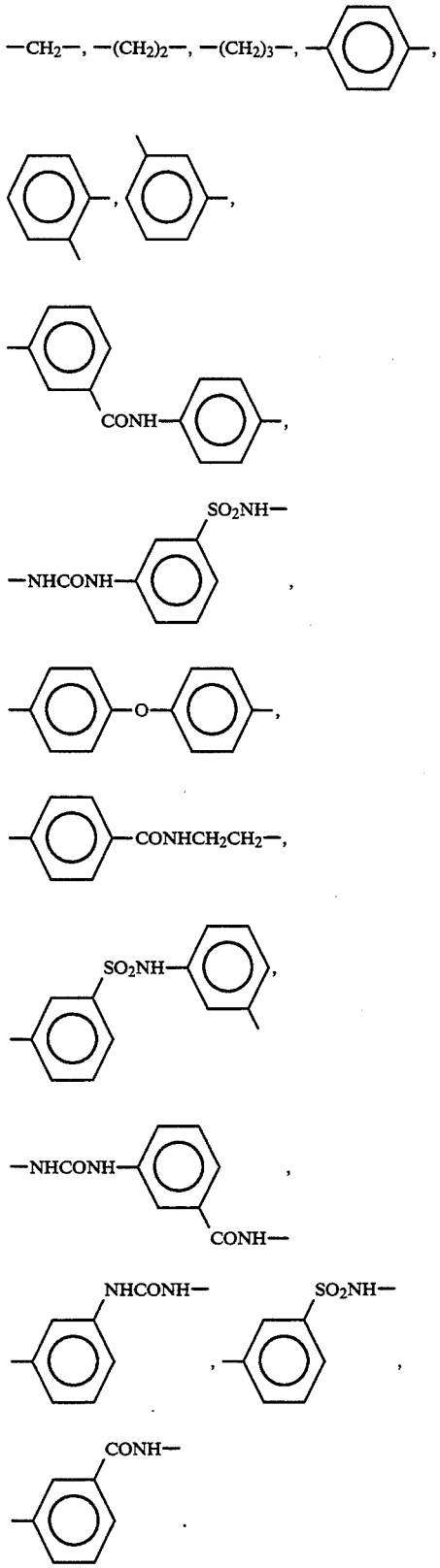

These divalent groups may further be substituted with an appropriate substituent. Suitable substituents are selected from those described with respect to the substituents for R.

R may further contain a ballast group which is commonly employed in immobile photographic additives such as couplers.

The ballast group is an organic group which has a molecular weight sufficient to substantially prevent the compound represented by general formula (Q-1) from diffusing into other layers or into the processing solutions. It comprises at least one of an alkyl group, an aryl group, a heterocyclic group, an ether group, a thioether group, an amido group, a ureido group, a urethane group, and a sulfonamido group. Preferred ballast groups are those having a substituted benzene ring, and more preferably those having a benzene ring substituted with a branched chain alkyl group.

In general formula (Q-1), the heterocyclic aromatic group represented by

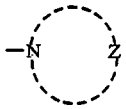

is preferably a substituted or unsubstituted 5-membered or 6-membered ring, either a monocyclic or a ring condensed with other rings.

Typical examples of preferred heterocyclic aromatic rings include, for example, pyrrole, imidazole, pyrazole, 1,2,3-triazole, 1,2,4-triazole, tetrazole, 2-thioxathiazoline, 2-oxathiazoline, 2-thioxaoxazoline, 2-oxaoxazoline, 2-thioxaimidazoline, 2-oxaimidazoline, 3-thioxa-1,2,4-triazoline, 3-oxa-1,2,4-triazoline, 1,2-oxazoline-5-thione, 1,2-thiazoline-5-thione, 1,2-oxazoline-5-one, 1,2-thiazoline-5-one, 2-thioxa-1,3,4-thiadiazoline 2-oxa-1,3,4-thiadiazoline, 2-thioxa-1,3,4-oxadiazoline, 2-oxa-1,3,4-oxadiazoline, 2-thioxadihydropyridine, 2-oxadihydropyridine, 4-thioxadihydropyridine, 4-oxadihydropyridine, isoindole, indole, indazole, benzotriazole, benzimidazole, 2-thioxabenzimidazole, 2-oxabenzimidazole, benzoxazoline-2-thione, azaindenes, benzooxazoline-2-one, benzothiazoline-2-thione, benzothiazoline-2-one, carbazole, purine, carboline, phenoxazine, and phenothiazine, and condensed rings at various condensing positions such as pyrazolopyridines, pyrazolopyrimidines, pyrazolopyrroles, pyrazolopyrazoles, pyrazoloimidazoles, pyrazolooxazoles, pyrazolothiazoles, pyrazolotriazoles, imidazolopyridines, imidazolopyrimidines, imidazolopyrroles, imidazoloimidazoles, imidazolooxazoles, imidazolothiazoles, and imidazolotriazoles.

More preferred examples of the heterocyclic aromatic rings include, pyrrole, imidazole, pyrazole, triazole, tetrazole, 2-thioxathiazoline, 2-thioxaoxazoline, indole, indazole, benzotriazole, benzimidazole, 2-thioxa-1,3,4-thiadiazoline, azaindene, 5-thioxatetrazoline, 2-thioxa-1,3,4-oxadiazoline, and 3-thioxa-1,2,4-triazoline, and condensed rings at various condensing positions such as pyrazolopyridines, and pyrazoloimidazoles. Most preferred examples of the heterocyclic aromatic rings include a ring containing a pyrazole nucleus such as pyrazole, indazole, and pyrazolopyridine.

These heterocyclic groups may have a substituent. Suitable examples of the substituents include a mercapto group, a nitro group, a carboxy group, a sulfo group, a phosphono group, a hydroxy group, an alkyl group, an aralkyl group, an alkenyl group, an alkynyl group, an aryl group, an alkoxyl group, an aryloxy group, an amino group, an acylamino group, a sulfonylamino group, a ureido group, a urethane group, a sulfamoyl group, a carbamoyl group, an alkylthio group, an arylthio group, a sulfonyl group, a sulfinyl group, a halogen atom, a cyano group, an aryloxycarbonyl group, an acyl group, an alkoxycarbonyl group, an acyloxy group, a carbonamido group, a sulfonamido group, and a phosphonamido group.

Examples of the compounds represented by general formula (Q-1) are shown below, but the present invention should not be construed as being limited thereto:

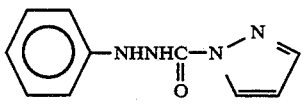

(Q-101)

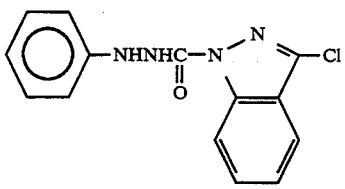

(Q-102)

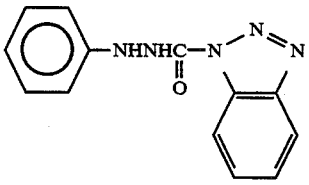

(Q-103)

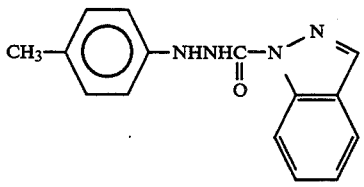

(Q-104)

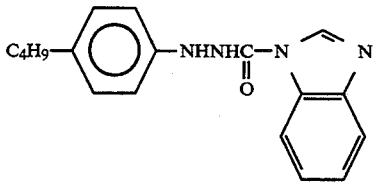

(Q-105)

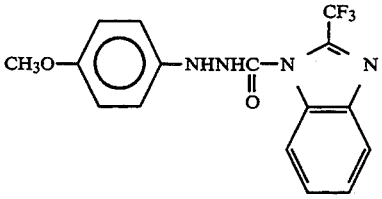

(Q-106)

-continued
(Q-107)
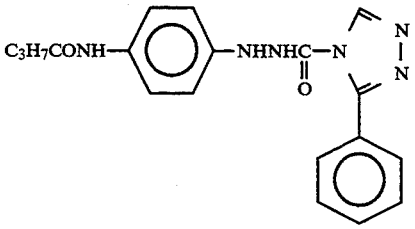
(Q-108)
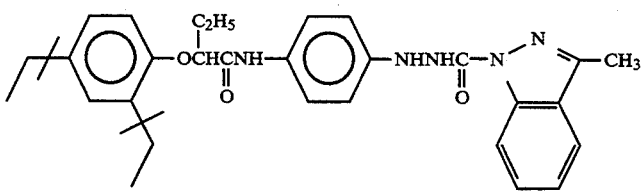
(Q-109)
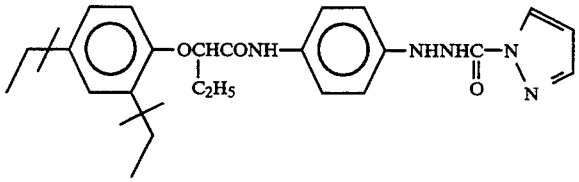
(Q-110)
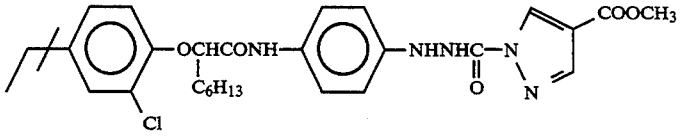
(Q-111)
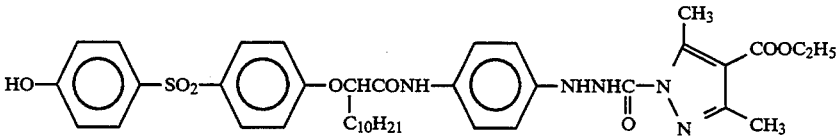
(Q-112)
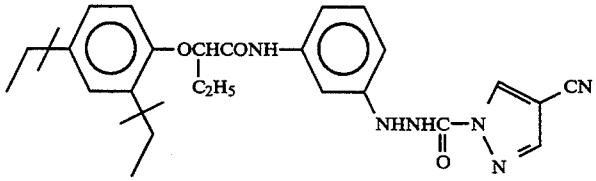
(Q-113)
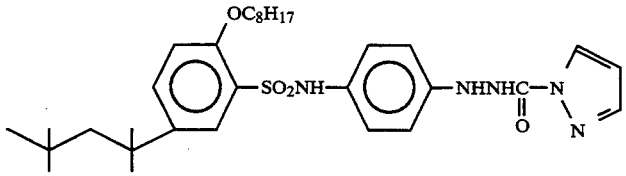
(Q-114)
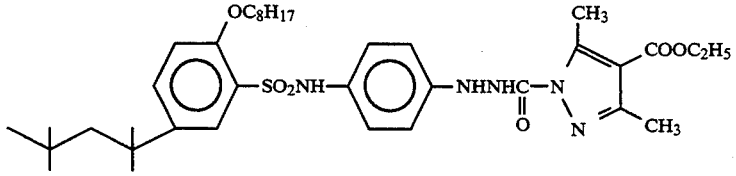

-continued
(Q-115)
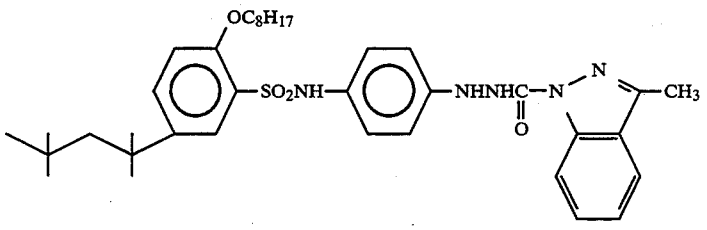
(Q-116)
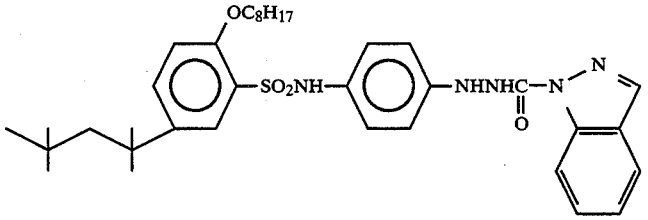
(Q-117)
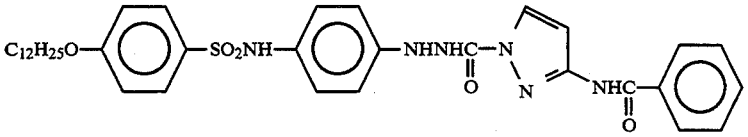
(Q-118)
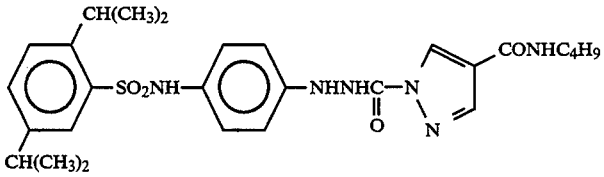
(Q-119)
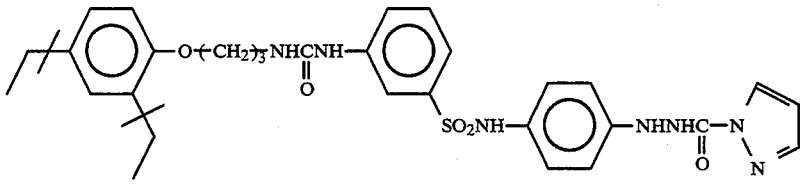
(Q-120)
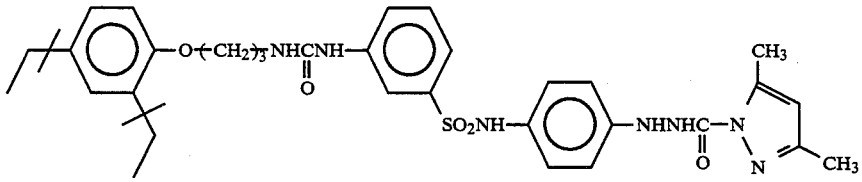
(Q-121)
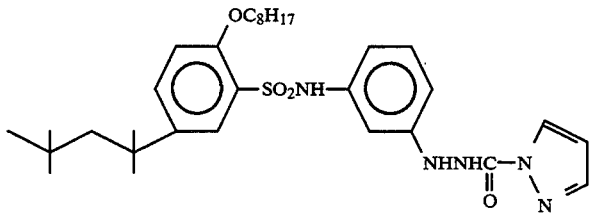
(Q-122)
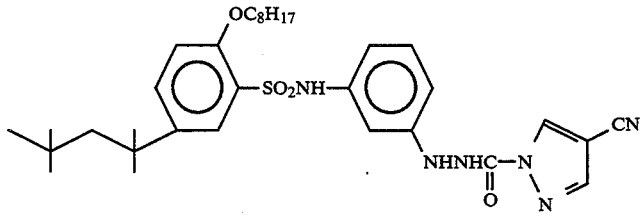

-continued
(Q-123)
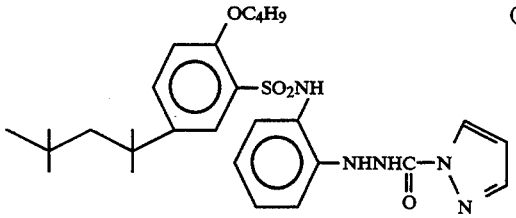
(Q-124)
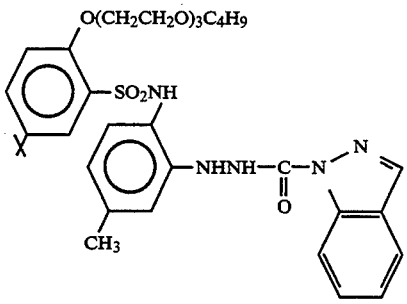
(Q-125)
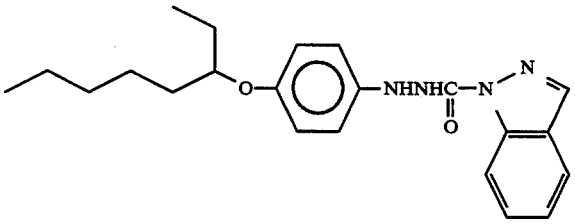
(Q-126)
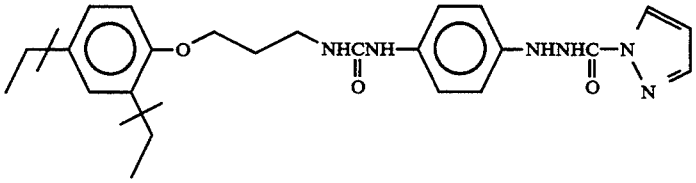
(Q-127)
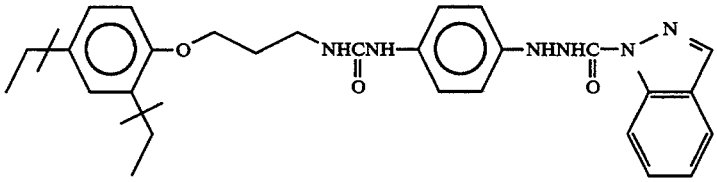
(Q-128)
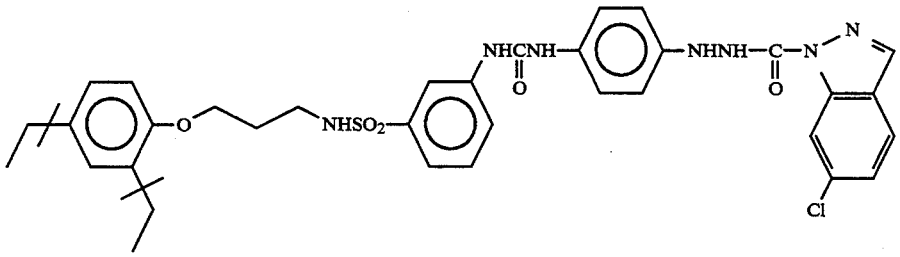
(Q-129)
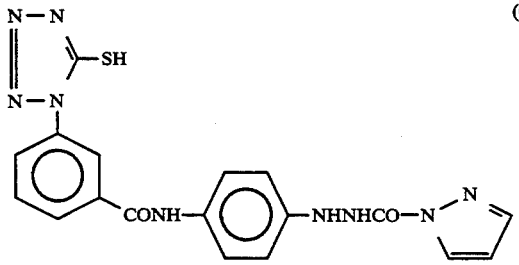
(Q-130)
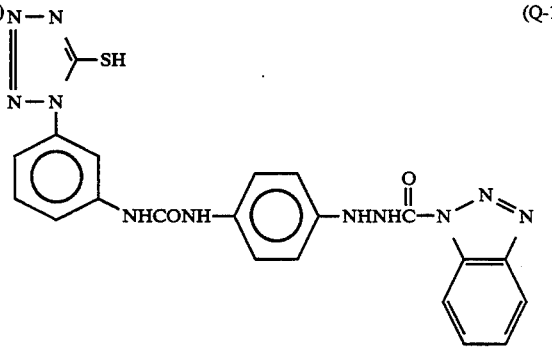

-continued (Q-131)

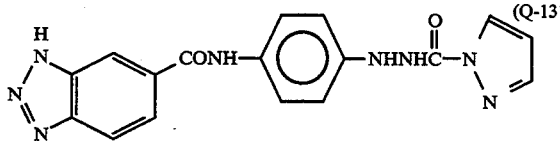

(Q-132)

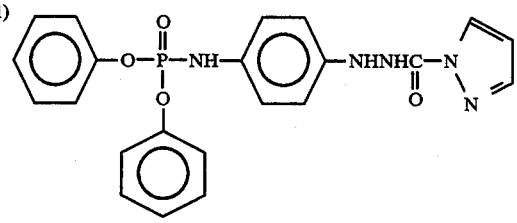

In addition to the above, certain of the compounds described, for example, in JP-A-3-39953 can be employed as the compounds represented by formula (Q-1) which can be used in the present invention. Synthesis methods of the compounds represented by general formula (Q-1) according to the present invention are also described in detail in JP-A-3-39953.

The amount of the compound represented by the general formula (Q-1) employed in the present invention is not particularly restricted, and is usually from $1\times10^{-3}$ mol to 10 mols, preferably from $1\times10^{-2}$ mol to 1 mol, per mol of the nucleating agent used.

The compound represented by general formula (Q-2) in the present invention is described in detail below.

In general formula (Q-2), R has the same meaning as R in general formula (Q-1).

R may have a substituent. Examples of suitable substituents for R include an alkyl group, an aralkyl group, an alkenyl group, an alkynyl group, an alkoxyl group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an alkyloxycarbonyl group, an aryloxycarbonyl group, an acyl group, an acyloxy group, a carbonamido group, a sulfonamido group, a nitro group, and a group represented by general formula (R) described above.

B in general formula (Q-2) represents a substituted or unsubstituted phenyl or naphthyl group. Suitable examples of substituents for B include those described as the substituents for R in general formula (Q-2) above.

Examples of the compounds represented by general formula (Q-2) are shown below, but the present invention should not be construed as being limited thereto:

(Q-201)

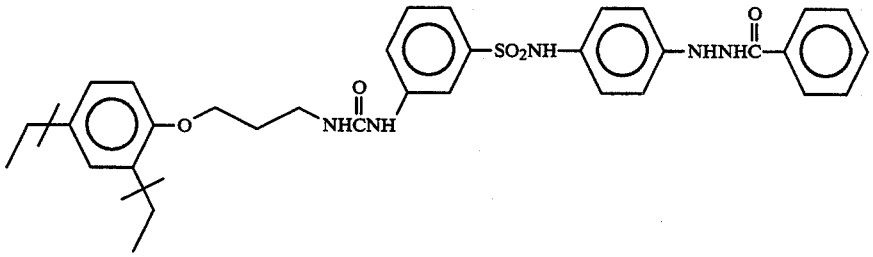

(Q-202)

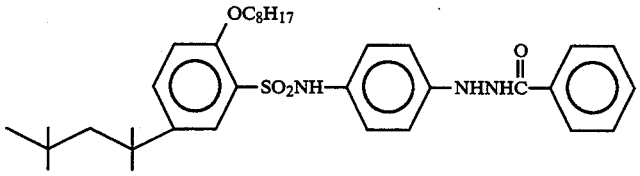

(Q-203)

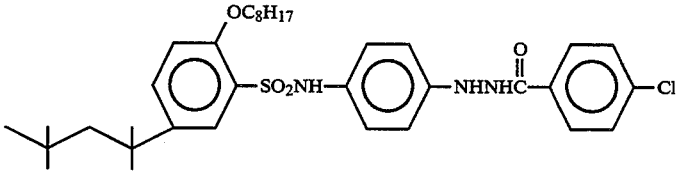

(Q-204)

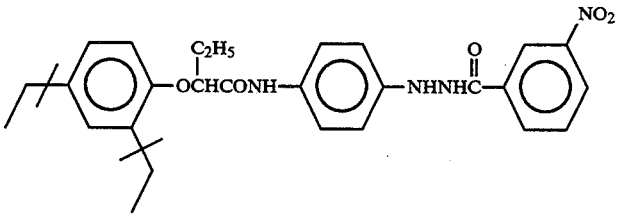

-continued
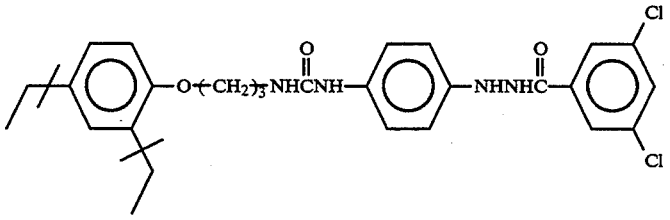
(Q-205)
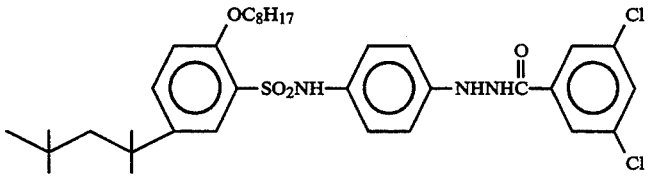
(Q-206)
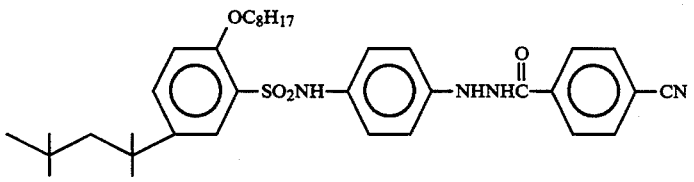
(Q-207)
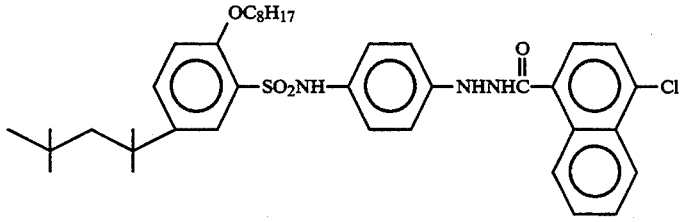
(Q-208)
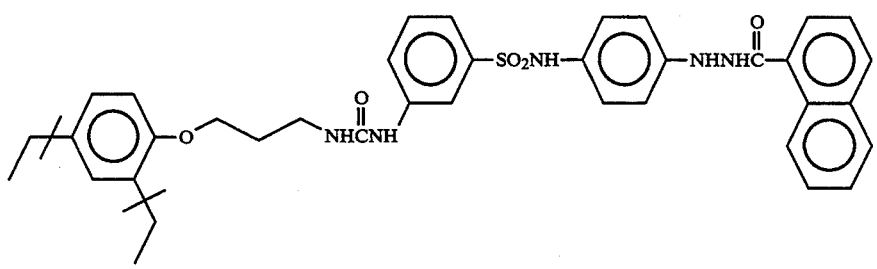
(Q-209)
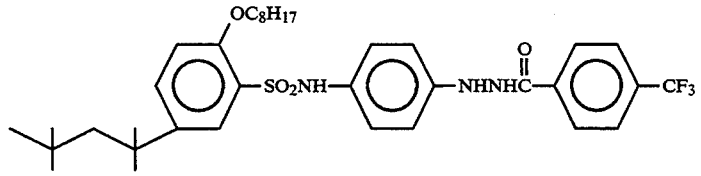
(Q-210)
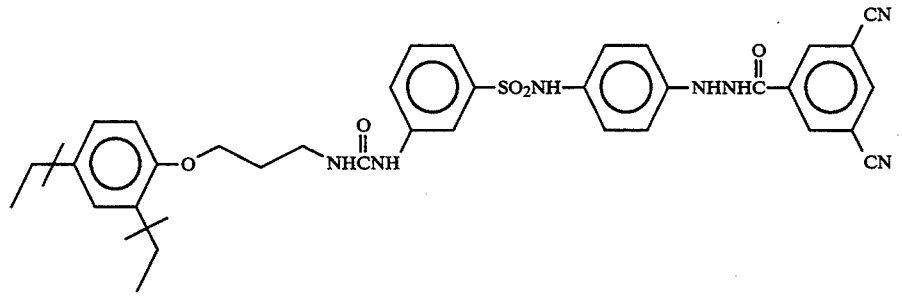
(Q-211)

-continued

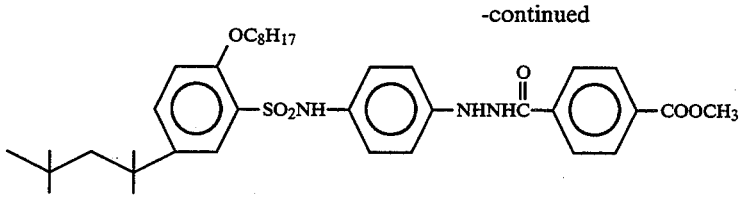

(Q-212)

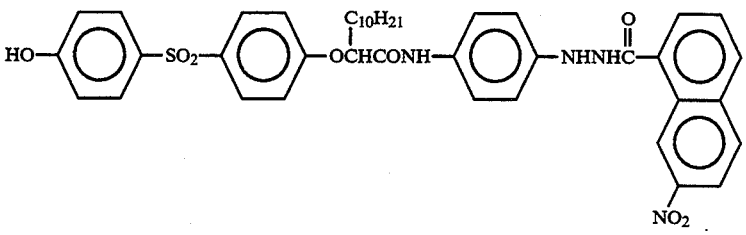

(Q-213)

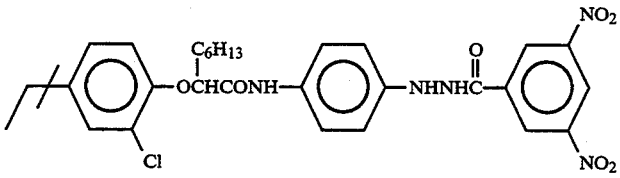

(Q-214)

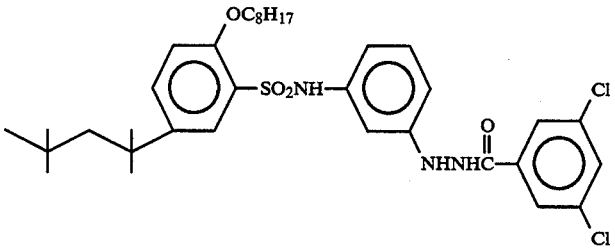

(Q-215)

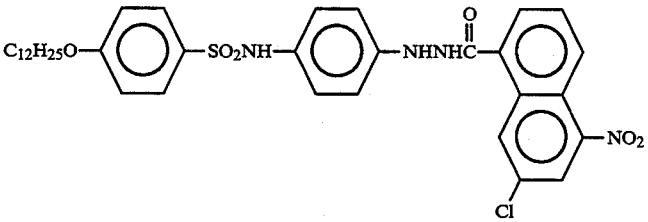

(Q-216)

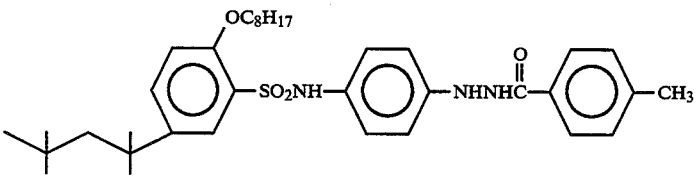

(Q-217)

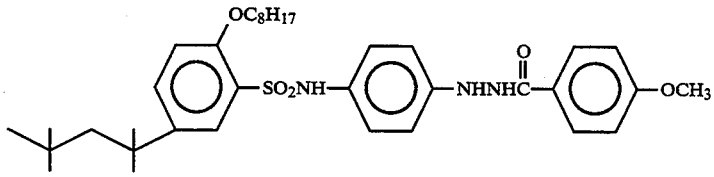

(Q-218)

The suitable amount of the compound represented by general formula (Q-2) employed in the present invention is the same as that of the compound represented by general formula (Q-1).

The compound represented by general formula (Q-1) or (Q-2) can be added to the photographic light-sensitive material in the same manner as described for the nucleating agent represented by general formula (N-1) above. Further, if desired, the compound can be employed by dissolving it together with the nucleating agent, or by co-emulsifying it with the nucleating agent.

In the present invention, it is preferred to include a redox compound capable of releasing a development inhibitor upon being oxidized by an oxidant of developing agent in a developing solution, together with the nucleating agent represented by general formula (N-1).

The redox compound capable of releasing a development inhibitor upon being oxidized, at least a part of which is soluble in a developing solution and which can turn into a compound having less development inhibiting activity upon a reaction with a component of the developing solution, will be described in detail below.

Preferred examples of the redox groups of the redox compounds used in the present invention include hydroquinones, catechols, naphthohydroquinones, aminophenols, pyrazolidones, hydrazines, hydroxylamines, and reductones. Among them, hydrazines are more preferable.

The redox compounds capable of releasing a development inhibitor upon oxidation, at least a part of which is soluble in a developing solution and which can turn into a compound of less development inhibiting activity upon a reaction with a component of the developing solution, used in the present invention are preferably the hydrazine compounds represented by general formula (R-1), (R-2) or (R-3) shown below. Among them, compounds of general formula (R-1) are particularly preferred.

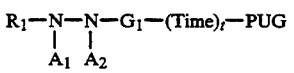

(R-1)

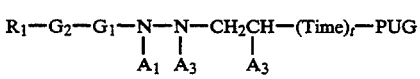

(R-2)

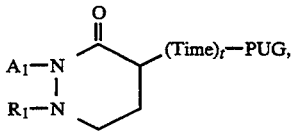

(R-3)

wherein $R_1$ represents an aliphatic group or an aromatic group; $G_1$ represents

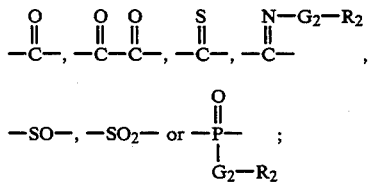

$G_2$ represents a mere bond, —O—, —S— or

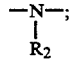

$R_2$ represents a hydrogen atom or $R_1$; and $A_1$ and $A_2$ each represents a hydrogen atom, an alkylsulfonyl group which may be substituted, an arylsulfonyl group which may be substituted or an acyl group which may be substituted, provided that in general formula (R-1), at least one of $A_1$ and $A_2$ is hydrogen atom; $A_3$ has the same meaning as $A_1$ or represents

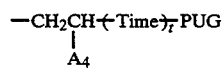

group; $A_4$ represents a nitro group, a cyano group, a carboxyl group, a sulfonyl group or a $—G_1—G_2—R_1$ group; Time represents a divalent connecting group; t represents 0 or 1; and PUG represents a development inhibitor.

When two or more moieties of $R_2$ or $—G_1—G_2—R$ are present in a molecule of the compounds represented by the general formula (R-1), (R-2) or (R-3), these moieties may be the same or different.

The compounds of general formula (R-1), (R-2) or (R-3) are described in more detail below.

In general formula (R-1), (R-2) or (R-3), the aliphatic group represented by $R_1$ preferably has from 1 to 30 carbon atoms, and more preferably is a straight chain, branched chain or cyclic alkyl group having from 1 to 20 carbon atoms. The alkyl group may be substituted.

In the general formula (R-1), (R-2) or (R-3), the aromatic group represented by $R_1$ is a monocyclic or bicyclic aryl group or an unsaturated heterocyclic group, and preferably has from 6 to 30 carbon atoms. The unsaturated heterocyclic group may be condensed with an aryl group to form a heteroaryl group.

Examples of the aromatic group include a benzene ring, a naphthalene ring, a pyridine ring, a quinoline ring and an isoquinoline ring. Among them, a group having a benzene ring is preferred.

Most preferably, $R_1$ is an aryl group.

The aryl group or the unsaturated heterocyclic group represented by $R_1$ may be substituted.

Typical examples of the substituents for $R_1$ include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, and a phosphonamido group. Preferred substituents are a straight chain, branched chain or cyclic alkyl group (preferably having from 1 to 20 carbon atoms), an aralkyl group (preferably having from 7 to 30 carbon atoms), an alkoxy group (preferably having from 1 to 30 carbon atoms), a substituted amino group (preferably an amino group substituted with an alkyl group having from 1 to 30 carbon atoms), an acylamino group (preferably having from 2 to 40 carbon atoms), a sulfonamido group (preferably having from 1 to 40 carbon atoms), a ureido group (preferably having from 1 to 40 carbon atoms) and a phosphonamido group (preferably having from 1 to 40 carbon atoms).

In general formula (R-1) or (R-2), $G_1$ is preferably

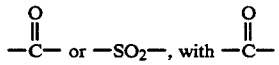

being most preferred.

$A_1$ and $A_2$ each is preferably hydrogen atom, and $A_3$ is preferably a hydrogen atom or a

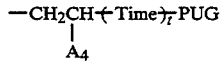

group.

In general formula (R-1), (R-2) or (R-3), Time represents a divalent connecting group and may have a timing controlling function.

The divalent connecting group represented by Time is a group which is released from Time-PUG through one or more step reactions, the Time-PUG moiety being released from an oxidation product of an oxidation-reduction mother nucleus.

Examples of the divalent connecting group represented by Time include those which release PUG by an intramolecular cyclization reaction of p-nitrophenoxy derivatives as described in U.S. Pat. No. 4,248,962 (JP-A-54-145135); those which release PUG by an intramolecular cyclization reaction after ring cleavage as described in U.S. Pat. Nos. 4,310,612 (JP-A-55-53330) and 4,358,525; those which release PUG by the intramolecular cyclization reaction of a carboxy group of succinic monoesters or analogs thereof with the formation of acid anhydride as described in U.S. Pat. Nos. 4,330,617, 4,446,216, and 4,483,919 and JP-A-59-121328; those which release PUG by electron transfer through a double bond conjugated with an aryloxy group or a heterocyclic oxy group together with the formation of quinomonomethane or analogs thereof as described in U.S. Pat. Nos. 4,409,323 and 4,421,845, *Research Disclosure* No. 21228 (December 1981), U.S. Pat. No. 4,416,977 (JP-A-57-135944), JP-A-58-209736 and JP-A-58-209738; those which release PUG from the $\gamma$-position of an enamine by electron transfer in a moiety having an enamine structure in a nitrogen-containing heterocyclic ring as described in U.S. Pat. No. 4,420,554 (JP-A-57-136640), JP-A-57-135945, JP-A-57-188035, JP-A-58-98728 and JP-A-58-209737; those which release PUG by the intramolecular cyclization reaction of an oxy group formed by electron transfer to a carbonyl group conjugated with a nitrogen atom in a nitrogen-containing heterocyclic ring as described in JP-A-57-56837; those which release PUG with the formation of aldehydes as described in U.S. Pat. No. 4,146,396 (JP-A-52-90932), JP-A-59-93442, JP-A-59-75475, JP-A-60-249148 and JP-A-60-249149; those which release PUG with a decarboxylation of a carboxyl group as described in JP-A-51-146828, JP-A-57-179842 and JP-A-59-104641; those which have a structure of —O—COO-$CR_aR_b$-PUG (wherein $R_a$ and $R_b$ each represents a monovalent group) and release PUG with the formation of aldehydes subsequent to decarboxylation; those which release PUG with the formation of isocyanates as described in JP-A-60-7429; and those which release PUG by a coupling reaction with an oxidation product of color developing agent as described in U.S. Pat. No. 4,438,193.

Specific examples of the divalent connecting groups represented by Time are described in detail, for example, in JP-A-61-236549, and JP-A-1-269936 and JP-A-3-67246.

In general formula (R-1), (R-2) or (R-3), PUG is a development inhibitor which is capable of changing into a compound having less development inhibiting activity upon a reaction with a component of a developing solution when dissolved in the developing solution. Further, PUG contains a hetero atom through which PUG is connected to the remainder of the compound represented by general formula (R-1), (R-2), (R-3).

Examples of known conventional development inhibitors are described, for example, in T. H. James, *The Theory of the Photographic Processes,* 4th Ed. (published by Macmillan Co., 1977), pages 396 to 399 and JP-A-3-67246.

The development inhibitors may be substituted. Examples of suitable substituents include a mercapto group, a nitro group, a carboxy group, a sulfo group, a phosphono group, a hydroxy group, an alkyl group, an aralkyl group, an alkenyl group, an alkynyl group, an aryl group, an alkoxy group, an aryloxy group, an amino group, an acylamino group, a sulfonylamino group, a ureido group, a urethane group, a sulfamoyl group, a carbamoyl group, an alkylthio group, an arylthio group, a sulfonyl group, a sulfinyl group, a halogen atom, a cyano group, an aryloxycarbonyl group, an acyl group, an alkoxycarbonyl group, an acyloxy group, a carbonamido group, a sulfonamido group and a phosphonamido group. These groups may be further substituted.

As described above, PUG is a development inhibitor which is capable of changing into a compound having less development inhibiting activity upon a reaction with a component of a developing solution when dissolved in the developing solution. Development inhibitors having such a function can be selected from known development inhibitors as described above. Alternatively, such a function can be imparted to known development inhibitors by introducing an appropriate substituent.

The development inhibitors represented by PUG are especially preferably compounds capable of inhibiting nucleating infectious development.

Nucleating infectious development is a novel development chemistry which has been employed in image formation with the Fuji Film GRANDEX System (by Fuji Photo Film Co., Ltd.) or with the Kodak Ultratec System (by Eastman Kodak Co., Ltd.).

The novel development chemistry, described in *Journal of The Society of Photographic Science and Technology of Japan*, Vol. 52, No. 5, pages 390 to 394 (1989) and *Journal of Photographic Science*, Vol. 35, page 162 (1987), involves a development step in which exposed silver halide grains are developed with an ordinary developing agent and a subsequent nucleating infectious development step in which a nucleating agent is oxidized with the oxidation product of the developing agent as formed in the previous development step by cross-oxidation to form an active nucleating seed. The ambient non-exposed or weakly exposed silver halide grains are then developed with the resulting active seeds by nucleating infectious development.

Accordingly, since a complete development process is composed of an ordinary development step and a subsequent nucleating infectious development step, novel compounds capable of retarding the nucleating infectious development step may also exhibit a development inhibiting activity in addition to the conventional ordinary development inhibitors which have heretofore been known. The former novel compounds are herein referred to as nucleating development inhibitors.

The development inhibitor represented by PUG used in the present invention is preferably a nucleating development inhibitor.

Compounds suitable for the nucleating development inhibitors include compounds having at least one nitro group or nitroso group, compounds containing a nitrogen-containing heterocyclic nucleus, especially a 6-membered nitrogen-containing heterocyclic aromatic nucleus, such as one derived from pyridine, pyrazine, quinoline, quinoxaline or phenazine, compounds having an N-halogen bond, quinones, tetrazolium compounds, amine oxides, azoxy compounds, or coordination compounds having an oxidizing power, are particularly effective although development inhibitors which have heretofore been known are effective.

Among them, the compounds having a nitro group and the compounds containing a pyridine nucleus are especially preferred.

The nucleating development inhibitors may be substituted. Depending on their properties, for example, the electron withdrawing property, the electron donative property, the hydrophobicity, the hydrophilicity, the adsorbing power to silver halide of substituents, various characteristics including power of development inhibition and diffusibility of the nucleating development inhibitors can be controlled.

Examples of suitable substituents include those listed for the conventional ordinary development inhibitors hereinbefore.

Examples of the nucleating development inhibitors useful in the present invention are described in detail in Japanese Patent Application Nos. 2-258928, 2-258929 and 3-15648. Also, as nucleating development inhibitors of another type, compounds adsorbing to silver halide grains which have an anionic group or a dissociative group capable of forming an anionic charge upon dissociation in the developing solution are effective.

The nucleating development inhibitor used as PUG in the present invention contains hetero atom(s) and is capable of being released from the remainder of the compound represented by general formula (R-1), (R-2) or (R-3) at the hetero atom through which PUG is connected and is capable of changing into a compound having less development inhibiting activity upon a reaction with a component of a developing solution, when dissolved in the developing solution. The above described two functions are preferably imparted to PUG used in the present invention by introducing an appropriate substituent into ordinary development inhibitors or the above described nucleating development inhibitors, if desired.

When PUG is dissolved in a developing solution, PUG turns into a compound having less development inhibiting activity upon a reaction with a component of the developing solution. Examples of the components of the developing solution include compounds which are contained in ordinary developing solutions such as alkali substances, hydroquinones and sulfite ions, as well as surfactants, amines and salts of organic acids. Further, for this purpose, particular reagents such as fluoride ions, hydrazines, hydroxylamines and hydroxamic acids may be added to the developing solution. The change of PUG may be induced by the complex reaction of the components.

PUG preferably is represented by general formula (P-1), (P-2) or (P-3) shown below:

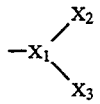

(P-1)

wherein $X_1$ represents a trivalent organic group; $X_2$ represents a group which is capable of changing into an anionic functional group upon a reaction with a component of a developing solution; and $X_3$ represents a group which exhibits a nucleating development inhibiting effect.

In greater detail, $X_1$ is a trivalent group which is an aliphatic group, an aromatic group or a group formed by combination of an aliphatic or aromatic group with

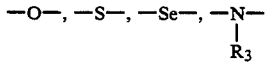

(wherein $R_3$ represents a hydrogen atom, an aliphatic group or an aromatic group), —CO—, —SO— or —$SO_2$— and which may be substituted. Examples of the preferred substituents include those listed for PUG above.

In general formula (P-1), the trivalent group represented by $X_1$ is preferably represented by general formula (P-11), (P-12) or (P-13) described below. In these general formulae, $X_1$ will be expressed together with $X_2$ and $X_3$ as in general formula (P-1).

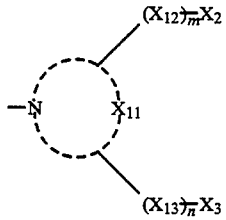

(P-11)

wherein $X_2$ and $X_3$ each has the same meaning as in general formula (P-1); $X_{11}$ represents a non-metallic atomic group necessary to form a nitrogen-containing hetero ring together with the nitrogen atom; $X_{12}$ and $X_{13}$ each represents a divalent organic group; and m and n each represents 0 or 1.

In general formula (P-11), $X_{12}$ and $X_{13}$ each preferably represents a divalent group which is an aliphatic group, an aromatic group or a group formed by combination of an aliphatic or aromatic group with

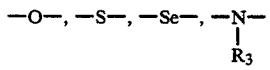

(wherein $R_3$ has the same meaning as in the general formula (P-1)), —CO—, —SO— or —$SO_2$— and which may be substituted. Examples of the preferred substituents include those listed for PUG above.

In general formula (P-11), the nitrogen-containing hetero ring represented by:

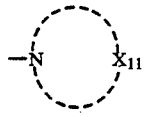

is preferably a heterocyclic aromatic ring, and more preferably a 5-membered or 6-membered ring which can be either a monocyclic ring or a condensed ring and which may be substituted.

Typical examples of preferred heterocyclic aromatic rings of general formula (P-11) include pyrroles, imidazoles, pyrazoles, 1,2,3-triazoles, 1,2,4-triazoles, tetrazoles, 2-thioxathiazolines, 2-oxathiazolines, 2-thioxaoxazolines, 2-oxaoxazolines, 2-thioxaimidazolines, 2-oxaimidazolines, 3-thioxa-1,2,4-triazolines, 3-oxa-1,2,4-triazolines, 1,2-oxazoline-5-thiones, 1,2-thiazoline-5-thiones, 1,2-oxazolin-5-ones, 1,2-thiazolin-5-ones, 2-thioxa-1,3,4-thiadiazolines, 2-oxa-1,3,4-thiadiazolines, 2-thioxa-1,3,4-oxadiazolines, 2-oxa-1,3,4-oxadiazolines, 2-thioxadihydropyridines, 2-oxadihydropyridines, 4-thioxadihydropyridines, 4-oxadihydropyridines, isoindoles, indoles, indazoles, benzotriazoles, benzimidazoles, 2-thioxabenzimidazoles, 2-oxabenzimidazoles, benzoxazolin-2-thiones, azaindenes, benzoxazolin-2-ones, benzothiazolin-2-thiones, benzothiazolin-2-ones, carbazoles, purines, carbolines, phenoxazines and phenothiazines; as well as condensed heterocyclic aromatic rings having condensed ring(s) at various position(s), such as pyrazolopyridines, pyrazolopyrimidines, pyrazolopyrroles, pyrazolopyrazoles, pyrazoloimidazoles, pyrazoloxazoles, pyrazolothiazoles, pyrazolotriazoles, imidazolopyridines, imidazolopyrimidines, imidazolopyrroles, imidazoloimidazoles, imidazoloxazoles, imidazolothiazoles and imidazolotriazoles.

More preferred examples of such heterocyclic aromatic rings of general formula (P-11) are pyrroles, imidazoles, pyrazoles, triazoles, tetrazoles, 2-thioxathiazolines, 2-thioxaoxazolines, indoles, indazoles, benzotriazoles, benzimidazoles, 2-thioxa-1,3,4-thiadiazolines, azaindenes, 5-thioxa-tetrazolines, 2-thioxa-1,3,4-oxadiazolines, and 3-thioxa-1,2,4-triazolines; as well as condensed heterocyclic aromatic rings having condensed ring (s) at various position (s), such as pyrazolopyridines and pyrazoloimidazoles. Especially preferred are pyrazole nucleus-containing heterocyclic aromatic rings such as pyrazoles, indazoles and pyrazolopyridines.

The heterocyclic compounds may be substituted. Examples of suitable substituents for such compounds include a mercapto group, a nitro group, a carboxy group, a sulfo group, a phosphono group, a hydroxy group, an alkyl group, an aralkyl group, an alkenyl group, an alkynyl group, an aryl group, an alkoxy group, an aryloxy group, an amino group, an acylamino group, a sulfonylamino group, a ureido group, a urethane group, a sulfamoyl group, a carbamoyl group, an alkylthio group, an arylthio group, a sulfonyl group, a sulfinyl group, a halogen atom, a cyano group, an aryloxycarbonyl group, an acyl group, an alkoxycarbonyl group, an acyloxy group, a carbonamido group, a sulfonamido group and a phosphonamido group.

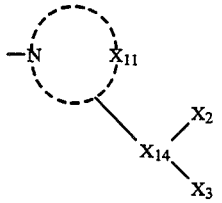

(P-12)

wherein $X_2$ and $X_3$ each has the same meaning as in general formula (P-1); $X_{11}$ has the same meaning as in general formula (P-11); and $X_{14}$ has the same meaning as $X_1$ in general formula (P-1).

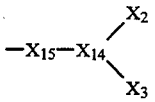

(P-13)

wherein $X_2$ and $X_3$ each has the same meaning as in general formula (P-1); $X_{14}$ has the same meaning as $X_1$ in general formula (P-12); and $X_{15}$ represents $$-O-,\ -S-,\ -Se-\ \text{or}\ -\underset{\underset{R_3}{|}}{N}-$$

(wherein $R_3$ has the same meaning as defined in the general formula (P-1)).

In the general formula (P-1), the group represented by $X_2$ is a monovalent group capable of changing into an anionic functional group upon a reaction with a component of a developing solution.

The change of $X_2$ into an anionic functional group is not a simple transfer of a proton as observed in the dissociation of an acid with an alkali, but preferably a change accompanied with one or more cleavages or formations of covalent bonds with the component of a developing solution. The artionic functional group formed is preferably bonded to a moiety represented by $X_1$ in the general formula (P-1). Further, it is preferred that the change of $X_2$ into the anionic functional group occurs substantially after the reaction releasing PUG from the redox compound.

In general formula (P-1), the group represented by $X_2$ is preferably represented by general formula (P-14), (P-15), (P-16), (P-17), (P-18) or (P-19) described below:

$$-X_{21}-R_4 \qquad \text{(P-14)}$$

wherein $X_{21}$ represents $$-CO_2-,\ -SO_3-,\ -\underset{\underset{R_5}{|}}{N}-SO_3-\ \text{or}\ -\overset{\overset{O}{\|}}{\underset{\underset{OR_5}{|}}{P}}-O-;$$

$R_4$ has the same meaning as $R_1$ in general formula (R-1); and $R_5$ represents a hydrogen atom or has the same meaning as $R_4$.

$$-X_{22}-\underset{\underset{R_6}{|}}{\overset{\overset{R_6}{|}}{C}}=\underset{\underset{R_6}{|}}{C} \qquad \text{(P-15)}$$

wherein $X_{22}$ represents $-SO_2-$, $-CO-$ or $-(NH-CO)_m-$; m represents 1 or 2; and $R_6$ represents a hydrogen atom or has the same meaning as $R_4$ in general formula (R-14), and three $R_6$ groups may be the same or different.

$$-SO_2-\underset{\underset{X_{24}}{|}}{C}=\underset{\underset{X_{24}}{|}}{C}-X_{23}-X_{24} \qquad \text{(P-16)}$$

wherein $X_{23}$ represents $-CO-$ or $-SO_2-$; and $X_{24}$ represents a monovalent group, and three $X_{24}$ groups may be the same or different or two of them may be bonded to each other to form a ring.

$$SO_2-CH_2CH_2-X_{23}-X_{24} \qquad \text{(P-17)}$$

wherein $X_{23}$ and $X_{24}$ each has the same meaning as in general formula (P-16).

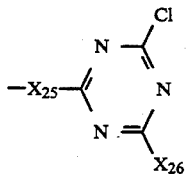

(P-18)

wherein $X_{25}$ represents a mere bond, —O— or —NH—; and $X_{26}$ represents Cl, OH or $NH_2$.

$$—X_{25}—X_{23}—CH_2—X_{27} \quad (P\text{-}19)$$

wherein $X_{23}$ has the same meaning as in general formula (P-16); $X_{25}$ has the same meaning as in general formula (P-18); and $X_{27}$ represents a halogen atom.

In addition, preferred examples of $X_2$ include a formyl group, a —N=C=O group and an oxirane group.

In general formula (P-1), the group which exhibits a development inhibiting effect represented by $X_3$ includes preferably a nitro group, a nitroso group, a nitrogen-containing heterocyclic group, a group having an N-halogen bond, a group containing a quinone nucleus, a group containing a tetrazolium nucleus, a group containing an amine oxide structure, a group containing an azoxy structure and a group derived from a coordination compound having an oxidizing power.

$X_3$ is particularly preferably a nitro group, a nitroso group or a 6-memebered nitrogen-containing heterocyclic group, and most preferably a nitro group or a pyridyl group.

$$—Y_1\text{-}Y_2\text{-}Y_3 \quad (P\text{-}2)$$

wherein $Y_1$ represents a divalent organic group; $Y_2$ represents a divalent group which is capable of being cleaved upon a reaction with a component of the developing solution; and $Y_3$ represents a group which exhibits a nucleating development inhibiting effect.

In greater detail, $Y_1$ is a divalent group which is an aliphatic group, an aromatic group or a group formed by combination of an aliphatic or aromatic group with $$—O—,\ —S—,\ —Se—,\ —\underset{\underset{R_3}{|}}{N}—$$

(wherein $R_3$ has the same meaning as defined in the general formula (P-1)), —CO—, —SO— or —$SO_2$— and which may be substituted. Examples of preferred substituents include those listed for PUG above.

In general formula (P-2), the divalent group represented by $Y_1$ is preferably represented by general formula (P-21) or (P-22) described below. In these general formulae, $Y_1$ will be expressed together with $Y_2$ and $Y_3$ as in general formula (P-2).

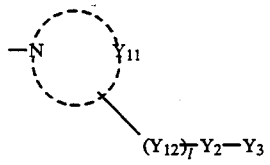

(P-21)

wherein $Y_2$ and $Y_3$ each has the same meaning as in general formula (P-2); $Y_{11}$ and $Y_{12}$ have the same meanings as $X_{11}$ and $X_{12}$ defined in the general formula (P-11) respectively; and l represents 0 or 1.

With respect to $Y_{11}$ and $Y_{12}$, the descriptions of the preferred embodiments for $X_{11}$ and $X_{12}$ in the general formula (P-11) can be applied here too.

$$—Y_{13}—Y_{12}—Y_2—Y_3 \quad (P\text{-}22)$$

wherein $Y_2$ and $Y_3$ each has the same meaning as in general formula (P-2); $Y_{12}$ has the same meaning as in general formula (P-21); and $Y_{13}$ has the same meaning as $X_{15}$ in general formula (P-13).

In the redox compound wherein PUG is represented by general formula (P-2) used in the present invention, the moiety $Y_1$—$Y_2$—$Y_3$ is released upon a reaction with an oxidation product of a developing agent from the redox compound. The cleavage of $Y_2$ in the moiety $Y_1$—$Y_2$—$Y_3$ occurs as a result of a component of the developing solution. It is preferred that the reaction of cleavage of $Y_2$ occurs substantially after the reaction of releasing the moiety $Y_1$—$Y_2$—$Y_3$. Thus, the reaction of cleavage of $Y_2$ is often confused with the reaction of the divalent linking group represented by Time in general formula (R-1), (R-2) or (R-3). However, in the reaction of the group Time, release of the moiety Time-PUG from the redox compound according to the present invention is the essential factor of the successive reaction of releasing the moiety PUG from the moiety Time-PUG. That is to say, the moiety PUG is released substantially only after release of the moiety Time-PUG. As opposed to this, it is preferred that cleavage of the group $Y_2$ occurs irrespective of the release of the moiety PUG. That is to say, cleavage of the group $Y_2$ may occur by the action of the component of a developing solution even in the absence of release of Time-$Y_1$—$Y_2$—$Y_3$ or $Y_1$—$Y_2$—$Y_3$.

Further, where it is represented that $Y_1$—$Y_2$—$Y_3$ is converted into $Y_1$—$Y_{21}$ and $Y_{22}$—$Y_3$ by cleavage of $Y_2$, it is preferred that $Y_{22}$ contains an anionic functional group and that the anionic functional group is a functional group formed by cleavage of $Y_2$. More preferably, $Y_{22}$ contains a conjugated base of an acidic functional group having a pKa of 6 or less as a functional group, and especially preferably a conjugated base of an acidic functional group having a pKa of 5 or less as a functional group. Preferred examples of such acidic functional groups include a carboxy group, a sulfonic acid group, a sulfinic acid group, a phosphoric acid group, a phosphonic acid group and a phosphinic acid group.

In general formula (P-2), the group represented by $Y_2$ is preferably represented by general formula (P-23), (P-24), (P-25) or (P-26) described below. In these general formulae, $Y_2$ is expressed together with $Y_3$ as in general formula (P-2).

$$—Y_{23}—Y_{24}—Y_3 \quad (P\text{-}23)$$

wherein $Y_3$ has the same meaning as in general formula (P-2); $Y_{24}$ has the same meaning as $X_{12}$ in general formula (P-11); $Y_{23}$ represents

—OCO—, —SCO—, —O—$SO_2$—,

-continued

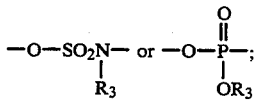

and $R_3$ has the same meaning as in general formula (P-1).

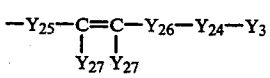

(P-24)

wherein $Y_3$ has the same meaning as in general formula (P-2); $Y_{24}$ has the same meaning as in general formula (P-23); $Y_{25}$ represents —CO— or —$SO_2$—; $Y_{26}$ represents —S—, —O— or —$SO_2$—; $Y_{27}$ represents a hydrogen atom or a monovalent group, and two $Y_{27}$ groups may be the same or different or may be bonded to each other to form a ring; or one or both of the two $Y_{27}$ groups may be bonded to the group $Y_1$ of general formula (P-2) to form a cyclic structure.

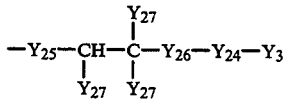

(P-25)

wherein $Y_3$, $Y_{24}$, $Y_{25}$, $Y_{26}$ and $Y_{27}$ each has the same meaning as in general formula (P-24).

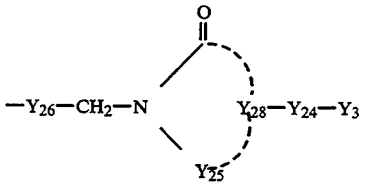

(P-26)

wherein $Y_3$ has the same meaning as in general formula (P-2); $Y_{24}$ has the same meaning as in general formula (P-23); $Y_{25}$ and $Y_{26}$ each has the same meaning as in general formula (P-24); $Y_{28}$ represents a non-metallic atomic group necessary for forming a cyclic structure together with the nitrogen atom, $Y_{25}$ and the carbonyl group.

In general formula (P-2), $Y_3$ has the same meaning as $X_3$ in general formula (P-1).

With respect to $Y_3$, the description including the preferred embodiments for $X_3$ in general formula (P-1) can be applied here too.

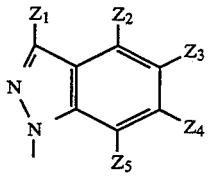

(P-3)

wherein $Z_1$ to $Z_5$ each represents a hydrogen atom or a monovalent group, provided that $Z_1$ to $Z_5$ meet at least one of the following requirements:

(1) at least one of $Z_2$ and $Z_5$ is a nitro group, (2) at least one of $Z_3$ and $Z_4$ is a nitro group and at least two of $Z_1$ to $Z_5$ are electron withdrawing groups, and (3) at least one of $Z_3$ and $Z_4$ is a nitro group and $Z_1$ is an aliphatic or aromatic group.

In greater detail, suitable examples of the monovalent groups represented by $Z_1$ to $Z_5$ include a nitro group and a nitroso group as well as the substituents described for $R_1$ in general formula (R-1).

Of the aliphatic groups represented by $Z_1$, a straight chain, branched chain or cyclic alkyl group having from 1 to 10 carbon atoms, an alkenyl group and an alkynyl group are preferred. An aralkyl group having from 7 to 10 carbon atoms wherein an alkyl group is substituted with an aryl group is also preferred. Specific examples of the preferred aliphatic groups include a methyl group, an ethyl group, an isopropyl group, a tert-butyl group and a benzyl group.

Of the aromatic groups represented by $Z_1$, an aryl group having from 6 to 10 carbon atoms and an unsaturated heterocyclic group having from 5 to 10 carbon atoms are preferred. These groups may be substituted. Suitable examples of the substituents include the monovalent groups represented by $Z_1$ to $Z_5$. Specific examples of the preferred aromatic groups include a substituted or unsubstituted phenyl group, a substituted or unsubstituted naphthyl group, a substituted or unsubstituted pyrizyl group, a substituted or unsubstituted quinolyl group and a substituted or unsubstituted isoquinolyl group.

When at least two of $Z_2$ to $Z_5$ represent electron withdrawing groups containing at least one nitro group, preferred electron withdrawing groups are substituents having a Hammett's substituent constant of 0.2 or more in terms of the $\sigma p$ value or of 0.3 or more in terms of the $\sigma m$ value, more preferably 0.3 or more in terms of the $\sigma p$ value or 0.4 or more in terms of the $\sigma m$ value. Specific examples of the electron withdrawing groups include a nitro group, a nitroso group, a cyano group, a polyhalogenated alkyl group such as a trifluoromethyl group or a trichloromethyl group, a polyfluoroaryl group such as a pentafluorophenyl group, an alkylsulfonyl group, an arylsulfonyl group, an alkylsulfinyl group, an arylsulfinyl group, a sulfamoyl group, a carbamoyl group, an alkylcarbonyl group, an arylcarbonyl group, an alkoxycarbonyl group, an aryloxycarbonyl group, a formyl group, an arylazo group, an amidino group, an ammonio group, a sulfonio group, an acyloxy group, an alkylsulfonyloxy group, an arylsulfonyloxy group, a phosphino group, a phosphinoxy group, a phosphonic acid ester group, a phosphonic acid amido group, an electron-lacking heterocyclic group, a bromine atom and a fluorine atom. These groups may further be substituted. Suitable examples of the substituents include those listed for $R_1$ in general formula (R-1).

Further, any one of $Z_2$, $Z_4$ and $Z_5$ is preferably a nitro group, and it is particularly preferred that $Z_2$ is a nitro group.

Examples of PUG represented by general formula (P-3) in the present invention are shown below, but the present invention should not be construed as being limited thereto:

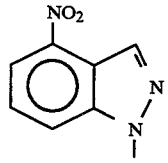

P-301

-continued
P-302
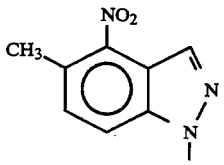
P-303
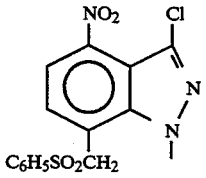
P-304
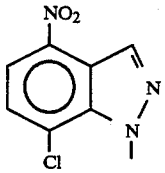
P-305
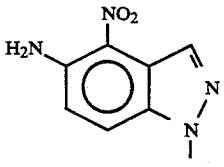
P-306
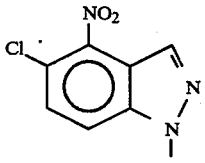
P-307
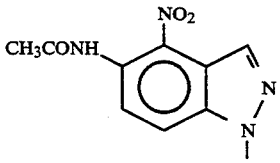
P-308
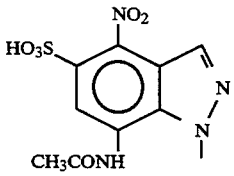
P-309
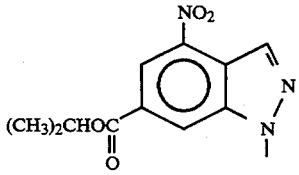
P-310
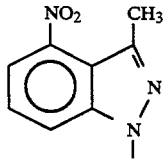
-continued
P-311
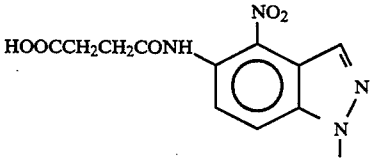
P-312
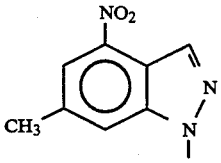
P-313
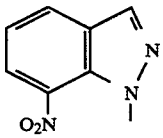
P-314
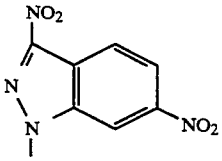
P-315
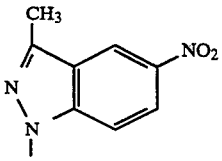
P-316
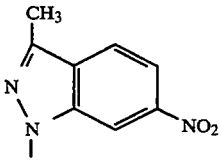
P-317
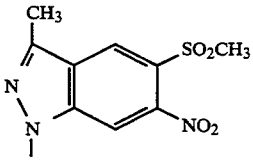
P-318
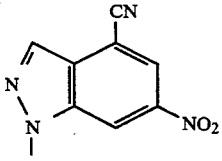
P-319
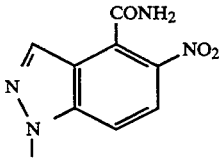

-continued

P-320

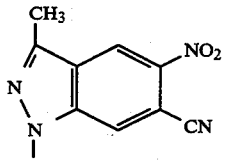

P-321

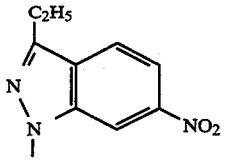

P-322

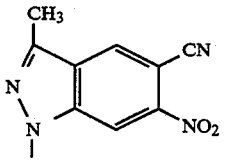

P-323

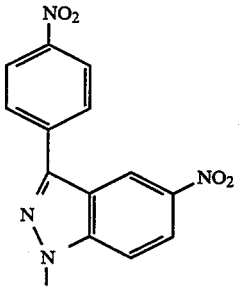

P-324

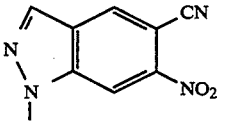

In the compounds represented by general formula (R-1), (R-2) or (R-3), a ballast group which is conventionally employed in immobile photographic additives such as couplers, or a group which is capable of accelerating adsorption of the compound onto silver halide grains may be incorporated into $R_1$ or Time of those formulas.

The ballast group is an organic group which provides a molecular weight sufficient for substantially preventing the compound represented by general formula (R-1), (R-2) or (R-3) from diffusion into other layers or into a processing solution. It includes, for example, alkyl, aryl, heterocyclic, ether, thioether, amido, ureido, urethane, sulfonamido or a combination of two or more thereof. The ballast group is preferably one containing a substituted benzene ring, and particularly one containing a benzene ring substituted with a branched alkyl group.

The adsorption accelerating group for silver halides includes a cyclic thioamido group, for example, 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidazoline-2-thione, a linear thioamido group, an aliphatic mercapto group, an aromatic mercapto group, a heterocyclic mercapto group (when the atom adjacent to the carbon atom bonded to the —SH group is a nitrogen atom, the mercapto group has the same meaning as a cyclic thioamide group which is in a tautomeric relation therewith and specific examples thereof are the same as illustrated above), a group having a disulfido bond, a 5-membered or 6-membered nitrogen-containing heretocyclic ring comprising a combination of nitrogen, oxygen, sulfur, and carbon atoms, for example, benzotriazole, triazole, tetrazole, indazole, benzimidazole, imidazole, benzothiazole, thiazole, thiazoline, benzoxazole, oxazole, oxazoline, thiadiazole, oxadiazole, triazine and azaindene, and a heterocyclic quaternary salt, for example, benzimidazolinium.

The compounds according to formulas (R-1), (R-2) or (R-3) may be further substituted with one or more appropriate substituents. The substituents can be selected from those described for $R_1$ above.

Examples of the redox compounds which can be employed in the present invention are shown below, but the present invention is not to be be construed as being limited to these compounds:

(R-1)

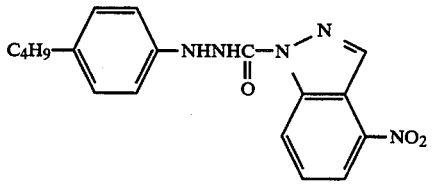

(R-2)

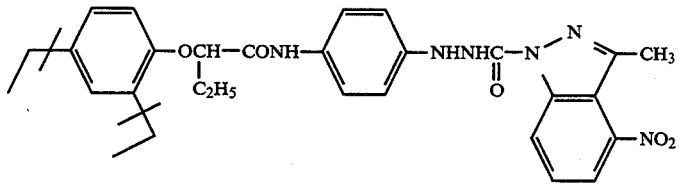

-continued
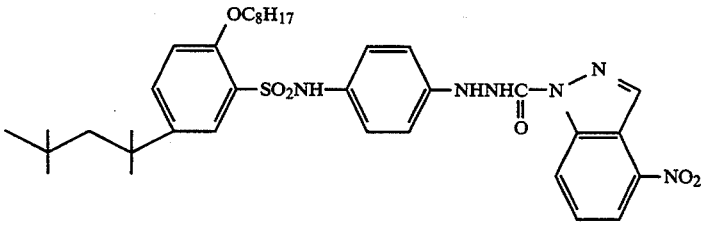
(R-3)
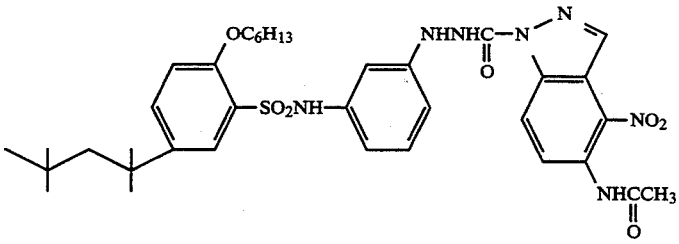
(R-4)
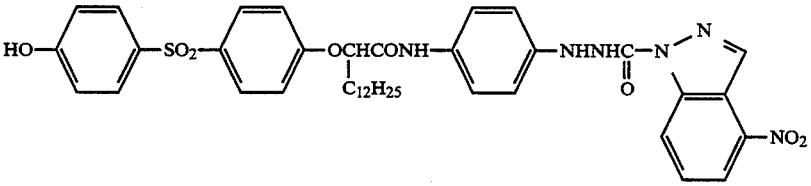
(R-5)
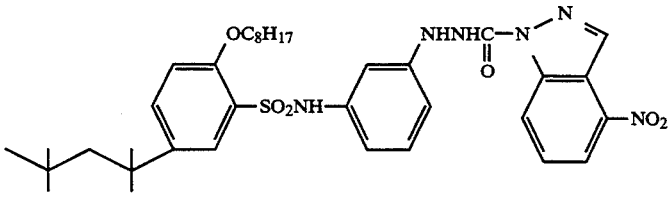
(R-6)
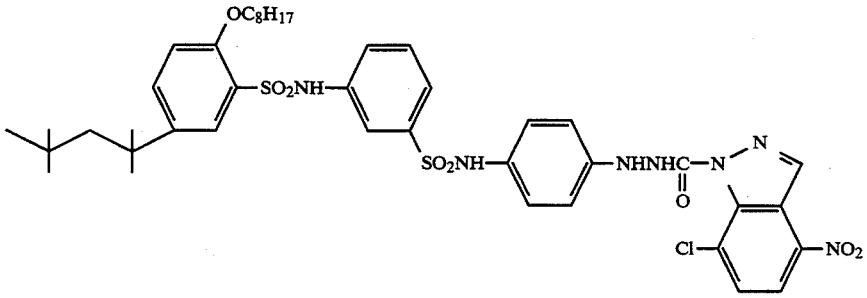
(R-7)
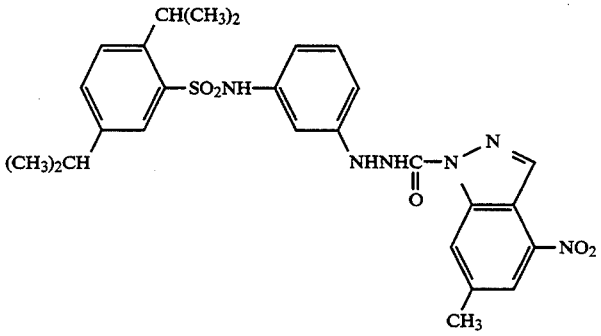
(R-8)

-continued
(R-9)
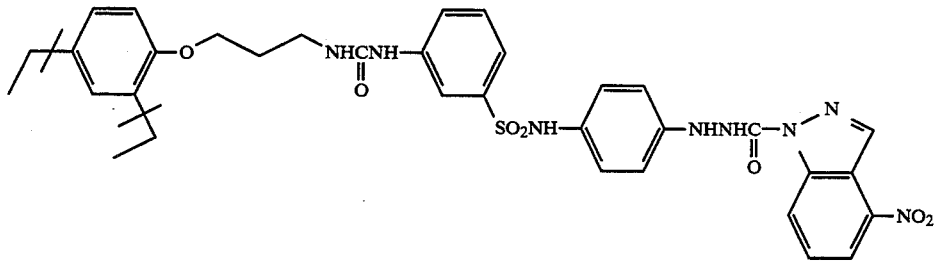
(R-10)
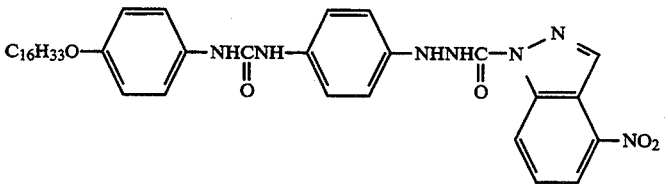
(R-11)
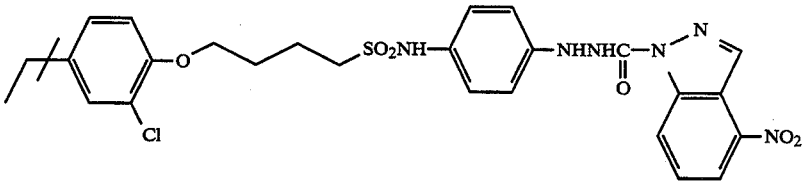
(R-12)
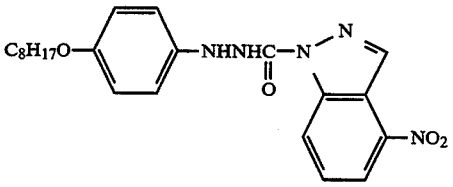
(R-13)
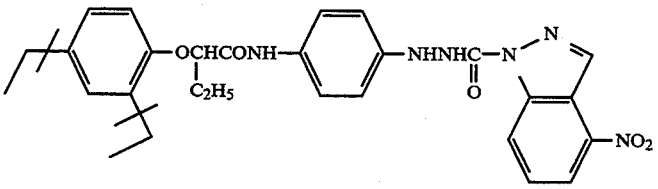
(R-14)
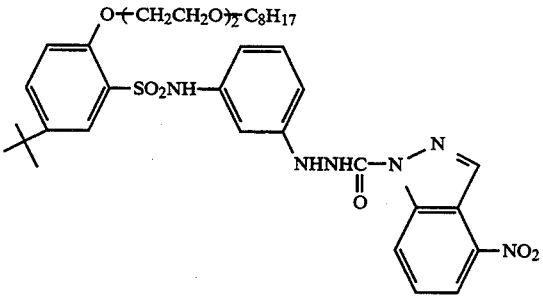
(R-15)
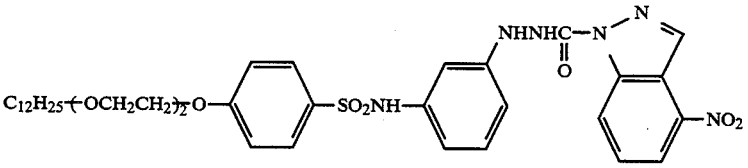

-continued
(R-16)
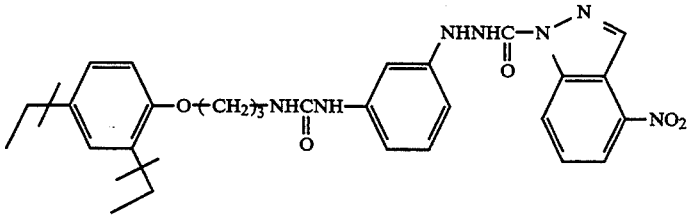
(R-17)
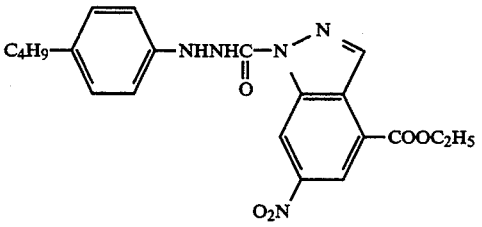
(R-18)
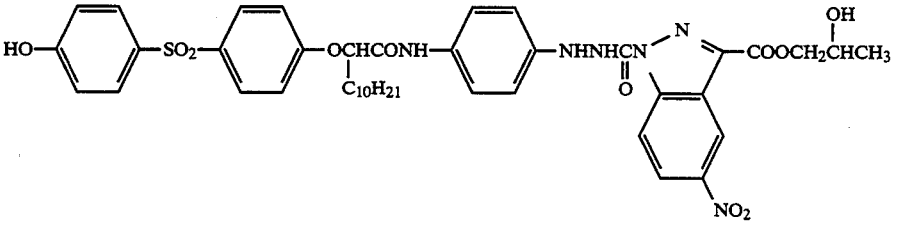
(R-19)
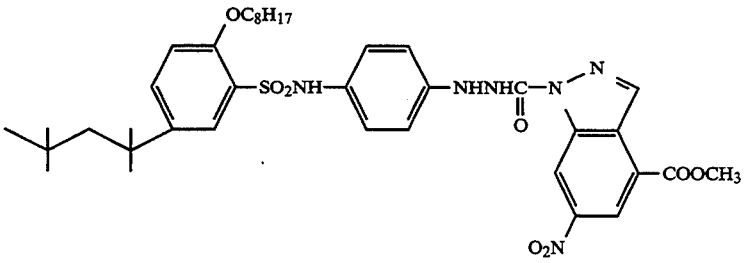
(R-20)
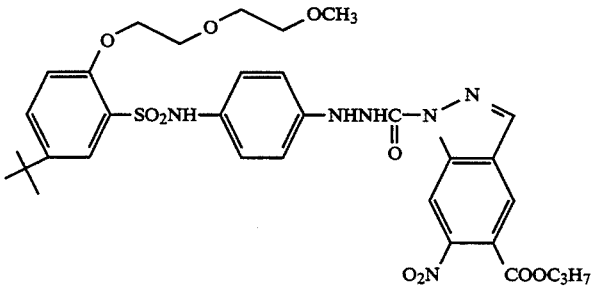
(R-21)
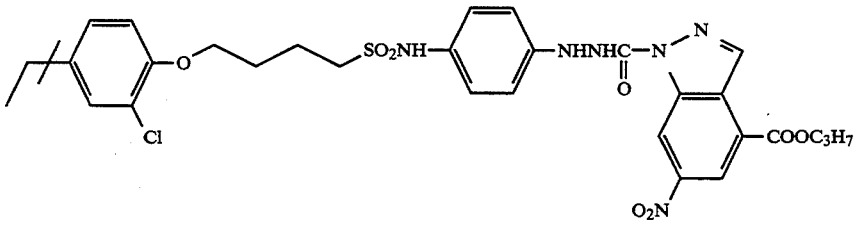
(R-22)
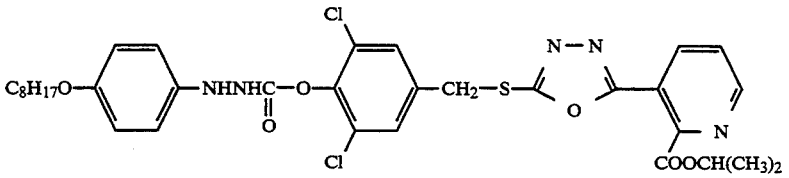

-continued
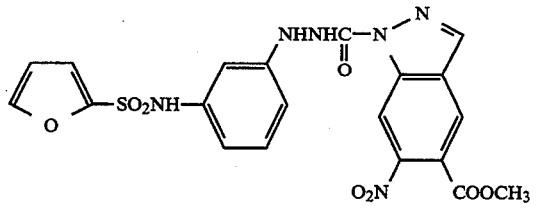
(R-23)
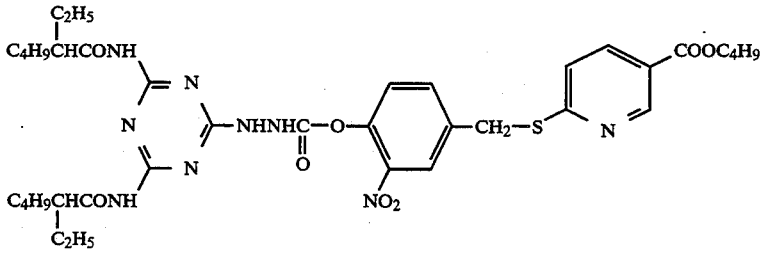
(R-24)
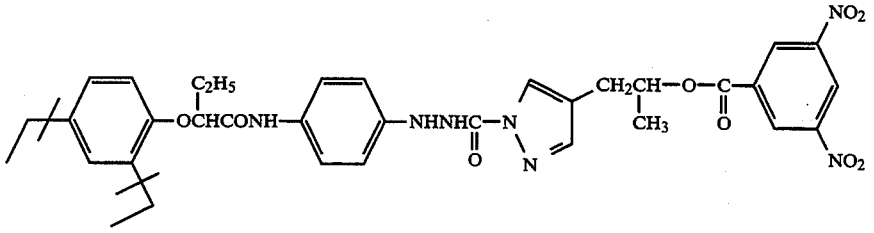
(R-25)
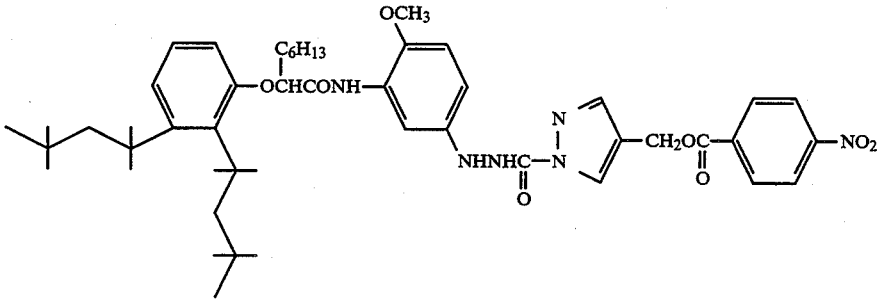
(R-26)
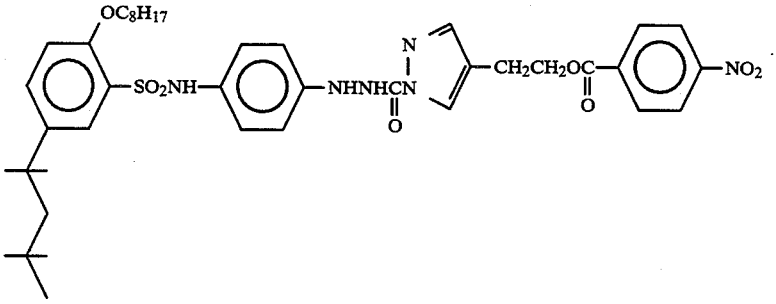
(R-27)

-continued
(R-28)
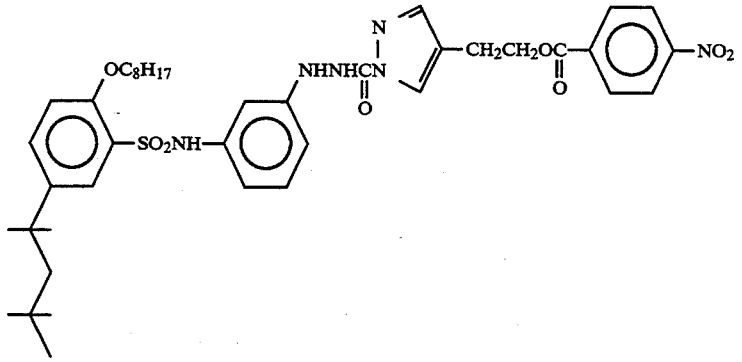
(R-29)
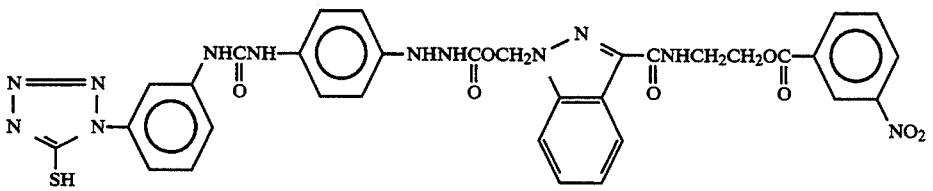
(R-30)
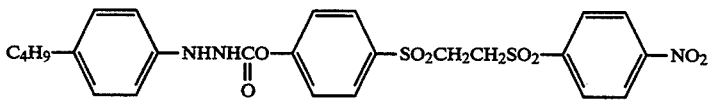
(R-31)
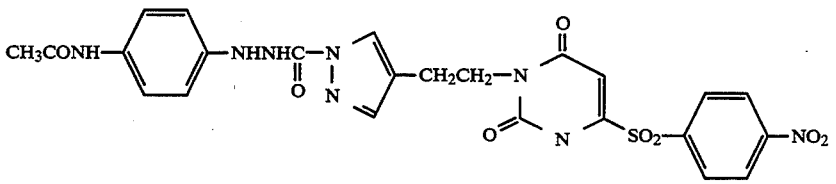
(R-32)
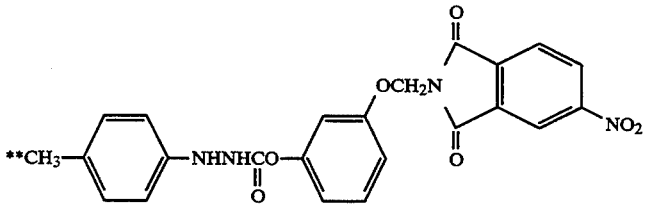
(R-33)
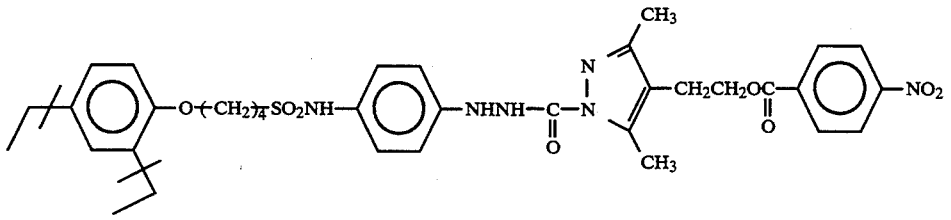
(R-34)
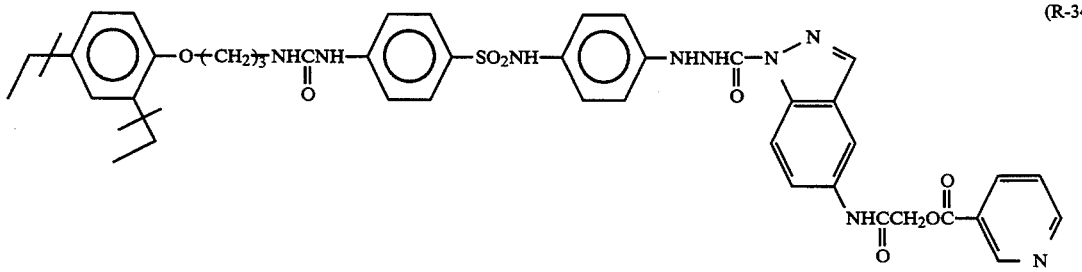

-continued
(R-35)
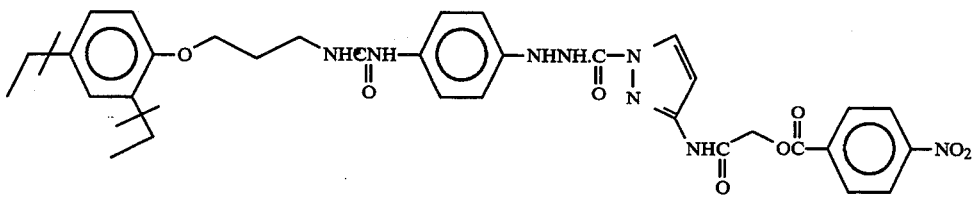
(R-36)
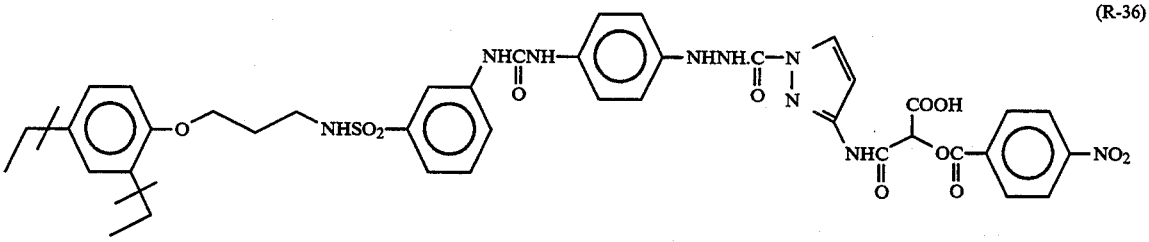
(R-37)
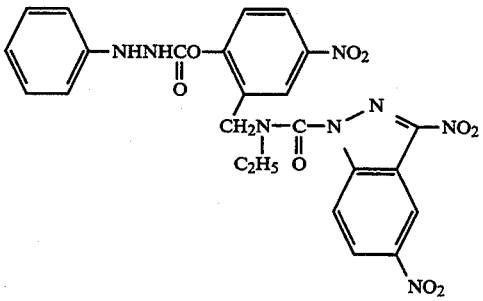
(R-38)
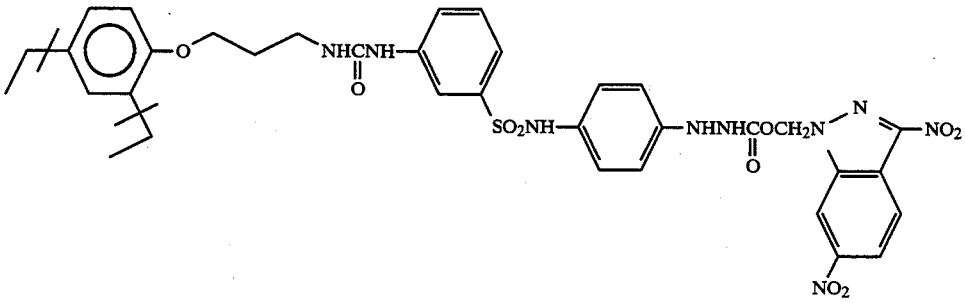
(R-39)
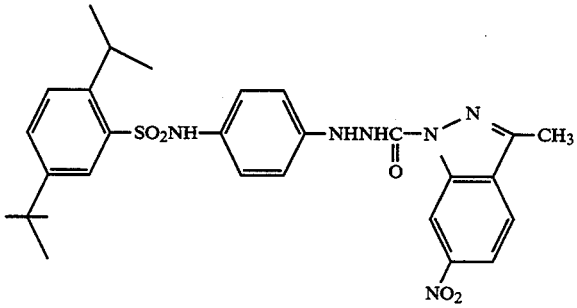
(R-40)
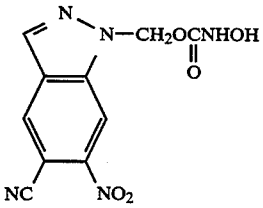

-continued
(R-41)
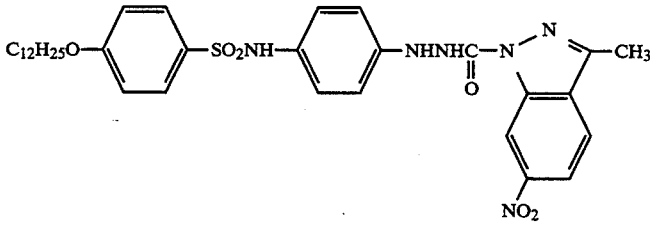
(R-42)
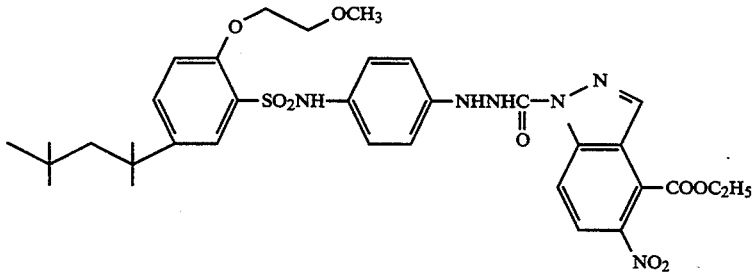
(R-43)
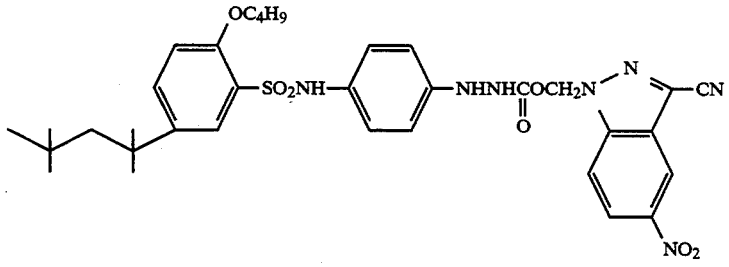
(R-44)
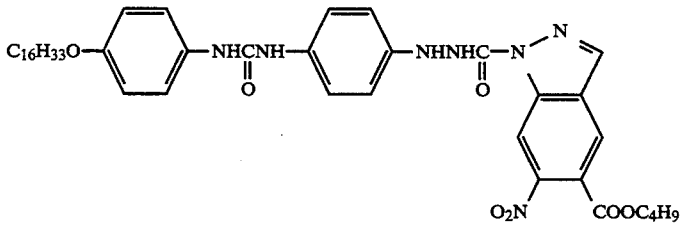
(R-45)
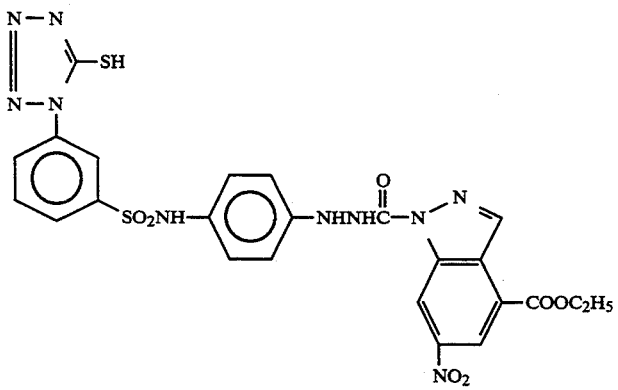
(R-46)
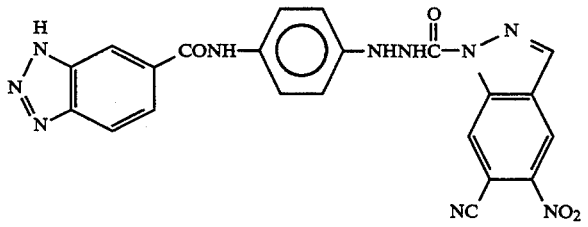

-continued (R-47)

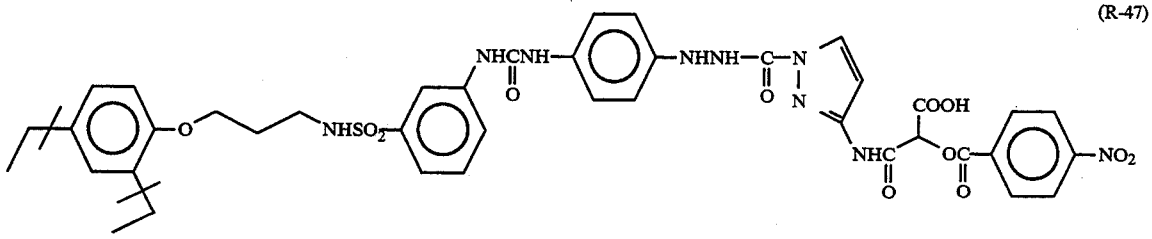

(R-48)

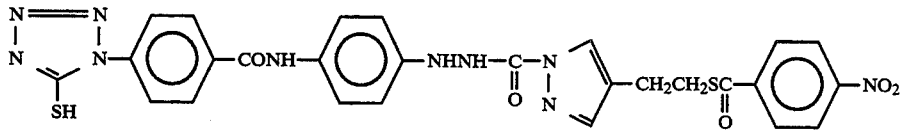

(R-49)

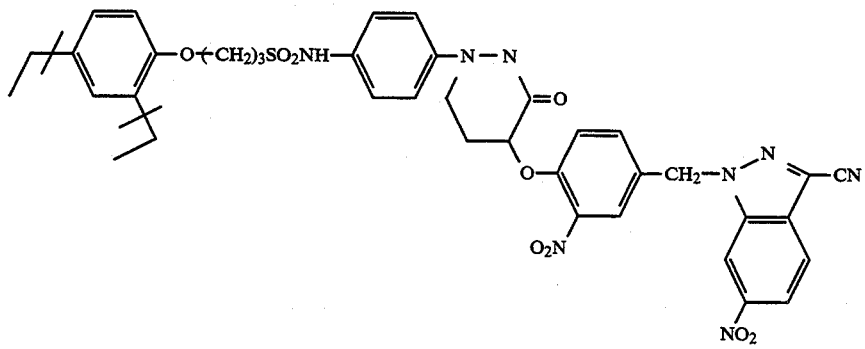

(R-50)

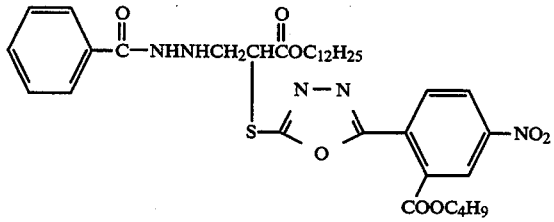

In addition to the above described compounds, the redox compounds described in Japanese Patent Application Nos. 2-258928, 2-258929 and 3-15648 can be used in the present invention.

Methods for synthesizing the redox compounds of the present invention are described, for example, in JP-A-61-213847, JP-A-62-260153, U.S. Pat. No. 4,684,604, JP-A-1-269936, U.S. Pat. Nos. 3,379,529, 3,620,746, 4,377,634 and 4,332,878, JP-A-49-129536, JP-A-56-153336, JP-A-56-153342, JP-A-3-39949, JP-A-3-39953 and JP-A-3-39951.

The redox compounds of the present invention are used in an amount of from $1\times10^{-6}$ to $5\times10^{-2}$ mol, preferably from $1\times10^{-5}$ to $1\times10^{-2}$ mol, per mol of silver halide.

The redox compound of the present invention can be used by dissolving it in an appropriate water-miscible organic solvent such as an alcohol (e.g., methanol, ethanol, propanol, or a fluorinated alcohol), a ketone (e.g., acetone, or methyl ethyl ketone), dimethylformamide, dimethyl sulfoxide, or methyl cellosolve.

The redox compound can also be dissolved using an oil such as dibutyl phthalate, tricresyl phosphate, glycerol triacetate or diethyl phthalate or an auxiliary solvent such as ethyl acetate or cyclohexanone and then mechanically emulsifying and dispersing the resulting solution by conventional emulsifying dispersion methods to prepare an emulsified dispersion. Alternatively, a powdered redox compound can be dispersed in water using a ball mill, a colloid mill, or by ultrasonic dispersion means according to a solid dispersion method known in the art.

The silver halide emulsion used in the silver halide emulsion layer of the present invention may have any composition such as silver chloride, silver chlorobromide, silver iodobromide, or silver iodochlorobromide.

The silver halide emulsion preferably contains a rhodium salt in view of the possible formation of super-high contrast image. One may select the optimum amount of rhodium salt depending on the grain size of silver halide emulsion, the method or degree of chemical sensitization or the like. Test methods for determining the amount thereof are well known in the art. Usually, it is preferable to employ in the range of from $1\times10^{-8}$ mol to $1\times10^{-4}$ mol per mol of silver halide. Preferred examples of the rhodium salts which can be used include rhodium dichloride, rhodium trichloride and ammonium rhodium hexachloride.

The average grain size of the silver halide used in the present invention is preferably very fine (for example, not more than 0.7 μm), and a grain size of not more than 0.5 μm is more preferred. Fundamentally, no limitation is imposed upon the grain size distribution, but the use of a mono-dispersion is preferred. Here, the term "mono-dispersion" means that the emulsion is comprised of grains such that at least 95% of the grains in terms of the number of grains or by weight are of a size within ±40% of the average grain size.

The silver halide grains in the photographic emulsion may have a regular crystalline form such as a cubic or octahedral form, or they may have an irregular form such as a spherical or plate-like form, or they may have a form which is a composite of these forms.

The silver halide grains may be such that the interior and surface layer are comprised of a uniform phase, or the interior and surface layer may be comprised of different phases. Mixtures of two or more types of silver halide emulsions which have been prepared separately can be also employed.

Water soluble dyes can be included in the emulsion layers or other hydrophilic colloid layers in the present invention as filter dyes, for the prevention of irradiation, or for various other purposes. Dyes for further reducing photographic speed, and preferably ultraviolet light absorbers which have a spectral absorption peak in the intrinsically sensitive region of silver halides and dyes which essentially absorb light principally within the 350 nm–600 nm range for increasing stability with respect to safe-light when light-sensitive materials are handled as bright-room light-sensitive materials, can be used as filter dyes.

Specific examples of such dyes which can be used are described in detail in JP-A-63-64039.

The above described dyes are dissolved in an appropriate solvent (for example, water, an alcohol (e.g., methanol, ethanol, or propanol), acetone or methylcellosolve, or a mixture of such solvents) and added to the coating solution which is used for the preparation of a light-insensitive hydrophilic colloid layer in the present invention.

Two or more of these dyes may be employed as a combination thereof.

The dye is employed in an amount necessary to make possible handling the light-sensitive material in a bright room. More specifically, the amount of dye used is preferably from $1\times10^{-3}$ g/m$^2$ to 1 g/m$^2$, particularly preferably from $1\times10^{-3}$ g/m$^2$ to 0.5 g/m$^2$.

Gelatin is advantageously employed as a binder or a protective colloid in photographic emulsions. Other hydrophilic colloids may also be used. Examples of suitable hydrophilic colloids include proteins, e.g., gelatin derivatives, graft polymers of gelatin with other polymers, albumin, and casein; cellulose derivatives, e.g., hydroxyethyl cellulose, carboxymethyl cellulose, and cellulose sulfate; sugar derivatives, e.g., sodium alginate, and starch derivatives; and various kinds of synthetic hydrophilic polymer substances, e.g., polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole, and copolymers comprising monomers constituting these homopolymers.

The gelatin used includes not only lime-processed gelatin but acid-processed gelatin, hydrolysis products of gelatin, and enzymatic decomposition products of gelatin.

The silver halide emulsion used in the present invention may or may not be subjected to chemical sensitization. Sulfur sensitization, reduction sensitization and noble metal sensitization are known as methods for the chemical sensitization of silver halide emulsions, and chemical sensitization can be carried out using these methods either individually or in combination.

Gold sensitization method among the noble metal sensitization methods is typical, and gold compounds, mainly gold complex salts, are used in this case. Complex salts of noble metals other than gold, for example of platinum, palladium or iridium, can also be included. Specific examples thereof are described, for example, in U.S. Pat. No. 2,448,060 and British Patent 618,061.

In addition to the sulfur compounds which are contained in gelatin, various sulfur compounds, for example, thiosulfates, thioureas, thiazoles, and rhodanines can be used as sulfur sensitizing agents.

Stannous salts, amines, formamidinesulfinic acid and silane compounds, for example, can be used as reduction sensitizing agents.

Known spectral sensitizing dyes may be added to the silver halide emulsion layer which can be used in the present invention. Specific examples of the spectral sensitizing dyes used include those described in Japanese Patent Application No. 2-123683, pages 49 to 85 and JP-A-62-215272, pages 77 to 124.

Various compounds can be incorporated into the photographic light-sensitive material of the present invention to prevent the occurrence of fog during the manufacture, storage or photographic processing of the light-sensitive material, or to stabilize photographic properties. Thus, many compounds which are known as anti-fogging agents or stabilizers, such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, or nitrobenzotriazoles; mercaptopyrimidines; mercaptotriazines; thioketo compounds such as oxazolinethione; azaindenes, for example, triazaindenes, tetraazaindenes (especially 4-hydroxy substituted 1,3,3a,7-tetraazaindenes) and pentaazaindenes; benzenethiosulfonic acid; benzenesulfinic acid; and benzenesulfonic acid amide, can be used. Among these compounds, the benzotriazoles (for example, 5-methylbenzotriazole) and nitroindazoles (for example, 5-nitroindazole) are preferred. Furthermore, these compounds may be included in a processing solution.

Inorganic or organic hardening agents can be incorporated into the photographic emulsion layer or other hydrophilic colloid layers in the photographic light-sensitive materials of the present invention. For example, chromium salts (for example, chromium alum), aldehydes (for example, glutaraldehyde), N-methylol compounds (for example, dimethylolurea), dioxane derivatives, active vinyl compounds (for example, 1,3,5-triacryloylhexahydo-s-triazine, or 1,3-vinylsulfonyl-2propanol), active halogen compounds (for example, 2,4-dichloro-6-hydroxy-s-triazine), and mucohalogen acids can be used individually or in combination.

A variety of surfactants can be included in the photographic emulsion layer or other hydrophilic colloid layers of the photographic light-sensitive material of the present invention, for various purposes, for example, as coating aids, as antistatic agents, for improving sliding properties, for emulsification and dispersion purposes, for the prevention of adhesions and for improving photographic performance (for example, accelerating development, increasing contrast or increasing speed).

For example, nonionic surfactants, such as saponin (steroid based), alkylene oxide derivatives (for example, polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkyl amines or amides, and polyethylene oxide adducts of silicones), glycidol derivatives (for example, alkenylsuccinic acid polyglyceride, and alkylphenol polyglyceride), fatty acid esters of polyhydric alcohols, and sugar alkyl esters; anionic surfactants which include acidic groups, such as carboxy groups, sulfo groups, phospho groups, sulfate groups and phosphate groups, for example, alkylcarboxylates, alkylsulfonates alkylbenzenesulfonates, alkylnaphthalenesulfonates, alkylsulfate, alkylphosphate, N-acyl-N-alkyltaurines, sulfosuccinate, sulfoalkylpolyoxyethylene alkylphenyl ethers, and polyoxyethylene alkylphosphate; amphoteric surfactants, such as amino acids, aminoalkylsulfonic acid, aminoalkyl sulfate or phosphate, alkylbetaines, and amineoxides; and cationic surfactants, such as aikylamine salts, aliphatic and aromatic quaternary ammonium salts, heterocyclic quaternary ammonium salts, for example pyridinium salts and imidazolium salts, and phosphonium and sulfonium salts which contain an aliphatic or heterocyclic ring can be employed.

Further, the compounds described, for example, in JP-A-62-215272, pages 649 to 688 may be employed.

Furthermore, polymer latexes such as polyalkyl acrylate latexes can be included for the purpose of providing dimensional stability.

In addition to the compounds described, for in example, JP-A-53-77616, JP-A-54-37732, JP-A-53-137133, JP-A-60-140340 and JP-A-60-14959, various compounds which contain N or S atoms are effective as development accelerators or nucleating infectious development accelerators which are suitable for use in the present invention.

Specific examples thereof are illustrated below.

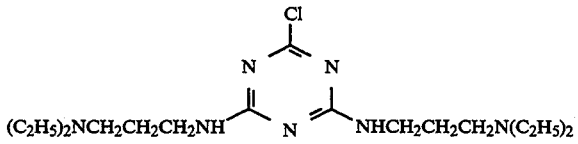

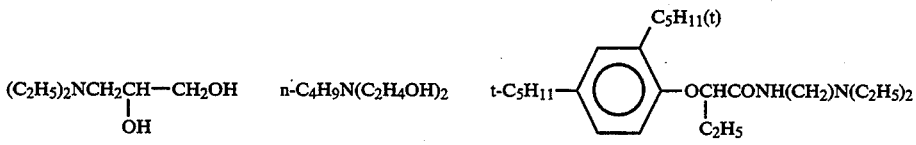

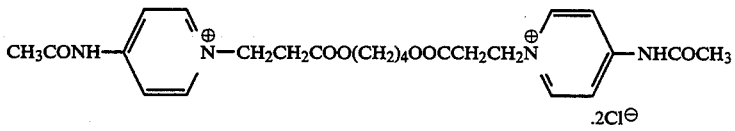

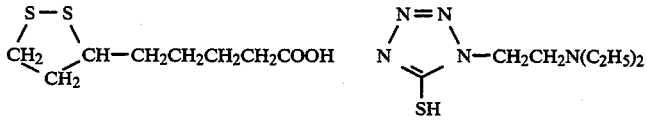

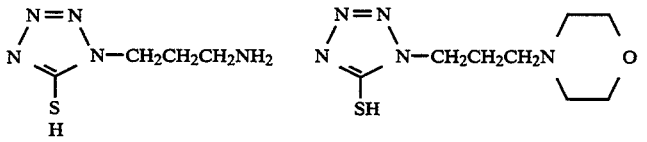

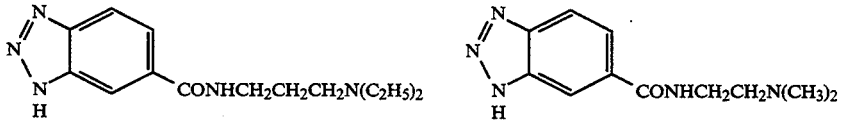

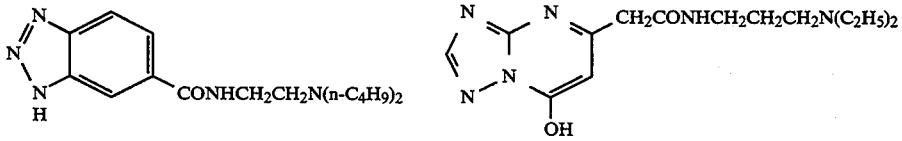

-continued

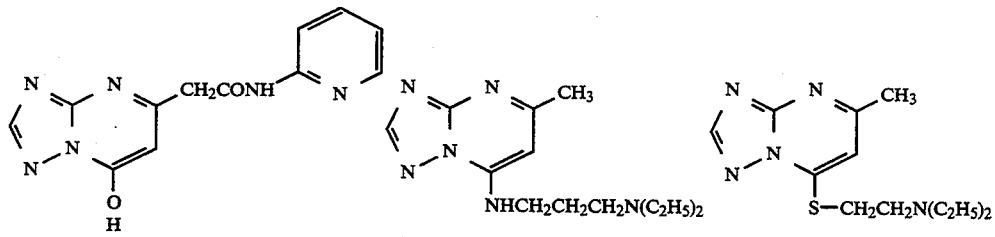

The optimum amount of the accelerator can be varied depending on the type of compound, but it is usually added in an amount of from $1.0\times10^{-3}$ g/m$^2$ to 0.5 g/m$^2$, and preferably from $5.0\times10^{-3}$ g/m$^2$ to 0.1 g/m$^2$. The accelerator is dissolved in a suitable solvent (for example, water, an alcohol such as methanol or ethanol, acetone, dimethylformamide, or methylcellosolve) and added to the coating solution.

A plurality of these additives can be used in combination.

A stable developing solution can be used in order to obtain superhigh contrast and high speed photographic characteristics using the silver halide photographic material of the present invention, and there is no need for the use of a conventional infectious developing solution or a highly alkaline developing solution of pH of nearly 13 as described in U.S. Pat. No. 2,419,975.

That is to say, superhigh contrast negative images can be obtained satisfactorily with the silver halide photographic material according to the present invention using a developing solution of pH 10.5–12.3, and preferably of pH 11.0–12.0, which contains at least 0.15 mol/liter of sulfite ion as a preservative.

No particular limitation is imposed upon the developing agent which can be used-in the processing of the present invention. For example, dihydroxybenzenes (for example, hydroquinone), 3-pyrazolidones (for example, 1-phenyl-3-pyrazolidone, or 4,4-dimethyl-1-phenyl-3-pyrazolidone), and aminophenols (for example, N-methyl-p-aminophenol) can be employed either individually or in combination.

The silver halide photographic material of the present invention is especially suitable for processing in a developing solution which contains a dihydroxybenzene as a main developing agent and a 3-pyrazolidone or an aminophenol as an auxiliary developing agent. The combined use of from 0.05 to 0.5 mol/liter of a dihydroxybenzene and not more than 0.06 mol/liter of a 3-pyrazolidone or aminophenol in the developing solution is preferred.

Furthermore, the development rate can be increased and the development time can be shortened by adding an amine to the developing solution, as described in U.S. Pat. No. 4,269,929.

In the developing solution used in the present invention, the amino compound described in Japanese Patent Application No. 1-294185 can be used.

Moreover, the developing solution may contain pH buffers, such as sulfites, carbonates, borates or phosphates of alkali metals, and development inhibitors or antifoggants, such as bromides, iodides and organic antifoggants (nitroindazoles and benzotriazoles being especially preferred) can also be included in the developing solution. Water softening agents, dissolution promoters, toning agents, development accelerators, surfactants (the above described polyalkylene oxides being especially preferred), defoaming agents, hardening agents, and agents for preventing silver contamination of film (for example, 2-mercaptobenzimidazolesulfonic acid) may be included, if desired.

Usual compositions can be used for a fixing solution. As well as thiosulfates and thiocyanates, the organosulfur compounds which are known to be effective as fixing agents can also be used as fixing agents. Water soluble aluminum salts can also be included in the fixing solution as hardening agents.

The processing temperature for the materials of the present invention is normally selected in the range of from 18° C. to 50° C.

The use of an automatic processor is preferred for photographic processing, and superhigh contrast negative gradation photographic characteristics can be obtained satisfactorily with the method of the present invention even if the total processing time from the introduction of the light-sensitive material into the processor to the discharge of the material from the processor is set in the range of from 60 to 120 seconds.

The compound described in JP-A-56-24347 can be used in the developing solution for the present invention as an agent for preventing silver contamination. The compound described in JP-A-61-267759 can be used as a dissolution promoter which is added to the developing solution. Moreover, the compounds described in JP-A-60-93433 and JP-A-62-186259 can be used as pH buffers in the developing solution.

According to one preferred embodiment of the present invention, a silver halide photographic material comprises a support having provided thereon a first silver halide emulsion layer (1), a hydrophilic colloid layer (2), a second silver halide emulsion layer (3) and a protective layer (4) in this order from the support, wherein (1) or (3) contains at least one nucleating agent represented by general formula (N-1) described below, the silver halide emulsion layer which does not contain the nucleating agent contains at least one redox compound capable of releasing a development inhibitor upon being oxidized. This redox compound is represented by general formula (R-1), (R-2) or (R-3) described below. The silver halide emulsion layer containing the nucleating agent and/or a hydrophilic colloid layer adjacent thereto which does not contain a silver halide emulsion contains at least one compound represented by the general formula (Q-1) or (Q-2) described below.

$$R_1-\underset{\underset{A_1}{|}}{N}-\underset{\underset{A_2}{|}}{N}-G_1-R_2 \qquad \text{(N-1)}$$

wherein $R_1$ represents an aliphatic group or an aromatic group; $R_2$ represents a hydrogen atom, an alkyl group, an aryl group, an alkoxyl group, an aryloxy group, an amino group, a hydrazino group, a carbamoyl group, or an oxycarbonyl group; $G_1$ represents $$-CO-,\ -SO_2-,\ -SO-,\ -\overset{\overset{O}{\|}}{\underset{\underset{R_2}{|}}{P}}-$$

(wherein $R_2$ is as defined above), $$-\overset{\overset{O}{\|}}{C}-\overset{\overset{O}{\|}}{C}-,\ -CS-,$$

or an iminomethylene group; $A_1$ and $A_2$ each represents a hydrogen atom, or one of $A_1$ and $A_2$ represents a hydrogen atom, and the other represents a substituted or unsubstituted alkylsulfonyl group, a substituted or unsubstituted arylsulfonyl group, or a substituted or unsubstituted acyl group, $$R-NHNH-\underset{\underset{O}{\|}}{C}-N\quad Z$$

wherein R represents an aliphatic group, an aromatic group or a heterocyclic group; and Z represents an atomic group necessary to form a nitrogen-containing heterocyclic aromatic group, $$R-NHNH-\underset{\underset{O}{\|}}{C}-B \qquad \text{(Q-2)}$$

wherein R represents an aliphatic group, an aromatic group or a heterocyclic group; and B represents a phenyl or naphthyl group, $$R_1-\underset{\underset{A_1}{|}}{N}-\underset{\underset{A_2}{|}}{N}-G_1-(Time)_t-PUG \qquad \text{(R-1)}$$

$$R_1-G_2-G_1-\underset{\underset{A_1}{|}}{N}-\underset{\underset{A_3}{|}}{N}-CH_2\underset{\underset{A_3}{|}}{CH}-(Time)_t-PUG \qquad \text{(R-2)}$$

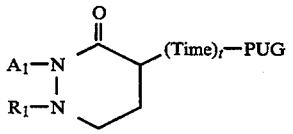

(R-3)

wherein $R_1$ represents an aliphatic or aromatic group; $G_1$ represents $$-\overset{\overset{O}{\|}}{C}-,\ -\overset{\overset{O}{\|}}{C}-\overset{\overset{O}{\|}}{C}-,\ -\overset{\overset{S}{\|}}{C}-\ -\overset{\overset{N-G_2-R_2}{\|}}{C}-\ ,$$

$-SO-$, $-SO_2-$ or $$-\overset{\overset{O}{\|}}{\underset{\underset{G_2-R_2}{|}}{P}}-\ ;$$

$G_2$ represents a mere bond, $$-O-,\ -S-\ \text{or}\ -\underset{\underset{R_2}{|}}{N}-;$$

$R_2$ represents a hydrogen atom or $R_1$; and $A_1$ and $A_2$ each represents a hydrogen atom, an alkylsulfonyl group which may be substituted, an arylsulfonyl group which may be substituted or an acyl group which may be substituted, provided that in general formula (R-1), at least one of $A_1$ and $A_2$ is hydrogen atom; $A_3$ has the same meaning as $A_1$ or represents a $$-CH_2\underset{\underset{A_4}{|}}{CH}-(Time)_t-PUG$$

group; $A_4$ represents a nitro group, a cyano group, a carboxyl group, a sulfonyl group or a $-G_1$13 $G_2-R_1$ group; Time represents a divalent connecting group; t represents 0 or 1; and PUG represents a development inhibitor which is soluble in a developing solution and capable of changing into a compound having less development inhibiting activity upon a reaction with a component of the developing solution, further provided that when two or more moieties of $R_2$ or $-G_1-G_2-R$ are present in the molecule of the compound, these moieties may be the same or different.

The present invention is now illustrated in greater detail with reference to the following examples, but the present invention is not to be construed as being limited thereto.

EXAMPLE 1

Preparation of Silver Halide Emulsion A

An aqueous solution containing 0.37M of silver nitrate and an aqueous halide solution containing $1.0\times10^{-7}$ mol/mol Ag of $(NH_4)_3RhC_{16}$, $2\times10^{-7}$ mol/mol Ag of $K_3IrCl_6$, 0.11M of potassium bromide and 0.27M of sodium chloride were added to an aqueous gelatin solution containing sodium chloride and 1,3-dimethyl-2-imidazolidinethione at 45° C. The solutions were stirred over a period of 12 minutes by a double jet process to conduct nucleation whereby silver chlorobromide grains having an average grain size of 0.20 μm and a silver chloride content of 70 mol % were obtained.

Then, an aqueous solution containing 0.63M of silver nitrate and an aqueous halide solution containing 0.19M of potassium bromide and 0.47M of sodium chloride were added thereto over a period of 20 minutes by a double jet process in the same manner as above. The resulting emulsion was subjected to conversion by adding an aqueous solution containing $1\times10^{-3}$ mol/mol Ag of potassium iodide, washed with water by a conventional flocculation method, and 40 g of gelatin was added thereto. After adjusting pH to 6.5 and pAg to 7.5, 7 mg/mol Ag of sodium benzenethiosulfonate, 5 mg/mol Ag of sodium thiosulfate and 8 mg/mol Ag of chloroauric acid were added to the emulsion, followed by heating at 60° C. for 45 minutes to conduct chemical sensitization. Then 150 mg of 1,3,3a,7-tetraazaindene as a stabilizer and proxel as an antiseptic were added thereto, whereby an emulsion containing cubic silver chlorobromide grains having an average grain size of 0.28 μm, a coefficient of variation of 9% and a silver chloride content of 70 mol % was obtained.

Preparation of Coating Sample

On a polyethylene terephthalate film support (thickness: 150 μm) having a subbing layer (thickness: 0.5 μm) composed of a copolymer of vinylidene chloride, each layer of UL, EM and PC was coated in this order from the support side to prepare Samples 101 to 111.

Preparation and coating amount of each layer are shown below.

UL:

Ten g of gelatin, 20% by weight of polyethyl acrylate based on gelatin, 2% by weight of Compound (a) shown below based on gelatin and water necessary to form 250 ml of a finished solution were added. The coating solution thus prepared was coated at a gelatin coating amount of 0.5 g/m$^2$.

EM:

Silver Halide Emulsion A described above was melted at 40° C. together with gelatin. Then, added thereto were $3.6\times10^{-4}$ mol/mol Ag of Compound (S-1) shown below as a sensitizing dye, 6.5 mg/m$^2$ of 5-methylbenzotriazole, 1.3 mg/m$^2$ of 4-hydroxy-1,3,3a,7-tetraazaindene, 1 mg/m$^2$ of 1-phenyl-5-mercaptotetrazole, 50 mg/m$^2$ of Compound (a) shown below, 15% by weight of polyethyl acrylate based on gelatin, 15% by weight of Compound (c) shown below based on gelatin, 4% by weight of Compound (b) shown below based on gelatin as a gelatin hardener, and the nucleating agents represented by general formula (N-1) and the compounds represented by general formula (Q-1) or (Q-2) according to the present invention as shown in Table 2 below. The resulting coating solution was coated at a silver coating amount of 3.6 g/m$^2$.

Compound (S-1)

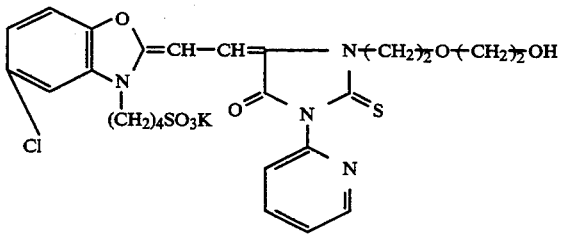

Compound (a)

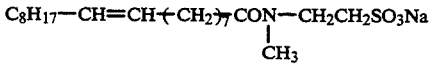

Compound (b)

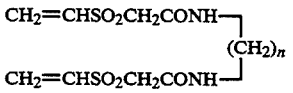

n = 2/n = 3:3/1

Compound (c)

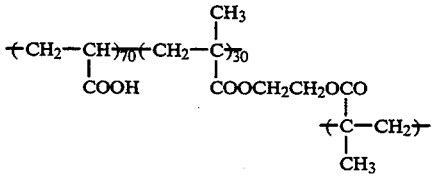

PC:

To an aqueous gelatin solution were added a dispersion of polymethyl methacrylate (average particle size: 5 μm) and Surfactants (d) and (e) shown below. The resulting coating solution was coated at a gelatin coating amount of 0.5 g/m$^2$ and a polymethyl methacrylate coating amount of 0.5 g/m$^2$.

Surfactant (d)

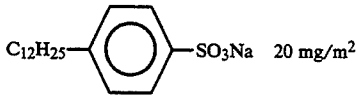

Surfactant (e)

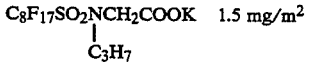

Further, a back layer having the composition shown below was coated on the rear side of the support.

| Back Layer Composition: | | |
|---|---|---|
| Gelatin | 4 | g/m$^2$ |
| Matting agent (polymethyl methacrylate having a particle size of from 3.0 to 4.0 μm) | 10 | mg/m$^2$ |
| Polyethyl acrylate latex | 2 | g/m$^2$ |
| Surfactant (sodium p-dodecylbenzene sulfonate) | 40 | mg/m$^2$ |
| Fluorine Type Surfactant (e) | 5 | mg/m$^2$ |
| Gelatin Hardener (Compound (b)) | 110 | mg/m$^2$ |
| Dye: a mixture of: | | |
| Dye (a) | 53 | mg/m$^2$ |
| Dye (b) | 14 | mg/m$^2$ |
| Dye (c) | 25 | mg/m$^2$ |
| Dye (d) | 18 | mg/m$^2$ |

Dye (a)

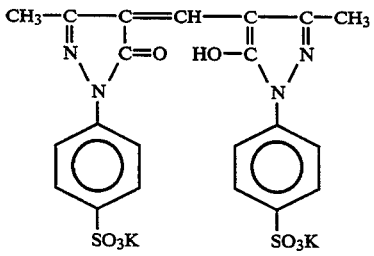

Dye (b)

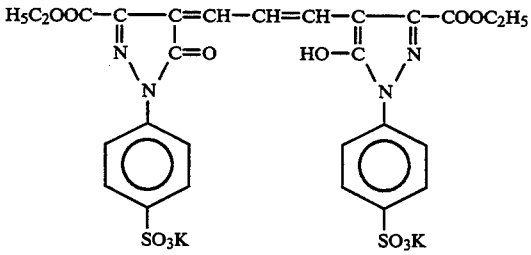

Dye (c)

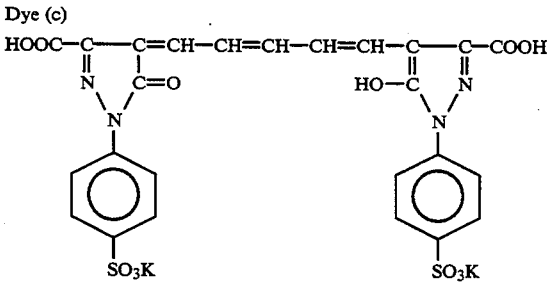

Dye (d)

-continued

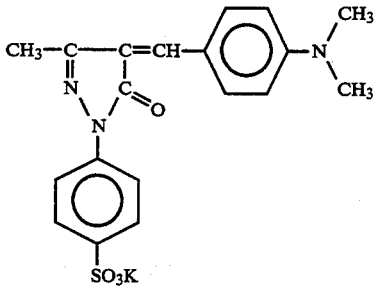

Comparative Compounds a, b and c used are shown below.

Comparative Compound a

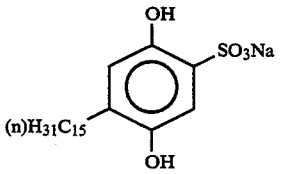

Comparative Compound b

-continued

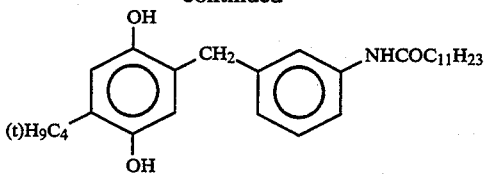

The composition of the developing solution used are shown below.

| Developing Solution: | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)benzene-sulfonate | 2.0 g |
| N-n-Butyldiethanolamine | 15.0 g |
| Sodium Toluenesulfonate | 8.0 g |
| Water to make | 1 l |
| pH adjusted to 11.6 (by adding potassium hydroxide) | pH 11.6 |

The kinds and amounts of the nucleating agents and the compounds represented by general formula (Q-1) or (Q-2) used in EM, and the results of photographic performance obtained are shown in Table 2 below.

TABLE 2

| Sample No. | Nucleating Agent | Amount Added (mol/m²) | Compound of Formula (Q-1)/(Q-2) | Amount Added (mol/m²) | Photographic Property $\bar{G}$[1] | Photographic Property Dot[2] Gradation | Black Pepper[3] Fresh Solution | Black Pepper[3] Fatigued[4] Solution | Remarks |
|---|---|---|---|---|---|---|---|---|---|
| 101 | I-5 | $4.0 \times 10^{-5}$ | — | — | 16.7 | 1.23 | 55 | 107 | Comparison |
| 102 | " | " | Q-109 | $5 \times 10^{-6}$ | 17.1 | 1.24 | 9 | 13 | Present Invention |
| 103 | " | " | Q-113 | " | 17.4 | 1.26 | 4 | 7 | Present Invention |
| 104 | " | " | Q-116 | " | 16.9 | 1.25 | 7 | 10 | |
| 105 | " | " | Q-128 | " | 17.3 | 1.24 | 9 | 11 | Present Invention |
| 106 | " | " | Q-202 | " | 16.8 | 1.24 | 10 | 18 | Present Invention |
| 107 | " | " | Q-203 | " | 17.4 | 1.27 | 13 | 25 | Present Invention |
| 108 | " | " | Q-208 | " | 17.2 | 1.27 | 12 | 20 | Present Invention |
| 109 | I-5 | $4.0 \times 10^{-5}$ | Comparative Compound a | $5 \times 10^{-6}$ | 17.0 | 1.21 | 50 | 81 | Comparison |
| 110 | " | " | Comparative Compound b | " | 17.2 | 1.23 | 33 | 67 | " |
| 111 | " | " | Comparative Compound c | " | 16.7 | 1.24 | 28 | 62 | " |

[1] $\bar{G}$: Gradient of a straight line linking between a point having a density of 0.3 and a point having a density of 3.0 on the characteristic curve. The larger the value, the higher the contrast.

[2] Dot Gradation: Exposure amount for providing a dot area ratio of 95% ($\log E_{95\%}$) - Exposure amount for providing a dot area ratio of 5% ($\log E_{5\%}$)

[3] Black Pepper: Number of black peppers appearing in an area having a diameter of 4 mm was microscopically observed under 25 magnifications. The smaller the value, the better the property.

[4] Fatigued Solution: The developing solution was subjected to running treatment for one week in a FG-660F processor without processing light-sensitive material.

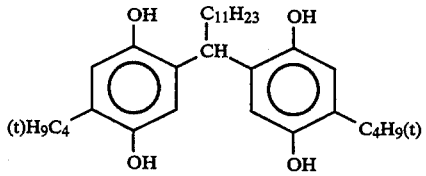

Comparative Compound c

From the results shown in Table 2, it can be seen that in the samples according to the present invention in which the nucleating agent is used together with the compound represented by the general formula (Q-1) or (Q-2), the appearance of black peppers is markedly controlled even when the fatigued developing solution is used, without a substantial change in photographic properties. On the other hand, Samples 109 to 111, wherein Comparative Compounds a, b and c are used respectively, still exhibit a large number of black peppers in comparison with the samples according to the present invention, though some effect on reducing the black peppers is observed in Samples 110 and 111 using Comparative Compounds b and c respectively when treated with a fresh developing solution.

According to the present invention, photographic light-sensitive materials which exhibit the restrained occurrence of black peppers without a substantial change in photographic properties can be obtained.

EXAMPLE 2

Samples 201 to 207 were prepared in the same manner as described in Example 1, except for changing the nucleating agent used in EM to $2.5\times10^{-5}$ mol/m$^2$ of Compound I-5 and $2.5\times10^{-7}$ mol/m$^2$ of Compound I-20 and adding the compound represented by general formula (Q-1) or (Q-2) to UL as shown in Table 3 below instead of adding the compound represented by general formula (Q-1) or (Q-2) to EM. These samples were subjected to exposure and development processing in the same manner as described in Example 1.

The results obtained are shown in Table 3 below.

TABLE 3

| Sample No. | Compound of Formula (Q-1)/(Q-2) in UL | Amount Added (mol/m$^2$) | Photographic Property $\bar{G}$ | Photographic Property Dot Gradation | Black Pepper with Fatigued Solution | Remarks |
|---|---|---|---|---|---|---|
| 201 | — | — | 16.9 | 1.22 | 116 | Comparison |
| 202 | Q-113 | $2.2\times10^{-5}$ | 17.2 | 1.23 | 12 | Present Invention |
| 203 | Q-119 | " | 17.0 | 1.20 | 15 | Present Invention |
| 204 | Q-126 | " | 17.2 | 1.24 | 10 | Present Invention |
| 205 | Q-128 | " | 17.4 | 1.21 | 7 | Present Invention |
| 206 | Q-202 | " | 16.7 | 1.21 | 19 | Present Invention |
| 207 | Q-212 | " | 17.1 | 1.23 | 23 | Present Invention |

As is apparent from the results shown in Table 3, the compound represented by general formula (Q-1) or (Q-2) exhibits the effect of preventing the occurrence of black peppers when added to UL provided under the emulsion layer.

EXAMPLE 3

Preparation of Silver Halide Emulsion B

Silver Halide Emulsion B was prepared in the same manner as for Silver Halide Emulsion A except for changing the amount of $(NH_4)_3RhCl_6$ to $1.8\times10^{-7}$ mol/mol Ag.

Preparation of Coating sample

On a polyethylene terephthalate film support (thickness: 150 μm) having a subbing layer (thickness: 0.5 μm) composed of a copolymer of vinylidene chloride, each layer of UL, EMU, ML, EMO and PC was coated in this order from the support side to prepare Samples 301 to 312.

Preparation and coating amount of each layer are shown below.

UL:

Ten g of gelatin, 20% by weight of polyethyl acrylate based on gelatin, 2% by weight of Compound (a) described in Example 1 based on gelatin and water necessary to form 250 ml of a finished solution were added. The coating solution thus prepared was coated at a gelatin coating amount of 0.5 g/m$^2$.

EMU:

Silver Halide Emulsion A described above was melted at 40° C. together with gelatin. Then, added thereto were $3.6\times10^{-4}$ mol/mol Ag of Compound (S-1) described in Example 1 as a sensitizing dye, 6.5 mg/m$^2$ of 5-methylbenzotriazole, 1.3 mg/m$^2$ of 4-hydroxy-6-methyl-1,3,3a,7-tetraazaindene, 1 mg/m$^2$ of 1-phenyl-5-mercaptotetrazole, 50 mg/m$^2$ of Compound (a) described in Example 1, 15% by weight of polyethyl acrylate based on gelatin, 15% by weight of Compound (c) described in Example 1 based on gelatin, 4% by weight of Compound (b) described in Example 1 based on gelatin as a gelatin hardener, $3.8\times10^{-5}$ mol/m$^2$ of Compound I-5 (nucleating agent) according to the present invention, and the compounds represented by general formula (Q-1) or (Q-2) according to the present invention as shown in Table 4 described below. The resulting coating solution was coated at a silver coating amount of 3.6 g/m$^2$.

ML:

Ten g of gelatin, 20% by weight of polyethyl acrylate based on gelatin, 2% by weight of Compound (a) described in Example 1 based on gelatin and water necessary to form 250 ml of a finished solution were added. The coating solution thus prepared was coated at a gelatin coating amount of 1.0 g/m$^2$.

EMO:

Silver Halide Emulsion B described above was melted together with gelatin. Then, added thereto were $3.6\times10^{-4}$ mol/mol Ag of Compound (S-1) described in Example 1 as a sensitizing dye, 1.0 mg/m$^2$ of 4-hydroxy-6-methyl-1,3,3a,7-tetraazaindene, the compound capable of releasing a development inhibitor upon oxidation according to the present invention as shown in Table 4 below, 20 mg of Compound (a) described in Example 1, 20% by weight of polyethyl acrylate based on gelatin, and 4% by weight of Compound (b) described in Example 1 based on gelatin as a gelatin hardener. The resulting coating solution was coated at a silver coating amount of 0.4 g/m$^2$ and a gelatin coating amount of 0.4 g/m$^2$.

PC:

To an aqueous gelatin solution were added a dispersion of polymethyl methacrylate (average particle size: 5 μm) and Surfactants (d) and (e) described in Example 1. The resulting coating solution was coated at a gelatin coating amount of 0.5 g/m$^2$ and a polymethyl methacrylate coating amount of 0.5 g/m$^2$.

Further, a back layer having the composition shown below was coated on the rear side of the support.

| Back Layer Composition: | |
|---|---|
| Gelatin | 4 g/m$^2$ |
| Matting agent (polymethyl methacrylate having a particle size of from 3.0 to 4.0 μm) | 10 mg/m$^2$ |
| Polyethyl acrylate latex | 2 g/m$^2$ |
| Surfactant (sodium p-dodecylbenzene sulfonate) | 40 mg/m$^2$ |
| Fluorine Type Surfactant (e) | 5 mg/m$^2$ |
| Gelatin Hardener (Compound (b)) | 110 mg/m$^2$ |
| Dye: a mixture of: | |
| Dye (a) | 53 mg/m$^2$ |
| Dye (b) | 14 mg/m$^2$ |
| Dye (c) | 25 mg/m$^2$ |
| Dye (d) | 18 mg/m$^2$ |

The developing solution used was the same as that used in Example 1.

The evaluation of these samples was conducted in the same manner as described in Example 1.

The results obtained are shown in Table 4 below.

An aqueous solution of silver nitrate and an aqueous solution of sodium chloride were added simultaneously to an aqueous gelatin solution maintained at 59° C. in the presence of $5.0\times10^{-6}$ mol/mol Ag of $(NH_4)_3RhCl_6$. After removing the soluble salts by a method well known in the art, gelatin was added to the emulsion. Then, 6-methyl-4-hydroxy-1,3,3a,7-tetraazaindene was added thereto as a stabilizer without conducting chemical sensitization. Thus, a cubic monodispersed emulsion having an average grain size of 0.15 μm was obtained (Emulsion C).

Emulsion D was prepared in the same manner as for Emulsion C except for changing the amount of $(NH_4)_3RhCl_6$ to $8.3\times10^{-6}$ mol/mol Ag.

Preparation of Coating Sample

On a polyethylene terephthalate film support (thickness: 150 μm) having a subbing layer (thickness: 0.5 μm) composed of a copolymer of vinylidene chloride, each layer of UL, EMU, ML, EMO and PC was coated in this order from the support side to prepare Samples 401 to 405.

Preparation and coating amount of each layer are shown below.

TABLE 4

| Sample No. | Compound of Formula (Q-1)/(Q-2) in EMU | Amount Added (mol/m$^2$) | Redox Compound in EMO | Amount Added (mol/m$^2$) | Photographic Property $\bar{G}$ | Photographic Property Dot Gradation | Black Pepper Fresh Solution | Black Pepper Fatigued Solution | Remarks |
|---|---|---|---|---|---|---|---|---|---|
| 301* | — | — | — | — | 13.4 | 1.21 | 29 | 63 | Comparison |
| 302* | Q-116 | $1.7\times10^{-6}$ | — | — | 13.8 | 1.23 | 5 | 8 | Present Invention |
| 303* | Q-203 | $2.0\times10^{-6}$ | — | — | 13.7 | 1.23 | 3 | 6 | Present Invention |
| 304 | — | — | R-3 | $1.3\times10^{-4}$ | 13.2 | 1.38 | 12 | 21 | Comparison |
| 305 | — | — | R-6 | " | 14.8 | 1.35 | 14 | 24 | " |
| 306 | — | — | R-9 | " | 12.8 | 1.39 | 15 | 23 | " |
| 307 | Q-116 | $1.7\times10^{-6}$ | R-3 | " | 13.3 | 1.38 | 2 | 3 | Present Invention |
| 308 | " | " | R-6 | " | 14.9 | 1.36 | 3 | 4 | Present Invention |
| 309 | " | " | R-9 | " | 13.0 | 1.38 | 1 | 2 | Present Invention |
| 310 | Q-202 | " | R-3 | " | 13.2 | 1.39 | 4 | 7 | Present Invention |
| 311 | " | " | R-6 | " | 14.6 | 1.35 | 5 | 10 | Present Invention |
| 312 | " | " | R-9 | " | 12.8 | 1.39 | 4 | 8 | Present Invention |

*The amount of compound I-5 used in EMU was reduced to $2\times10^{-5}$ mol/m$^2$.

From the results shown in Table 4, it can be seen that the occurrence of black peppers is restrained by using the compounds represented by general formula (Q-1) or (Q-2) together with the nucleating agent according to the present invention. Further, it is apparent that the use of the compounds represented by general formula (Q-1) or (Q-2) together with the nucleating agent according to the present invention is sufficiently effective to restrain the occurrence of black peppers when the redox compound according to the present invention is employed in EMO.

EXAMPLE 4

Preparation of Light-Sensitive Emulsion

UL

To a 3% aqueous solution of gelatin was added Compound (d) shown below, and the resulting solution was coated at a gelatin coating amount of 0.3 g/m$^2$ and a Compound (d) coating amount of 10 mg/m$^2$.

EMU:

Emulsion C described above was remelted. Then, added thereto were fine grains of polymer containing a hydrazine type nucleating agent, Compounds (a) to (d) shown below, 30% by weight of polyethyl acrylate based on gelatin, and 2% by weight of 1,3-bisvinylsulfonyl-2-propanol based on gelatin as a hardener. The resulting solution was coated at a silver coating amount of 3.8 g/m$^2$, a gelatin coating amount of 2 g/m$^2$ and a Compound I-5 coating amount of $7.5\times10^{-5}$ mol/m$^2$.

Compound (a)

-continued

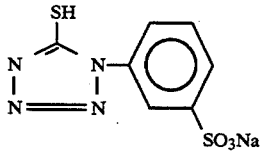

Compound (b)

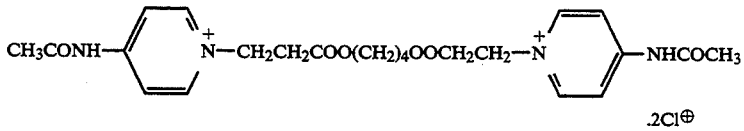

Compound (c)

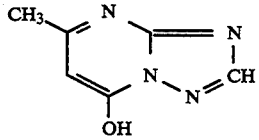

Compound (d)

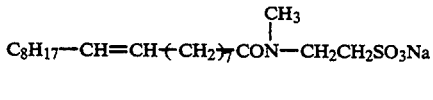

ML:

Ten g of gelatin was dissolved in an aqueous solution containing 0.12% of Compound (d) described above to prepare 300 ml of the solution, and the solution was coated at a gelatin coating amount of 1.0 g/m$^2$.

EMO:

Emulsion D described above was remelted, then added thereto were $7.5\times10^{-5}$ mol/m$^2$ of Compound R-3 capable of releasing a development inhibitor upon oxidation, 0.03 mg/m$^2$ of Compound (a) described above, 30% by weight of polyethyl acrylate based on gelatin and 2% by weight of 1,3-bisvinylsulfonyl-2-propanol based on gelatin as a hardener. The resulting solution was coated at a silver coating amount of 0.3 g/m$^2$ and a gelatin coating amount of 0.4 g/m$^2$.

PC:

To an aqueous gelatin solution were added polymethyl methacrylate particles (average particle size; 2.5 μm) as a matting agent, and Surfactants (e), (f) and (g) as coating aids, Stabilizers (h) and (i) and Ultraviolet Absorbing Agent (j) each shown below. The resulting solution was coated at a gelatin coating amount of 1.5 g/m$^2$ and a matting agent coating amount of 0.3 g/m$^2$.

| | |
|---|---|
| Surfactant (e) 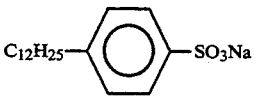 | 37 mg/m$^2$ |
| Surfactant (f) $CH_2COOC_6H_{13}$ \| $CHCOOC_6H_{13}$ \| $SO_3Na$ | 37 mg/m$^2$ |
| Surfactant (g) $C_8F_{17}SO_2N(C_3H_7)CH_2COOK$ | 2.5 mg/m$^2$ |
| Stabilizer (h) Thioctic acid | 2.5 mg/m$^2$ |
| Stabilizer (i) 1-Phenyl-5-mercaptotetrazole | 5.0 mg/m$^2$ |
| Ultraviolet Absorbing Agent (j) | 100 mg/m$^2$ |

-continued

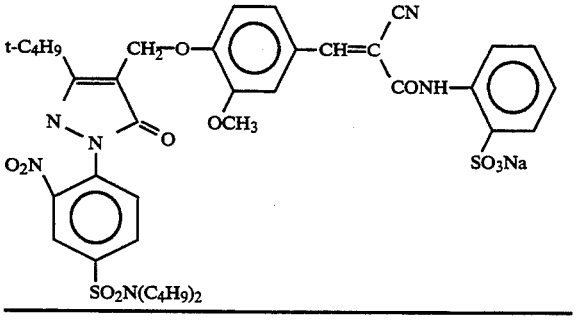

Preparation of Fine Grains of Polymer Containing Nucleating Agent

A solution containing 1.5 g of Nucleating Agent I-5, 3.0 g of Nucleating Agent I-30, 1.7 g of Melting Point Lowering Agent (A-1) shown below, 6.0 g of poly-tert-butylacrylamide and 50 ml of ethyl acetate was heated to 60° C. and added to 120 ml of aqueous solution containing 12 g of gelatin, 0.7 g of sodium dodecylbenzenesulfonate, and 20 mg of Proxel which has the structure:

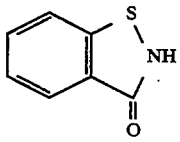

The mixture was stirred in a high speed agitator (Homogenizer manufactured by Nippon Seimitsu Seisakusho) to prepare an emulsion of fine particles. Then, ethyl acetate was removed therefrom by distillation under reduced pressure by heating. The average particle size of the emulsion was 0.13 μm.

Melting Point Lowering Agent (A-1)

-continued

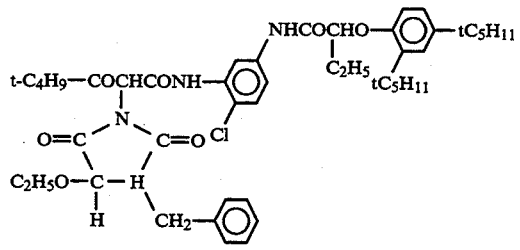

The compound represented by general formula (Q-1) or (Q-2) according to the present invention was added in EMU as shown in Table 5 below.

Each of these samples thus prepared was exposed to light using a bright room type printer P-607 manufactured by Dainippon Screen Mfg. Co., Ltd. through the original as illustrated in FIG. 1 of JP-A-2-293736, developed at 38° C. for 20 seconds, fixed, washed with water and dried.

The quality of the thus obtained superimposed letter images was evaluated. The quality "5" of superimposed letter images refers to a quality such that when the original as illustrated in FIG. 1 of JP-A-2-293736 and a contact-type light-sensitive material were arranged, and the correct exposure was applied thereto by which 50% dot area on the halftone original could be reproduced as 50% dot area on the light-sensitive material, was given, letter images having a line width of 30 μm could be reproduced on the light-sensitive material, that is to say, a very excellent quality. On the other hand, the quality "1" of superimposed letter images refers to a quality such that when the same correct exposure as described above was applied, letter images having a line width of 150 μm or more could barely be reproduced, that is, the quality was quite inferior. The three ranks 4, 3, and 2 were designated between the quality "5" and the quality "1" on a basis of sensory evaluation. The ranks 3 or higher were practically usable.

The results obtained are shown in Table 5 below.

TABLE 5

| Sample No. | Compound of Formula (Q-1)/(Q-2) in EMU | Amount Added (mol/m²) | Photographic Property $\bar{G}$ | Photographic Property Dot Gradation | Dot Quality | Black Pepper | Remarks |
|---|---|---|---|---|---|---|---|
| 401 | — | — | 12.7 | 1.40 | 4 | 36 | Comparison |
| 402 | Q-119 | $2.5 \times 10^{-6}$ | 12.3 | 1.40 | 5 | 7 | Present Invention |
| 403 | Q-113 | " | 12.6 | 1.41 | 5 | 3 | Present Invention |
| 404 | Q-116 | " | 12.1 | 1.43 | 5 | 4 | Present Invention |
| 405 | Q-208 | " | 12.5 | 1.40 | 5 | 10 | Present Invention |

From the results shown in Table 5, it can be seen that in Samples 402 to 405 according to the present invention the dot quality is excellent, the occurrence of black peppers is very low and the good photographic properties are obtained. Also, the samples of the present invention are excellent in the quality of superimposed letter image.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon a silver halide emulsion layer containing at least one nucleating agent represented by general formula (N-1) shown below, wherein the silver halide photographic material contains at least one compound represented by general formula (Q-2) shown below in said silver halide emulsion layer and/or in a hydrophilic colloid layer adjacent thereto which does not contain a silver halide emulsion:

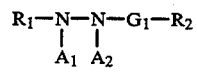

(N-1)

wherein $R_1$ represents an aliphatic group or an aromatic group; $R_2$ represents a hydrogen atom, an alkyl group, an aralkyl group, an aryl group, an alkoxyl group, an aryloxyl group, an amino group, a hydrazino group, a carbamoyl group, or an oxycarbonyl group; $G_1$ represents

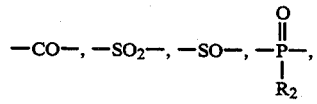

(wherein $R_2$ is as defined above,

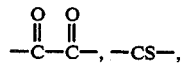

or an iminomethylene group; $A_1$ and $A_2$ each represents a hydrogen atom, or one of $A_1$ and $A_2$ represents a hydrogen atom, and the other represents an unsubstituted alkylsulfonyl group, an alkylsulfonyl group substituted by a halogen atom, an ether group, a sulfonamido group, a carbonamido group, a hydroxy group, a carboxy group or a sulfonic group, an unsubstituted arylsulfonyl group, an arylsulfonyl group substituted by a halogen atom, an ether group, a sulfonamido group, a carbonamido group, a hydroxy group, a carboxy group or a sulfonic group, an unsubstituted acyl group, or an acyl group substituted by a halogen atom, an ether group, a sulfonamido group, a carbonamido group, a hydroxy group, a carboxy group or a sulfonic group,

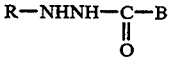

(Q-2)

wherein R represents an aromatic group; and B represents an unsubstituted phenyl group, an unsubstituted naphthyl group, or a phenyl or naphthyl group substituted by an unsubstituted alkyl group, a halogen-substituted alkyl group, an aralkyl group, an alkenyl group, an alkynyl group, an alkoxy group, an aryl group, an amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an alkyloxycarbonyl group, an aryloxycarbonyl group, an acyl group, an acyloxy group, a carbonamido group, a sulfonamido group, or a nitro group.

2. A silver halide photographic material as claimed in claim 1, wherein $R_1$ represents an aryl group.

3. A silver halide photographic material as claimed in claim 1, wherein $G_1$ represents a carbonyl group.

4. A silver halide photographic material as claimed in claim 1, wherein $R_2$ represents a group represented by the following general formula (a):

$$-R_3-Z_1 \qquad \text{(a)}$$

wherein $Z_1$ represents a group which nucleophilically attacks $G_1$ to split the $G_1$—$R_3$—$Z_1$ moiety from the remainder of formula (N-1); $R_3$ represents a group derived by removing one hydrogen atom from $R_2$; and $R_3$ and $Z_1$ form a cyclic structure together with $G_1$ upon nucleophilic attack of $Z_1$ on $G_1$.

5. A silver halide photographic material as claimed in claim 4, wherein the group represented by the general formula (a) is a group represented by the following general formula (b) or (c):

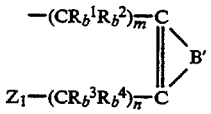

(b)

wherein $Z_1$ is as defined above; $R_b^1$, $R_b^2$, $R_b^3$, and $R_b^4$ which may be the same or different, each represents a hydrogen atom, an alkyl group, an alkenyl group or an aryl group; B' represents an atomic group necessary to form a 5-membered or 6-membered ring; m and n each represents 0 or 1; and (n+m) is 1 or 2

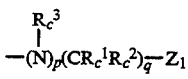

(c)

wherein $Z_1$ is as defined above; $R_c^1$ and $R_c^2$, which may be the same or different, each represents a hydrogen atom, an alkyl group, an alkenyl group, an aryl group or a halogen atom; $R_c^3$ represents a hydrogen atom, an alkyl group, an alkenyl group or an aryl group; p represents an integer of from 0 to 2; q represents an integer of from 1 to 4; and $R_c^1$, $R_c^2$, and $R_c^3$ may be taken together to form a ring provided that $Z_1$ is capable of intramolecular nucleophilic attack on $G_1$.

6. A silver halide photographic material as claimed in claim 1, wherein $A_1$ and $A_2$ each represents a hydrogen atom.

7. A silver halide photographic material as claimed in claim 1, wherein an amount of the nucleating agent is from $1\times10^{-6}$ mol to $5\times10^{-1}$ mol per mol of silver halide.

8. A silver halide photographic material as claimed in claim 1, wherein R represents an aromatic group.

9. A silver halide photographic material comprising a support having provided thereon a first silver halide emulsion layer (1), a hydrophilic colloid layer (2), a second silver halide emulsion layer (3) and a protective layer (4) in this order from the support, wherein (1) or (3) contains at least one nucleating agent represented by general formula (N-1) described below, the silver halide emulsion layer which does not contain the nucleating agent contains at least one redox compound capable of releasing a development inhibitor upon being oxidized, said redox compound being represented by general formula (R-1), (R-2) or (R-3) described below, and the silver halide emulsion layer containing the nucleating agent and/or a hydrophilic colloid layer adjacent thereto which does not contain a silver halide emulsion contains at least one compound represented by general formula (Q-2) described below:

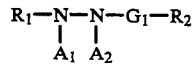

(N-1)

wherein $R_1$ represents an aliphatic group or an aromatic group; $R_2$ represents a hydrogen atom, an alkyl group, an aryl group, an alkoxyl group, an aryloxyl group, an amino group, a hydrazino group, a carbamoyl group, or an oxycarbonyl group; $G_1$ represents $$-CO-,\ -SO_2-,\ -SO-,$$

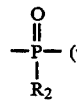

(wherein $R_2$ is as defined above),

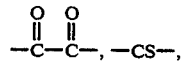

or an iminomethylene group; $A_1$ and $A_2$ each represents a hydrogen atom, or one of $A_1$ and $A_2$ represents a hydrogen atom, and the other represents an unsubstituted alkylsulfonyl group, an alkylsulfonyl group substituted by halogen atom, ether group, sulfonamido group, carbonamido group, hydroxy group, carboxy group or sulfonic group, an unsubstituted arylsulfonyl group, an arylsulfonyl group substituted by halogen atom, ether group, sulfonamido group, carbonamido group, hydroxy group, carboxy group or sulfonic group, an unsubstituted acyl group, or an acyl group substituted by halogen atom, ether group, sulfonamido group, carbonamido group, hydroxy group, carboxy group or sulfonic group;

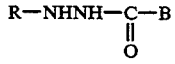

(Q-2)

wherein R represents an aromatic group; and B represents an unsubstituted phenyl group, an unsubstituted naphthyl group, or a phenyl or naphthyl group substituted by an unsubstituted alkyl group, a halogen-substituted alkyl group, an aralkyl group, an alkenyl group, an alkynyl group, an alkoxy group, an aryl group, an amino group, an aryloxyl group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an alkyloxycarbonyl group, an aryloxycarbonyl group, an acyl group, an acyloxy group, a carbonamido group, a sulfonamido group, or a nitro group;

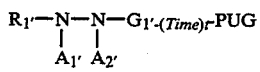

(R-1)

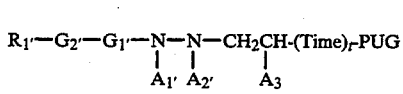

(R-2)

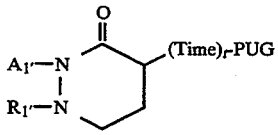

(R-3)

wherein $R_{1'}$ represents an aliphatic or aromatic group; $G_{1'}$ represents

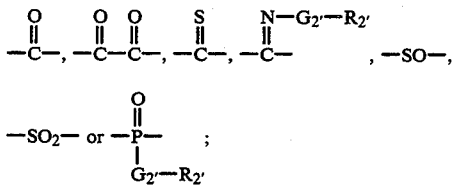

; $G_{2'}$ represents a mere bond, —O—, —S— or

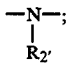

$R_{2'}$ represents a hydrogen atom or $R_{1'}$; and $A_{1'}$ and $A_{2'}$ each represents a hydrogen atom, an unsubstituted alkylsulfonyl group, an alkylsulfonyl group substituted by halogen atom, ether group, sulfonamido group, carbonamido group, hydroxy group, carboxy group or sulfonic group, an unsubstituted arylsulfonyl group, an arylsulfonyl group substituted by halogen atom, ether group, sulfonamido group, carbonamido group, hydroxy group, carboxy group or sulfonic group, an unsubstituted acyl group, an acyl group substituted by halogen atom, ether group, sulfonamido group, carbonamido group, hydroxy group, carboxy group or sulfonic group, provided that in general formula (R-1), at least one of $A_{1'}$ and $A_{2'}$ is a hydrogen atom; $A_3$ has the same meaning as $A_{1'}$ or represents a

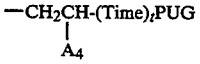

group; $A_4$ represents a nitro group, a cyano group, a carboxyl group, a sulfonyl group or a $—G_1—G_2—R_{1'}$ group; Time represents a divalent connecting group; t represents 0 or 1; and PUG represents a development inhibitor which is soluble in a developing solution and capable of changing into a compound of less development inhibiting activity upon a reaction with a component of the developing solution, further provided that when two or more moieties of $R_2$ or $—G_1—G_2—R_{1'}$ are present in the molecule of the compound, these moieties may be the same or different.

10. A silver halide photographic material as claimed in claim 1, wherein an amount of the compound represented by general formula (Q-2) is from $1\times10^{-3}$ mol to 10 mols per mol of the nucleating agent.

11. A silver halide photographic material as claimed in claim 1, wherein the silver halide photographic material further contains a redox compound capable of releasing a development inhibitor upon being oxidized.

12. A silver halide photographic material as claimed in claim 11, wherein the redox compound is a hydrazine compound represented by the following general formula (R-1), (R-2) or (R-3):

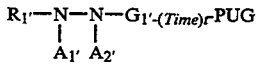

(R-1)

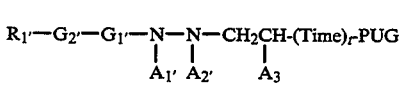

(R-2)

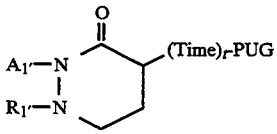

(R-3)

wherein $R_{1'}$ represents an aliphatic group or an aromatic group $G_{1'}$ represents

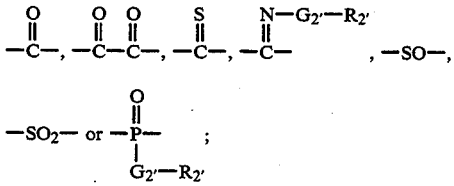

$G_{2'}$ represents a mere bond —O—, —S— or

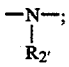

$R_{2'}$ represents a hydrogen atom or $R_{1'}$; and $A_{1'}$ and $A_{2'}$ each represents a hydrogen atom, an unsubstituted alkylsulfonyl group, an alkylsulfonyl group substituted by halogen atom, ether group, sulfonamido group, carbonamido group, hydroxy group, carboxy group or sulfonic group, an unsubstituted arylsulfonyl group, an arylsulfonyl group substituted by halogen atom, ether group, sulfonamido group, carbonamido group, hydroxy group, carboxy group or sulfonic group, an unsubstituted acyl group, or an acyl group substituted by halogen atom, ether group, sulfonamido group, carbonamido group, hydroxy group, carboxy group or sulfonic group, provided that in general formula (R-1), at least one of $A_1$, and $A_2$, is hydrogen atom; $A_a$ has the same meaning as $A_1$, or represents

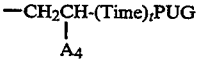

group; $A_4$ represents a nitro group, a cyano group, a carboxyl group, a sulfonyl group or a $—G_1—G_2—R_{1'}$ group; Time represents a divalent connecting group; t represents 0 or 1; and PUG represents a development inhibitor.

13. A silver halide photographic material as claimed in claim 12, wherein $R_{1'}$ represents an aryl group.

14. A silver halide photographic material as claimed in claim 12, wherein $G_{1'}$ represents $$-\overset{\overset{\displaystyle O}{\|}}{C}-.$$

15. A silver halide photographic material as claimed in claim 12, wherein $A_{1'}$ and $A_{2'}$ each represents a hydrogen atom.

16. A silver halide photographic material as claimed in claim 12, wherein $A_3$ represents a hydrogen atom or $$-CH_2\underset{\underset{\displaystyle A_4}{|}}{C}H\text{-}(\text{Time})_t\text{-PUG}.$$

17. A silver halide photographic material as claimed in claim 12, wherein the development inhibitor represented by PUG is a nucleating development inhibitor.

18. A silver halide photographic material as claimed in claim 17, wherein the PUG is a group represented by the following general formula (P-1), ( P-2) or (P-3):

$$-X_1\begin{matrix} X_2 \\ X_3 \end{matrix} \qquad \text{(P-1)}$$

wherein $X_1$ represents a trivalent organic group; $X_2$ represents a group which is capable of changing into an anionic functional group upon a reaction with a component of a developing solution; and $X_3$ represents a group which exhibits a nucleating development inhibiting effect;

$$-Y_1-Y_2-Y_3 \qquad \text{(P-2)}$$

wherein $Y_1$ represents a divalent organic group; $Y_2$ represents a divalent group which is capable of being cleaved upon a reaction with a component of a developing solution; and $Y_3$ represents a group which exhibits a nucleating development inhibiting effect;

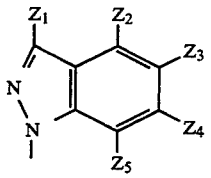

(P-3)

wherein $Z_1$ to $Z_5$ each represents a hydrogen atom or a monovalent group, provided that $Z_1$ to $Z_5$ meet at least one of the following requirements:

(1) at least one of $Z_2$ and $Z_5$ is a nitro group, (2) at least one of $Z_3$ and $Z_4$ is a nitro group and at least two of $Z_1$ to $Z_5$ are electron withdrawing groups, and (3) at least one of $Z_3$ and $Z_4$ is a nitro group and $Z_1$ is an aliphatic or aromatic group.

19. A silver halide photographic material as claimed in claim 11, wherein an amount of the redox compound is from $1\times10^{-6}$ mol to $5\times10^{-2}$ mol per mol of silver halide.

20. A silver halide photographic material as claimed in claim 1, wherein the substituent for the substituted phenyl or naphthyl group is a halogen-substituted alkyl group, an alkoxy group, a halogen atom, a cyano group, an alkyloxycarbonyl group, or a nitro group.

21. A silver halide photographic material as claimed in claim 1, wherein R in general formula (Q-2) contains a substituent represented by general formula (R):

$$R_{1''}-L-Y-\underset{\underset{\displaystyle R_{2'}}{|}}{N}- \qquad \text{(R)}$$

wherein Y represents $$-CO-,\ -SO_2-,\ \text{or}\ -\overset{\overset{\displaystyle O}{\|}}{\underset{\underset{\displaystyle R_3}{|}}{P}}-$$

(wherein $R_3$ represents an alkoxy group or an aryloxy group); L represents a mere bond, $$-O-,\ -S-,\ \text{or}\ -\underset{\underset{\displaystyle R_4}{|}}{N}-$$

(wherein $R_4$ represents a hydrogen atom, an aliphatic group, or an aromatic group); and $R_{1''}$ and $R_{2'}$ which may be the same or different, each represents a hydrogen atom, an aromatic group, an aliphatic group, or a heterocyclic group, or $R_{1''}$ and $R_{2'}$ may be connected to each other to form a ring.

22. A silver halide photographic material as claimed in claim 21, wherein Y represents $-SO_2-$, $R_{1''}$ represents an aromatic group, $R_{2'}$ represents a hydrogen atom, and L represents a mere bond.

* * * * *

UNITED STATES PATENT AND TRADEMARK OFFICE

CERTIFICATE OF CORRECTION

PATENT NO. : 5,447,835

DATED : September 5, 1995

INVENTOR(S) : Minoru Sakai, et al.

It is certified that error appears in the above-indentified patent and that said Letters Patent is hereby corrected as shown below:

On the title page, item [30], delete "3-12812" and insert --3-128212--.

Signed and Sealed this

Twenty-seventh Day of February, 1996

*Attest:*

Bruce Lehman

BRUCE LEHMAN

*Attesting Officer*

*Commissioner of Patents and Trademarks*